US010571850B2

(12) United States Patent
Matsuoka et al.

(10) Patent No.: US 10,571,850 B2
(45) Date of Patent: Feb. 25, 2020

(54) END MEMBER, PHOTORECEPTOR DRUM UNIT, AND PROCESS CARTRIDGE

(71) Applicant: Mitsubishi Chemical Corporation, Chiyoda-ku (JP)

(72) Inventors: Yohei Matsuoka, Kanagawa (JP); Shuichi Ikeda, Kanagawa (JP); Yasunori Kawai, Kanagawa (JP); Kozo Ishio, Kanagawa (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 16/002,396

(22) Filed: Jun. 7, 2018

(65) Prior Publication Data

US 2018/0284686 A1 Oct. 4, 2018

Related U.S. Application Data

(63) Continuation of application No. PCT/JP2016/086243, filed on Dec. 6, 2016.

(30) Foreign Application Priority Data

Dec. 7, 2015 (JP) ..... 2015-238591

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01); *G03G 21/1864* (2013.01); *G03G 2221/1657* (2013.01)

(58) Field of Classification Search
CPC ..... G03G 15/757; G03G 21/186; G03G 21/1864; G03G 2221/1657
See application file for complete search history.

(56) References Cited

U.S. PATENT DOCUMENTS 8,295,734 B2 * 10/2012 Ueno ..... G03G 15/757 399/167
8,417,154 B2 * 4/2013 Nieda ..... G03G 15/757 399/167

(Continued)

FOREIGN PATENT DOCUMENTS

JP 2010-26473 2/2010
JP 2010-55055 3/2010

(Continued)

OTHER PUBLICATIONS

Extended European Search Report dated Sep. 28, 2018 in Patent Application No. 16872981.2, 10 pages.

(Continued)

*Primary Examiner* — Francis C Gray
(74) *Attorney, Agent, or Firm* — Oblon, McClelland, Maier & Neustadt, L.L.P.

(57) ABSTRACT

An end member is disposed in an end portion of a columnar rotating body, comprising: a shaft member; and a bearing member which holds the shaft member, wherein the shaft member comprises: a rotating shaft; and a rotating force receiving portion, and wherein at least one of the shaft member and the bearing member has a mechanism where the rotating force receiving portion moves also in a shaft line direction without be inclined by a movement of the rotating force receiving portion in a direction orthogonal to the shaft line direction or by a rotation of the rotating force receiving portion around a shaft line.

14 Claims, 75 Drawing Sheets

(56) References Cited

U.S. PATENT DOCUMENTS

| | | | | |
|---|---|---|---|---|
| 9,684,274 | B2 * | 6/2017 | Huang | G03G 21/1857 |
| 10,185,277 | B1 * | 1/2019 | Wu | G03G 15/757 |
| 2006/0153587 | A1 * | 7/2006 | Omura | G03G 15/50 399/89 |
| 2007/0122188 | A1 * | 5/2007 | Igarashi | G03G 15/0806 399/119 |
| 2010/0034561 | A1 | 2/2010 | Batori et al. | |
| 2011/0159970 | A1 * | 6/2011 | Okabe | G03G 21/1864 464/169 |
| 2011/0182619 | A1 | 7/2011 | Batori et al. | |
| 2011/0217073 | A1 * | 9/2011 | He | G03G 15/757 399/111 |
| 2011/0255900 | A1 * | 10/2011 | Zhou | G03G 15/757 399/111 |
| 2013/0230337 | A1 | 9/2013 | Batori et al. | |
| 2014/0086632 | A1 | 3/2014 | Batori et al. | |
| 2014/0086633 | A1 | 3/2014 | Batori et al. | |
| 2015/0050048 | A1 * | 2/2015 | Huang | G03G 15/757 399/167 |
| 2015/0093150 | A1 | 4/2015 | Xiao et al. | |
| 2015/0185693 | A1 * | 7/2015 | Wang | G03G 21/1857 399/111 |
| 2016/0048103 | A1 * | 2/2016 | Ikeda | F16D 1/06 399/111 |
| 2016/0246250 | A1 * | 8/2016 | Kamoshida | G03G 21/1853 |
| 2016/0370750 | A1 * | 12/2016 | Ikeda | G03G 15/757 |
| 2017/0219985 | A1 * | 8/2017 | Iijima | G03G 15/757 |

FOREIGN PATENT DOCUMENTS

| | | | |
|---|---|---|---|
| JP | 2015034565 | A * | 2/2015 |
| WO | WO 2015/133552 | A1 | 9/2015 |

OTHER PUBLICATIONS

International Search Report dated Jan. 31, 2017 in PCT/JP2016/086243, filed on Dec. 6, 2016 (with English Translation).

Written Opinion dated Jan. 31, 2017 in PCT/JP2016/086243, filed on Dec. 6, 2016.

Japan Institute of Invention and Innovation, Journal of Technical Disclosure No. 2010-502200, 31 pages.

* cited by examiner

END MEMBER, PHOTORECEPTOR DRUM UNIT, AND PROCESS CARTRIDGE

CROSS-REFERENCES TO RELATED APPLICATIONS

This application is a Continuation of PCT/JP2016/086243, which was filed on Dec. 6, 2016. This application is based upon and claims the benefit of priority to Japanese Application No. 2015-238591, which was filed on Dec. 7, 2015.

TECHNICAL FIELD

The present invention relates to a process cartridge which is attachable to and detachable from an image forming apparatus, such as a laser printer or a copying machine, a photoreceptor drum unit which is provided in the process cartridge, and an end member which is attached to a columnar rotating body, such as a photoreceptor drum or a developing roller.

BACKGROUND ART

In an image forming apparatus, such as a laser printer or a copying machine, a process cartridge which is attachable to and detachable from a main body (hereinafter, referred to as an "apparatus main body") of the image forming apparatus is provided.

The process cartridge is a member which forms contents to be expressed by letters or figures and transfers the contents to a recording medium, such as a paper sheet. More specifically, in the process cartridge, the photoreceptor drum is included, and the contents to be transferred are formed onto the photoreceptor drum. In addition, in the process cartridge, various other means for forming the contents to be transferred onto the photoreceptor drum are also disposed. Examples of the means include a developing roller unit, a charging roller unit, and means for performing cleaning.

The process cartridge attaches and detaches the same process cartridge to and from the apparatus main body for maintenance, or disengages an old process cartridge from the apparatus main body and mounts a new process cartridge on the apparatus main body. Attaching and detaching the process cartridge in this manner can be performed by users of the image forming apparatus themselves, and from this point of view, it is desirable to perform attaching and detaching as easily as possible.

Meanwhile, the photoreceptor drum included in the process cartridge is configured to be engaged with a driving shaft of the apparatus main body directly or via another member, and accordingly, to receive a rotating force from the driving shaft and to rotate. Therefore, in order to attach and detach the process cartridge to and from the apparatus main body, it is necessary to release (disengage) the engagement between the driving shaft of the apparatus main body and the photoreceptor drum every time attaching and detaching occur, and to mount the process cartridge again.

Here, if it is possible to move the photoreceptor drum (process cartridge) in the shaft line direction of the driving shaft of the apparatus main body, and to attach and detach the photoreceptor drum to and from the driving shaft, the configuration of the apparatus can be relatively simple. However, from the viewpoint of reducing the image forming apparatus in size or ensuring an attachment and detachment space of the process cartridge, it is preferable to disengage the process cartridge from the apparatus main body to be pulled out in the direction which is different from the shaft line direction of the driving shaft, and to mount the process cartridge on the apparatus main body to be pushed in a direction opposite to the direction.

In PTL 1, a configuration for attaching and detaching a process cartridge in a direction different from the shaft line direction of the driving shaft of the apparatus main body, is disclosed. Specifically, a coupling member described in PTL 1 is swingably attached to a drum flange (bearing member) by providing a spherical portion. Therefore, a part (rotating force receiving member) which is provided in the coupling member and is engaged with the driving shaft of the apparatus main body can swing around the spherical portion and change an angle with respect to the shaft line of the photoreceptor drum, and it is easy to mount and disengage the driving shaft of the apparatus main body and the photoreceptor drum to and from each other.

In addition, in the invention described in NPL 1, in a structure in which a swinging shaft member is linked to a bearing member, a groove for introducing a rotating force transmission pin provided in the shaft member into the bearing member is provided on an inner circumferential side of the bearing member. The groove is formed so as to extend in a rotational direction, and it becomes easy to attach the rotating force transmission pin to the bearing member by the groove.

CITATION LIST

Patent Literature

[PTL 1] JP-A-2010-26473

Non Patent Literature

[NPL 1] Japan Institute of Invention and Innovation, Journal of technical disclosure 2010-502200

SUMMARY OF INVENTION

Technical Problem

However, in the inventions described in PTL 1 and NPL 1, there is a case where attachment and detachment of the process cartridge and the apparatus main body to and from each other are unlikely to be smoothly performed. Specifically, for example, high accuracy is required for each member in order to exhibit necessary functions, and the influence on the performance due to the variation in quality of the shaft member is great.

In consideration of the above-described problems, an object of the present invention is to provide an end member which can be smoothly mounted on an apparatus main body. In addition, another object of the present invention is to provide a photoreceptor drum unit including the end member and a process cartridge.

Solution to Problem

Hereinafter, the present invention will be described.

The present invention is an end member which is disposed in an end portion of a columnar rotating body, comprising: a shaft member; and a bearing member which holds the shaft member, wherein the shaft member comprises: a rotating shaft; and a rotating force receiving portion which is provided on one end side of the rotating shaft, is engageable with a rotating force imparting portion of an image forming apparatus main body, and receives a rotating force from a driving shaft in the engaged posture, and wherein at least one of the shaft member and the bearing member has a mechanism where the rotating force receiving portion moves also in a shaft line direction without be inclined by a movement of the rotating force receiving portion in a direction orthogonal to the shaft line direction or by a rotation of the rotating force receiving portion around a shaft line.

The present invention is an end member which is mounted on an image forming apparatus main body having a groove that guides a rotating force receiving portion, and is disposed in an end portion of a columnar rotating body, the end member comprising: a shaft member; and a bearing member which holds the shaft member, wherein the shaft member comprises: a rotating shaft; and the rotating force receiving portion which is provided on one end side of the rotating shaft, is engageable with a rotating force imparting portion of the image forming apparatus main body, and receives a rotating force from a driving shaft in the engaged posture, and wherein at least one of the shaft member and the bearing member has a mechanism where the rotating force receiving portion moves also in a shaft line direction without be inclined by a movement of the rotating force receiving portion in a direction orthogonal to the shaft line direction or by a rotation of the rotating force receiving portion around a shaft line.

According to the aspect of the present invention, for example, the mechanism comprises a projection provided in the bearing member, and the rotating force receiving portion moves by the shaft member moving along a surface of the projection.

According to the aspect of the present invention, for example, the mechanism comprises a cam member provided with a pin having a shaft line that becomes a twist position, and the rotating force receiving portion moves by inclination of the cam member.

According to the aspect of the present invention, for example, the mechanism comprises; a hole that is provided in the bearing member and is twisted such that a sectional shape is deviated along a shaft line direction; and a twisted pillar-like member which is provided in the shaft member and is inserted into the hole.

According to the aspect of the present invention, for example, the mechanism comprises an inclined surface provided in the bearing member, and is configured such that the shaft member moves also in the shaft line direction by the shaft member moving in a direction orthogonal to the shaft line while sliding on the inclined surface.

The present invention is an end member which is disposed in an end portion of a columnar rotating body, comprising: a shaft member; and a bearing member which holds the shaft member, wherein the shaft member comprises: a rotating shaft; a rotating force receiving portion which is provided on one end side of the rotating shaft, is engageable with a rotating force imparting portion of an image forming apparatus main body, and receives a rotating force from a driving shaft in the engaged posture; and a base end portion which becomes thin toward a tip end and is provided in an end portion on a side opposite to a side on which the rotating force receiving portion is disposed, wherein the bearing member comprises a projection which extends toward a shaft line direction, and wherein the rotating force receiving portion is movable by the base end portion moving along a surface of the projection.

According to the aspect of the present invention, for example, a rotating force transmission pin for transmitting a rotating force, is further provided in the base end portion.

According to the aspect of the present invention, for example, a rotating force receiving portion for receiving a rotating force from the rotating force transmission pin, is further provided in the bearing member.

The present invention is an end member which is disposed in an end portion of a columnar rotating body, comprising: a shaft member; and a bearing member which holds the shaft member, wherein the shaft member comprises: a rotating shaft; and a rotating force receiving portion which is provided on one end side of the rotating shaft, is engageable with a rotating force imparting portion of an image forming apparatus main body, and receives a rotating force from a driving shaft in the engaged posture, and wherein at least one of the shaft member and the bearing member has a mechanism which moves the shaft member in a shaft line direction without inclining the rotating force receiving portion by providing a member which presses the shaft member in the shaft line direction due to deformation caused by an external force.

The present invention is a photoreceptor drum unit comprising: a photoreceptor drum which is the columnar rotating body; and the above-described end member which is disposed at least one end portion of the photoreceptor drum.

The present invention is a process cartridge comprising: a housing; and the above-described photoreceptor drum unit held by the housing.

According to the aspect of the present invention, for example, the housing comprises: a biasing member holding the shaft member in a posture of being deviated from a shaft line of the bearing member.

The present invention is an image forming apparatus comprising: the above-described end member; and an image forming apparatus main body in which a groove which guides the rotating force receiving portion provided in the shaft member of the end member is formed.

Advantageous Effects of Invention

According to the present invention, since engagement between the end member and the driving shaft is performed without inclining (swinging) the rotating force receiving portion, smooth engagement between the end member and the driving shaft is possible.

DESCRIPTION OF EMBODIMENTS

Figure 1:
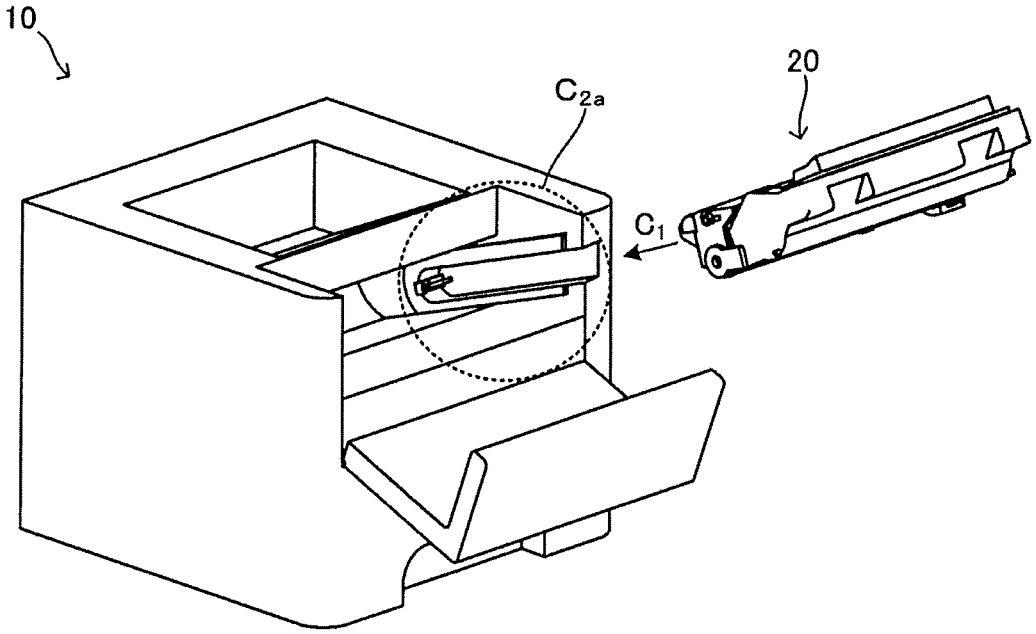
FIG. 1 is an external view of an image forming apparatus main body 10 and a process cartridge 20.

Hereinafter, the present invention will be described based on aspects illustrated in the drawings. However, the present invention is not limited to the aspects. In addition, in each of the drawings, for the description, members are expressed being omitted and seen through, or the shape is exaggerated as necessary. In addition, in sectional views, hatching may be applied to a surface that becomes an end surface.

FIG. 1 is a view describing a first aspect, and is a perspective view schematically illustrating a process cartridge 20 including an end member 40 (refer to FIG. 6) and an image forming apparatus main body 10 (hereinafter, there is a case of being described as "apparatus main body 10") which mounts and uses the process cartridge 20. As illustrated in FIG. 1, the process cartridge 20 can be mounted on the apparatus main body 10 by moving in a direction indicated by $C_1$ in FIG. 1, and can be disengaged from the apparatus main body 10 by moving the process cartridge 20 in a direction reverse thereto. The direction $C_1$ is a direction different from the shaft line direction of a driving shaft 12 (refer to FIG. 4) of the apparatus main body 10. In addition, the apparatus main body 10 and the process cartridge 20 configure an image forming apparatus. Hereinafter, details will be described.

The apparatus main body 10 of the aspect is a laser printer. In the laser printer, the above-described process cartridge 20 operates in a mounted posture, and when the image is formed, the photoreceptor drum 35 (refer to FIG. 6) is rotated, and charging is performed by the charging roller unit. In this state, the photoreceptor drum 35 is irradiated with the laser light which corresponds to image information by using various optical members provided here, and the electrostatic latent image which is based on the image information is obtained. The latent image is developed by the developing roller unit.

Meanwhile, the recording medium, such as a paper sheet, is set in the apparatus main body 10, and is conveyed to a transfer position by a sending roller or a conveying roller, which is provided in the apparatus main body 10. A transfer roller is disposed at the transfer position, voltage is applied to the transfer roller following the passage of the recording medium, and the image is transferred to the recording medium from the photoreceptor drum 35. After this, the image is fixed to the recording medium as heat and pressure are applied to the recording medium. In addition, the recording medium on which the image from the apparatus main body 10 is formed is discharged by a discharge roller.

Figure 6A:
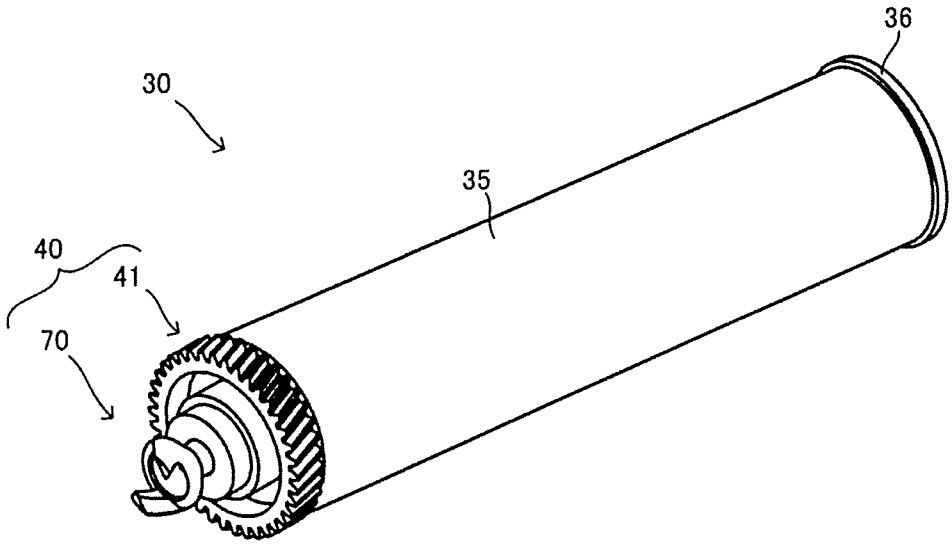
FIG. 6A is an external perspective view of a photoreceptor drum unit 30.

In this manner, in a posture in which the process cartridge 20 is mounted, the apparatus main body 10 applies the rotation driving force to the photoreceptor drum unit 30 (refer to FIG. 6A).

Figure 2A:
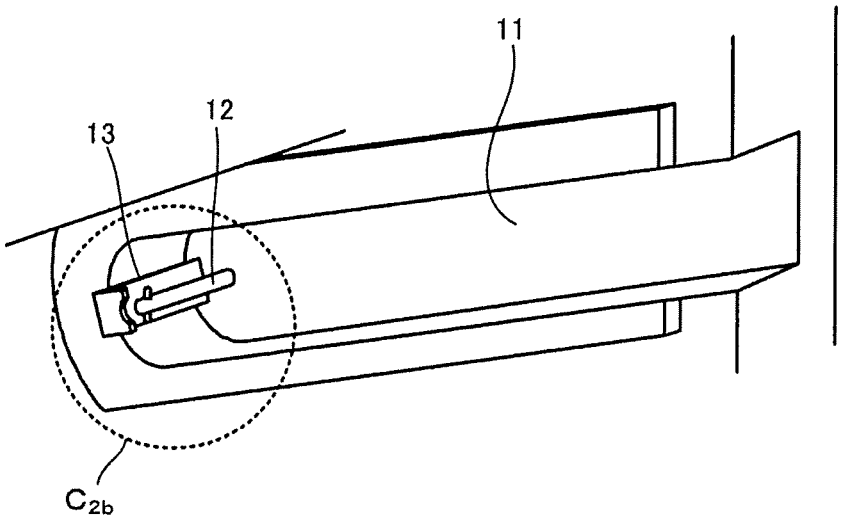
FIG. 2A is a view focusing on a guide groove 11 part of the apparatus main body 10.

Among such an apparatus main body 10, a part indicated by $C_{2a}$ in FIG. 1 will be described. Since other parts can be configured similar to the known apparatus main body 10, the description will be omitted here. In FIG. 2A, the part indicated by $C_{2a}$ in FIG. 1 is illustrated in an enlarged manner. In addition, in FIG. 2B, the part indicated by $C_{2b}$ is enlarged and illustrated in FIG. 2A.

The part indicated by $C_{2a}$ in the apparatus main body 10 is the part at which a side on which the end member 40 is disposed in an end portion of the process cartridge 20 moves, and the driving shaft 12 of the apparatus main body 10 with which the end member 40 is engaged for receiving a rotating force protrudes. As can be ascertained from FIGS. 1, 2A, and 2B, the part is configured to have a guide groove 11, a driving shaft 12, and an auxiliary member 13.

The guide groove 11 is a groove which extends from the outside to the driving shaft 12, and the end portion of the process cartridge 20 is moved and guided in the groove. Therefore, the width or the depth of the groove may be formed such that the end portion on the side on which the end member 40 is disposed in the process cartridge 20 is appropriately guided.

Figure 2B:
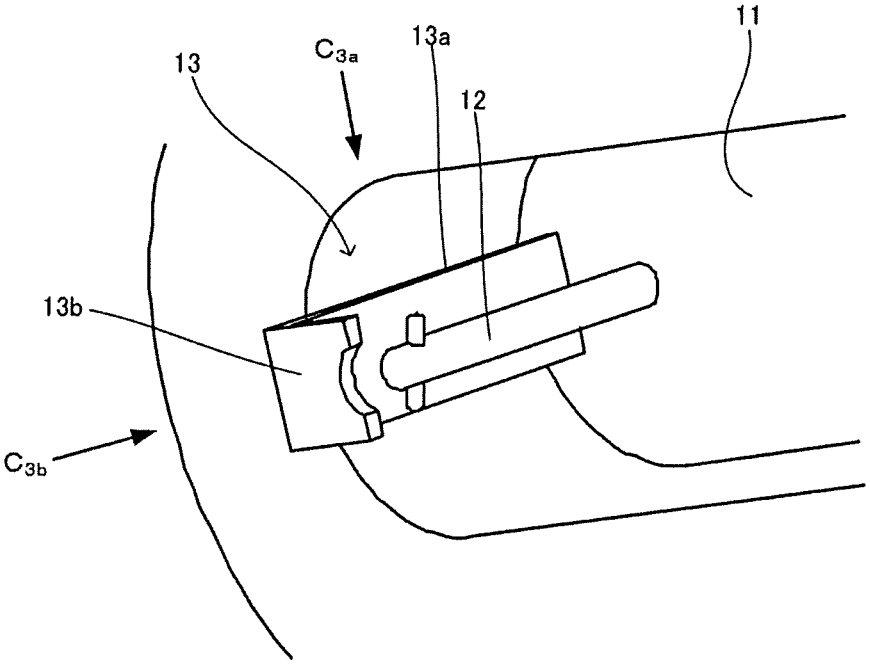
FIG. 2B is an enlarged view of a part of FIG. 2A.
Figure 3A:
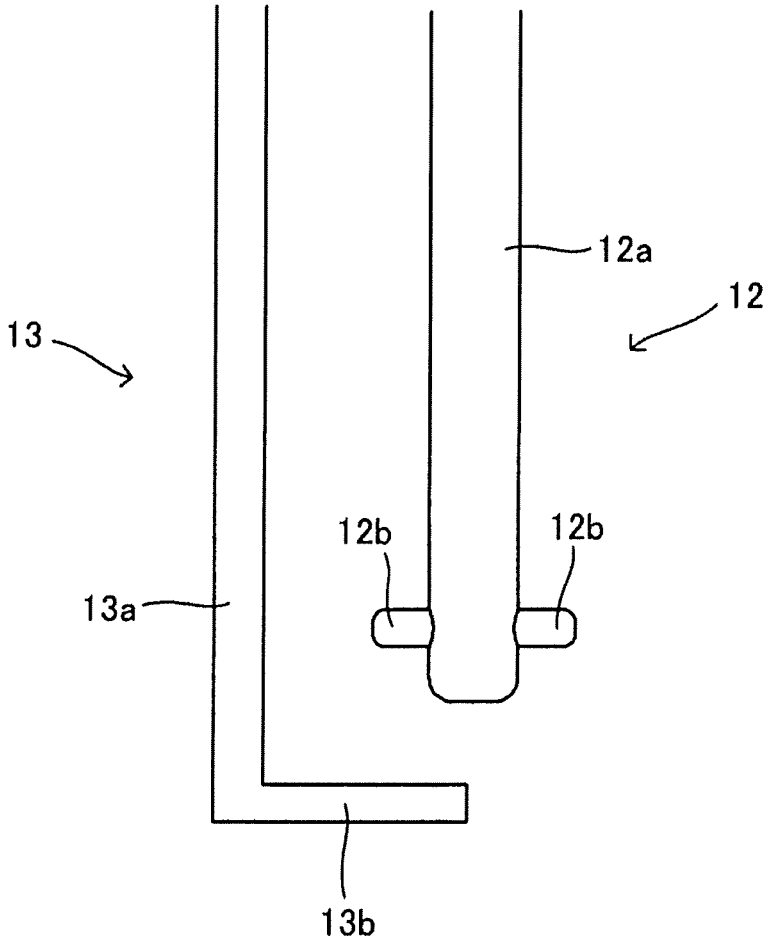
FIG. 3A is a view for describing a driving shaft 12 and an auxiliary member 13 of the apparatus main body 10.
Figure 3B:
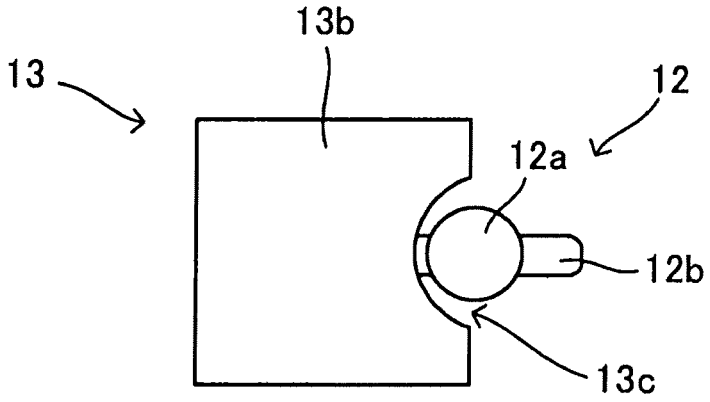
FIG. 3B is a view when viewed from a viewpoint different from that of FIG. 3A.
Figure 4:
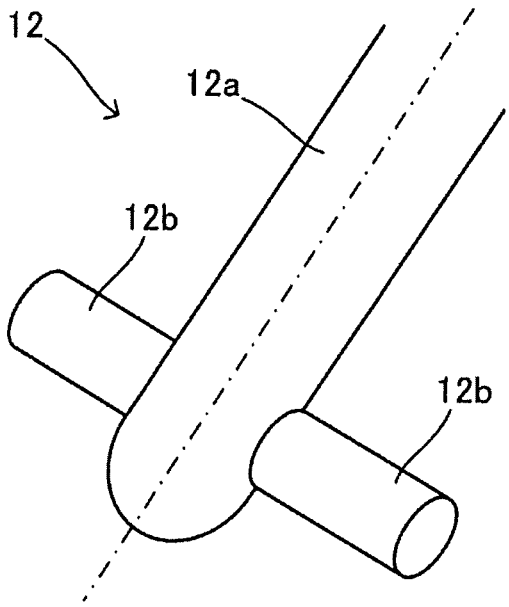
FIG. 4 is a perspective view of a tip end part of the driving shaft 12.

As will be described later, the driving shaft 12 functions as a member (rotating force imparting portion) which is engaged with the end member 40 to apply a rotation driving force. FIG. 3A illustrates a plan view of the driving shaft 12 and the auxiliary member 13 when viewed from a direction indicated by an arrow $C_{3a}$ in FIG. 2B, and FIG. 3B illustrates a view when viewed from a direction indicated by an arrow $C_{3b}$ in FIG. 2B (viewed from the shaft line direction of the driving shaft 12), respectively. In addition, FIG. 4 illustrates a perspective view focusing on a tip end part of the driving shaft 12.

As can be ascertained from the drawings, the driving shaft 12 includes: a shaft portion 12*a* which is a shaft member provided to protrude from a bottom portion of the guide groove 11 in the end portion on a far side of the guide groove 11, and which is a columnar shaft member of which a tip end is a hemispherical surface; and a columnar pin 12*b* which serves as a rotating force imparting portion that protrudes in the direction orthogonal to the rotation shaft line illustrated by one-dot chain line of the shaft portion 12*a*. On the side opposite to the tip end side illustrated in FIG. 4 of the driving shaft 12, a gear train is formed to make the rotation around the shaft line of the shaft portion 12*a* of the driving shaft 12 possible, and is connected to a motor which is a driving source via the gear train.

The auxiliary member 13 is a member which presses and moves the shaft member 70 (refer to FIG. 6A) of the end member 40 that has advanced in the guide groove 11, as will be described later. As can be ascertained from FIGS. 2A and 2B, the auxiliary member 13 is disposed further to the far side of the guide groove 11 (the side opposite to the part that communicates with the outside) than the driving shaft 12. In addition, the auxiliary member 13 has a configuration in which a standing portion 13*a* and a pressing portion 13*b* are provided.

The standing portion 13*a* is a plate-like member which stands upright from the bottom portion of the guide groove 11 and is configured such that the height thereof reaches a position that exceeds the tip end of the driving shaft 12.

The pressing portion 13*b* is a plate-like member which extends from the tip end of the standing portion 13*a* to the upper part of the driving shaft 12. As can be ascertained from FIG. 3B, a semicircular recess 13*c* is formed at the tip end of the pressing portion 13*b*, and a part of the shaft portion 12*a* of the driving shaft 12 is inserted into the recess 13*c* from the viewpoint of FIG. 3B, and is disposed such that the pressing portion 13*b* and the shaft portion 12*a* of the driving shaft 12 do not overlap each other.

With the auxiliary member 13, as will be described later, the pressing portion 13*b* presses the shaft member 70 of the end member 40 from the side surface, and the end member 40 can be in a posture of being likely to be engaged with the driving shaft 12.

Figure 5:
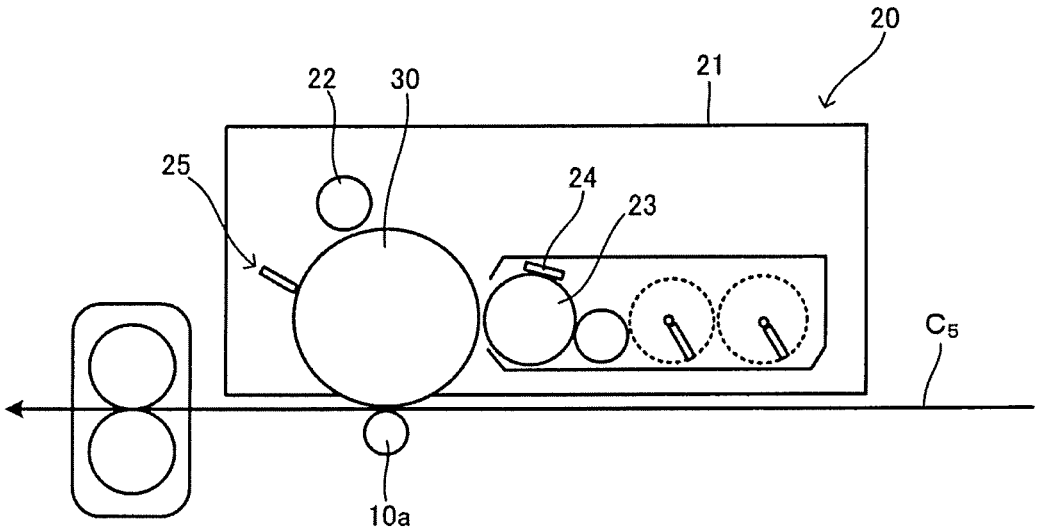
FIG. 5 is a view schematically illustrating a structure of the process cartridge 20.

Next, the process cartridge 20 will be described. In FIG. 5, a structure of the process cartridge 20 is schematically illustrated. As can be ascertained from FIG. 5, the process cartridge 20 includes a photoreceptor drum unit 30 (refer to FIG. 6) on the inside of a housing 21, a charging roller unit 22, a developing roller unit 23, a regulating member 24, and a cleaning blade 25. In a posture in which the process cartridge 20 is mounted on the apparatus main body 10, as a recording medium, such as a paper sheet, moves along line indicated by $C_5$ in FIG. 5, an image is transferred to the recording medium from the photoreceptor drum unit 30.

In addition, the attachment and detachment of the process cartridge 20 to and from the apparatus main body 10 is generally performed as follows. In the aspect, as the photoreceptor drum unit 30 provided in the process cartridge 20 receives a rotation driving force from the apparatus main body 10, and rotates, a state where a driving shaft 12 (refer to FIGS. 1 to 5) of the apparatus main body 10 and an end member 40 (refer to FIG. 6B) of the photoreceptor drum unit 30 are engaged with each other at least during the operation, and the rotating force can be transmitted, is achieved (refer to FIG. 13).

Meanwhile, when attaching and detaching the process cartridge 20 to and from the apparatus main body 10, it is necessary that the driving shaft 12 and the end member 40 are promptly engaged and disengaged not to interrupt the movement or rotation each other regardless of the posture.

In this manner, the end member 40 of the photoreceptor drum unit 30 is appropriately engaged with the driving shaft 12 of the apparatus main body 10, and the rotation driving force is transmitted.

Hereinafter, each configuration will be described.

In the process cartridge 20, as can be ascertained from FIG. 5, the charging roller unit 22, the developing roller unit 23, the regulating member 24, the cleaning blade 25, and the photoreceptor drum unit 30 are provided, and these members are included inside the housing 21. Each of these is as follows.

The charging roller unit 22 charges a photoreceptor drum 35 (refer to FIG. 6A) of the photoreceptor drum unit 30 by applying voltage from the apparatus main body 10. The charging is performed, for example, as the charging roller unit 22 rotates following the photoreceptor drum 35, and comes into contact with an outer circumferential surface of the photoreceptor drum 35.

The developing roller unit 23 is a member which includes a roller that supplies a developer to the photoreceptor drum 35. In addition, an electrostatic latent image formed on the photoreceptor drum 35 is developed by the developing roller unit 23. In addition, in the developing roller unit 23, a fixed magnet is embedded.

The regulating member 24 is a member which adjusts an amount of developer adhered onto the outer circumferential surface of the above-described developing roller unit 23, and applies a frictional electrification charge to the developer itself The cleaning blade 25 is a blade which comes into contact with the outer circumferential surface of the photoreceptor drum 35, and removes the developer remaining after the transfer by a tip end thereof.

Figure 6B:
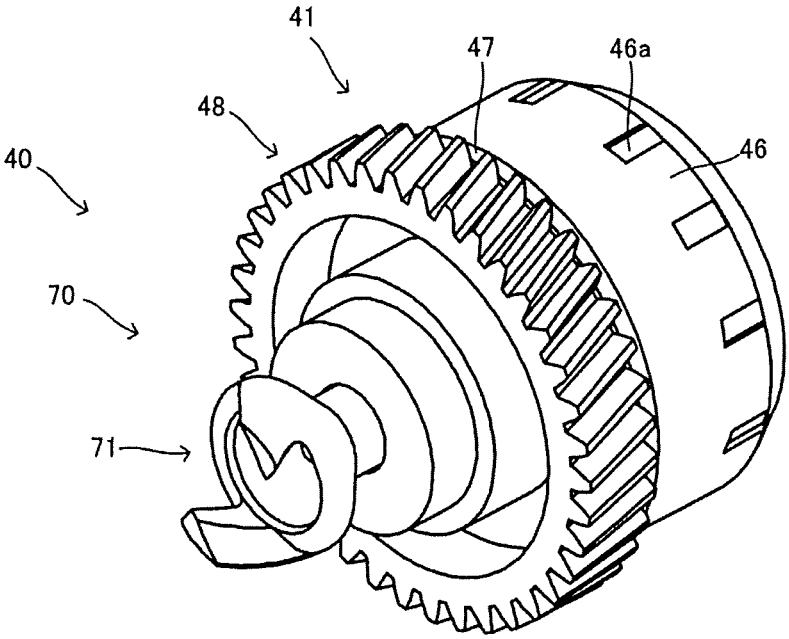
FIG. 6B is an external perspective view of an end member 40.

The photoreceptor drum unit 30 is a member in which letters or figures to be transferred to the recording medium, such as a paper sheet, are formed on a surface thereof. FIG. 6A illustrates an external perspective view of the photoreceptor drum unit 30. As can be ascertained from FIG. 6A, the photoreceptor drum unit 30 includes a photoreceptor drum 35, a lid material 36, and an end member 40. FIG. 6B is a perspective view focusing on the end member 40. Hereinafter, the photoreceptor drum unit 30 will be described with reference to FIGS. 6A and 6B and appropriately illustrated views.

The photoreceptor drum 35 is a member which covers a photoreceptor layer on the outer circumferential surface of a drum cylinder (referred to as "base body" in some cases) which is a columnar rotating body. In other words, the drum cylinder is a conductive cylinder made of aluminum or the like, and here, the cylinder is coated with the photoreceptor layer. An end member 40 is attached to one end of the photoreceptor drum 35 as will be described later, and a lid material 36 is disposed at the other end. In the aspect, the drum cylinder is a hollow cylindrical shape, but may be a solid round bar shape. However, at least the lid material 36 and the end member 40 are formed so as to be appropriately attached to the end portion thereof.

The lid material 36 is a member made of a resin, and a fitting portion fitted to the inside of the cylinder of the photoreceptor drum 35 and a bearing portion disposed so as to cover one end surface of the photoreceptor drum 35 are coaxially formed. The bearing portion is in a disk shape which covers the end surface of the photoreceptor drum 35 and has a part for receiving the shaft provided in the process cartridge. In addition, on the lid material 36, an earth plate made of a conductive material is disposed, and accordingly, electrically connects the photoreceptor drum 35 and the apparatus main body 10 to each other.

In addition, in the aspect, although an example of a lid material is illustrated in the aspect, not being limited thereto, and another aspect of lid material which can be normally adopted is also possible. For example, a gear for transmitting the rotating force may be disposed on the lid material. In addition, the conductive material may be provided on the end member 40 side which will be described later.

Figure 7:
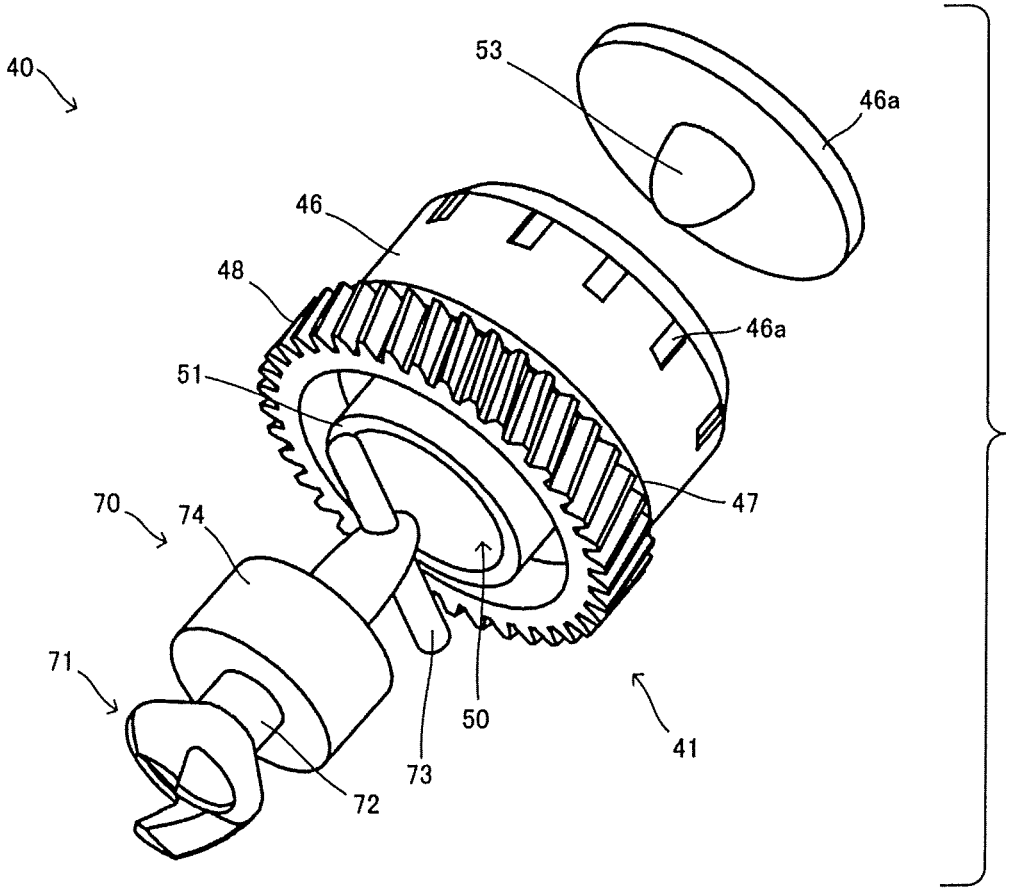
FIG. 7 is an exploded perspective view of the end member 40.

The end member 40 is a member which is attached to the end portion opposite to the lid material 36 among the end portions of the photoreceptor drum 35. FIG. 7 is an exploded perspective view of the end member 40. As can be ascertained from FIGS. 6B and 7, the end member 40 is provided with a bearing member 41 and a shaft member 70.

Figure 8A:
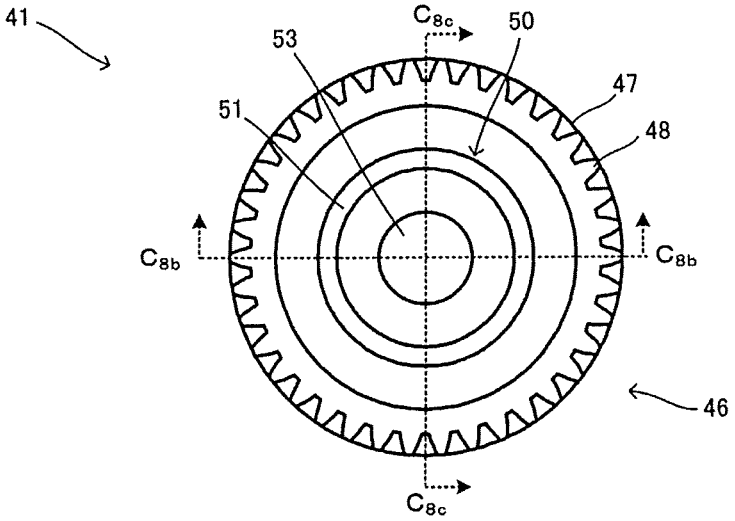
FIG. 8A is a plan view of a bearing member 41.
Figure 8B:
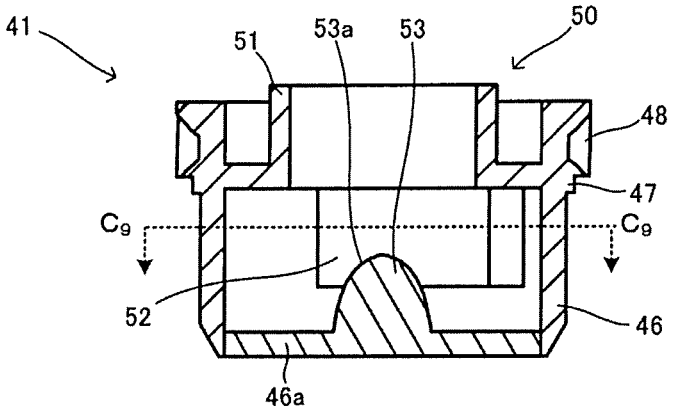
FIG. 8B is one sectional view of the bearing member 41.
Figure 8C:
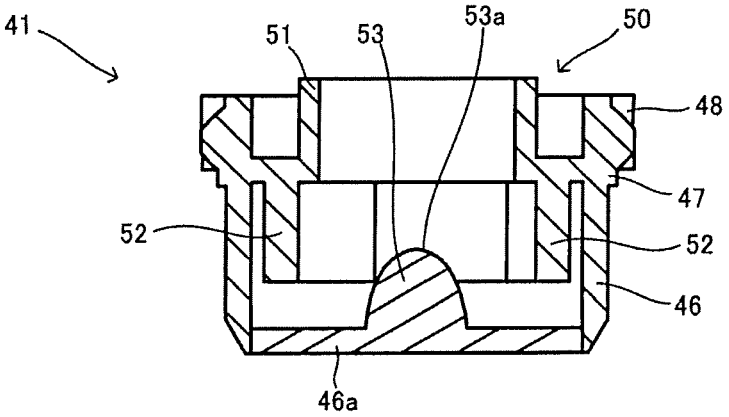
FIG. 8C is another sectional view of the bearing member 41.
Figure 9:
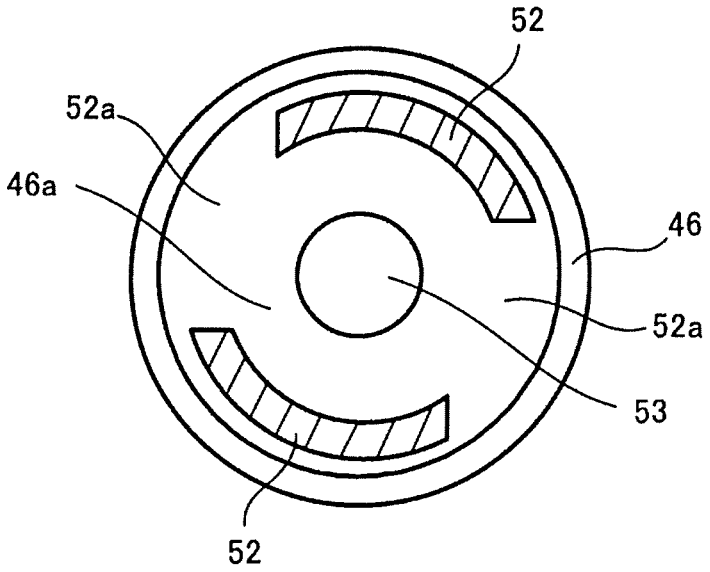
FIG. 9 is a sectional view of the bearing member 41.

The bearing member 41 is a member fixed to the end portion of the photoreceptor drum 35. FIG. 8A illustrates a plan view of the bearing member 41 when viewed from the shaft line direction, FIG. 8B illustrates a sectional view of the bearing member 41 along the line indicated by $C_{8b}$-$C_{8b}$ in FIG. 8A, and FIG. 8C illustrates a sectional view of the bearing member 41 along the line indicated by $C_{8c}$-$C_{8c}$ in FIG. 8A. In addition, FIG. 9 illustrates a sectional view along the line indicated by $C_9$-$C_9$ in FIG. 8B.

In the aspect, the bearing member 41 includes a cylindrical tubular body 46. In the aspect, the tubular body 46 is a tubular body having a bottom at one part at which a bottom portion 46*a* is provided on one side. In addition, on the outer circumferential surface of the tubular body 46, a ring-shaped contact wall 47 and a gear 48 are formed to stand upright along the outer circumferential surface. The outer diameter of the tubular body 46 is substantially the same as the inner diameter of the photoreceptor drum 35, one end side which is a side on which the bottom of the tubular body 46 is provided is inserted into the photoreceptor drum 35 and fitted thereto, and accordingly, the bearing member 41 is fixed to the photoreceptor drum 35. At this time, the end surface of the photoreceptor drum 35 is inserted to a depth at which the end surface abuts against the contact wall 47. At this time, an adhesive may be used for more firm fixation. In addition, the bottom portion 46*a* or irregularities may be provided in the tubular body 46 at the part at which the adhesive is disposed. Accordingly, the adhesive is held in the bottom portion 46*a* or a recess portion, and the adhesion between the photoreceptor drum 35 and the bearing member 41 is further strengthened.

The gear 48 is a gear which transmits the rotating force to the developing roller unit 23, and in the aspect, a helical gear is disposed. The type of the gear is not particularly limited, and may be a spur gear or the like. However, gears may be provided and are not necessarily provided.

A holding portion 50 is provided inside the tubular body 46 which has a shape of a tube. The holding portion 50 is a part which holds one end side of the shaft member 70 which will be described later while making the one end side movable on the inside of the holding portion 50. As can be ascertained from FIGS. 7 to 9, the holding portion 50 is configured to be provided with a shaft member accommodation portion 51, a pin engaging portion 52, and a cam projection 53.

The shaft member accommodation portion 51 is a part at which the elastic member 74 part of the shaft member 70 is accommodated. In the aspect, the shaft member accommodation portion 51 is a tubular body which is coaxial to the tubular body 46, both ends thereof are open to pass therethrough, and the shaft member accommodation portion 51 is disposed on a side opposite to the bottom portion 46*a* on the inside of the tubular body 46.

The pin engaging portion 52 is a plate-like member provided in the end portion on the cam projection 53 side of the end portion of the shaft member accommodation portion 51. In the aspect, regarding the pin engaging portion 52, as can be ascertained from FIG. 9, the two pin engaging portions 52 are disposed to oppose each other across the shaft line on the same circumference around the shaft line of the tubular body 46. In addition, a gap 52*a* is formed between the adjacent pin engaging portions 52. As will be described later, the tip end portion of the rotating force transmission pin 73 is disposed in the gap 52*a*, and the rotating force transmission pin 73 is hooked to the pin engaging portion 52, and accordingly, the rotating force is transmitted. In addition, the base end portion of the shaft member 70 is disposed between the opposing pin engaging portions 52.

The cam projection 53 functions as a mechanism in which the rotating force receiving portion moves also in the shaft line direction without being inclined by the movement in the direction orthogonal to the shaft line direction of the rotating force receiving portion, and in the aspect, as can be ascertained from FIGS. 8B, 8C, and the like, the cam projection 53 is a projection having a curved surface provided on a side that becomes the inside of the tubular body 46 on the surface of the bottom portion 46*a*. The cam projection 53 has a cam surface 53*a* which is a surface that is most separated from the bottom portion 46*a* at a position that matches the shaft line part of the tubular body 46, and the cam surface 53*a* is curved or inclined so as to approach the bottom portion 46*a* as being separated from the shaft line of the tubular body 46.

The aspect of the cam surface 53*a* is not particularly limited, but a spherical surface, a parabolic surface, a tapered surface, or the like can be employed.

A material which configures the bearing member 41 is not particularly limited, but a resin, such as polyacetal, polycarbonate, or PPS can be used. Here, in order to improve the rigidity of the member, the glass fiber or the carbon fiber may be mixed into the resin in accordance with the load torque. In addition, in order to make the sliding smooth, at least one type of a fluorine, polyethylene, and silicon rubber may be contained in the resin. In addition, the resin may be coated with fluorine or lubricant.

Figure 10A:
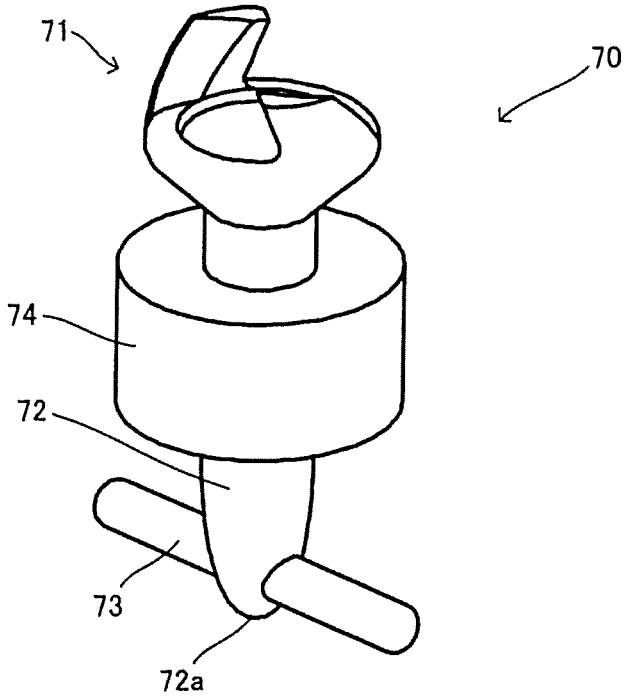
FIG. 10A is a perspective view of a shaft member 70.
Figure 10B:
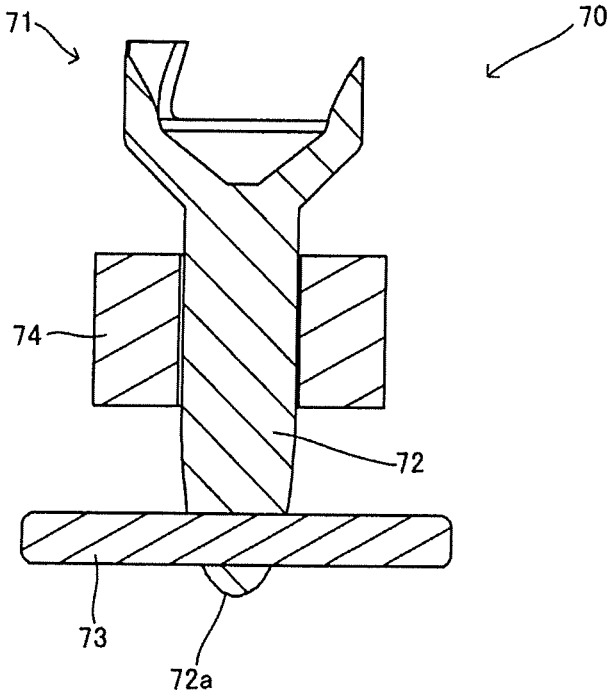
FIG. 10B is a sectional view of the shaft member 70.

Next, the shaft member 70 of the end member 40 will be described. FIG. 10A illustrates a perspective view of the shaft member 70, and FIG. 10B illustrates a sectional view of the shaft member 70 along the shaft line of the rotating shaft 72 and the rotating force transmission pin 73. As can be ascertained from the drawings, the shaft member 70 is provided with a coupling member 71, a rotating shaft 72, a rotating force transmission pin 73, and an elastic member 74.

The coupling member 71 is a part that functions as a rotating force receiving portion which receives a rotation driving force from the above-described driving shaft 12 (refer to FIGS. 2 to 4) of the apparatus main body 10. In the aspect, the coupling member 71 is a circular dish-like member and is configured to be engaged with the pin 12*b* of the driving shaft 12 and receive the rotation driving force from the driving shaft 12. In this manner, as an aspect of the coupling member 71 that can receive the rotation driving force, a known aspect can be applied, and the aspect is not particularly limited.

The rotating shaft 72 is a columnar shaft-like member that functions as a rotating force transmission portion which transmits the rotating force received by the coupling member 71. Therefore, the coupling member 71 is provided at one end of the rotating shaft 72.

In the aspect, in the end portion of the rotating shaft 72, a base end portion 72*a* which is an end portion opposite to the side on which the coupling member 71 is disposed, is formed so as to become to be thinner toward the tip end thereof. The aspect in which the base end portion 72*a* becomes thinner is not particularly limited, but a spherical surface, a parabolic surface, a tapered surface, or the like can be employed.

The rotating force transmission pin 73 is a rod-like member provided on the base end portion 72*a* side, and as can be ascertained from FIGS. 10A and 10B, the rotating force transmission pin 73 is disposed to extend in the direction orthogonal to the shaft line of the rotating shaft 72. As will be described later, the tip end of the rotating force transmission pin 73 is hooked to the pin engaging portion 52 of the bearing member 41, and accordingly, the rotating force is transmitted from the shaft member 70 to the bearing member 41.

The elastic member 74 is a tubular member configured of a material used as an elastic member, and as can be ascertained from FIGS. 10A and 10B, the elastic member 74 is disposed so as to cover the rotating shaft 72.

The outer shape of the elastic member 74 has a size and shape that can be inserted into the shaft member accommodation portion 51 provided in the holding portion 50 of the bearing member 41. In the aspect, since the shaft member accommodation portion 51 is cylindrical, the outer shape of the elastic member 74 has a circular section.

The inner shape of the elastic member 74 has a size and shape through which the rotating shaft 72 can be inserted. In the aspect, since the rotating shaft 72 has a cylindrical shape, the inner shape of the elastic member 74 has a circular section.

A material of the elastic member is not particularly limited as long as a material used as an elastic member is employed, and examples thereof can include rubber, sponge, and the like.

A material of the shaft member 70 is not particularly limited, but other than the elastic member 74, a resin, such as polyacetal, polycarbonate, or PPS can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

Figure 11A:
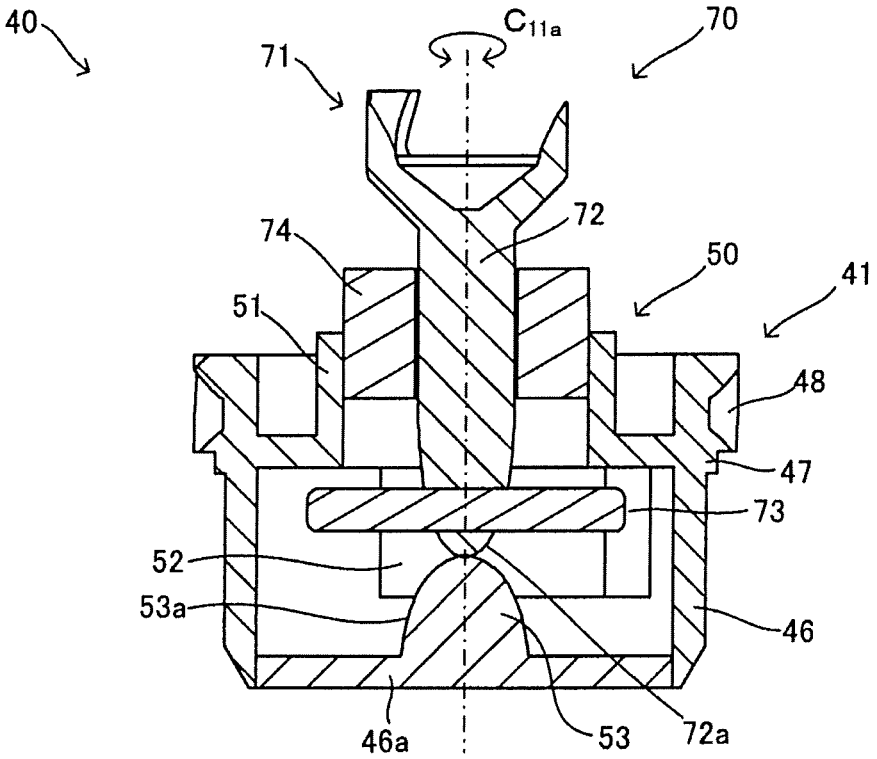
FIG. 11A is one sectional view of the end member 40.
Figure 11B:
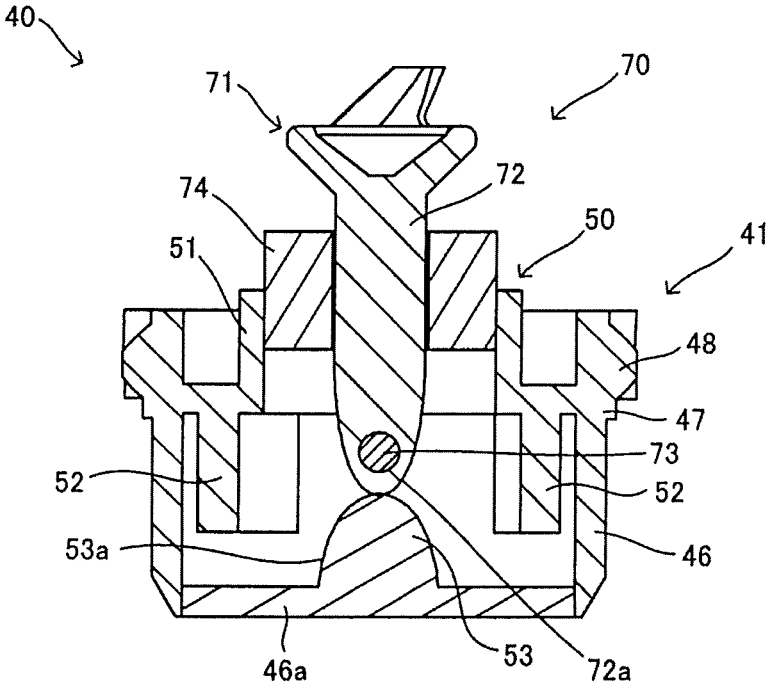
FIG. 11B is another sectional view of the end member 40.
Figure 12A:
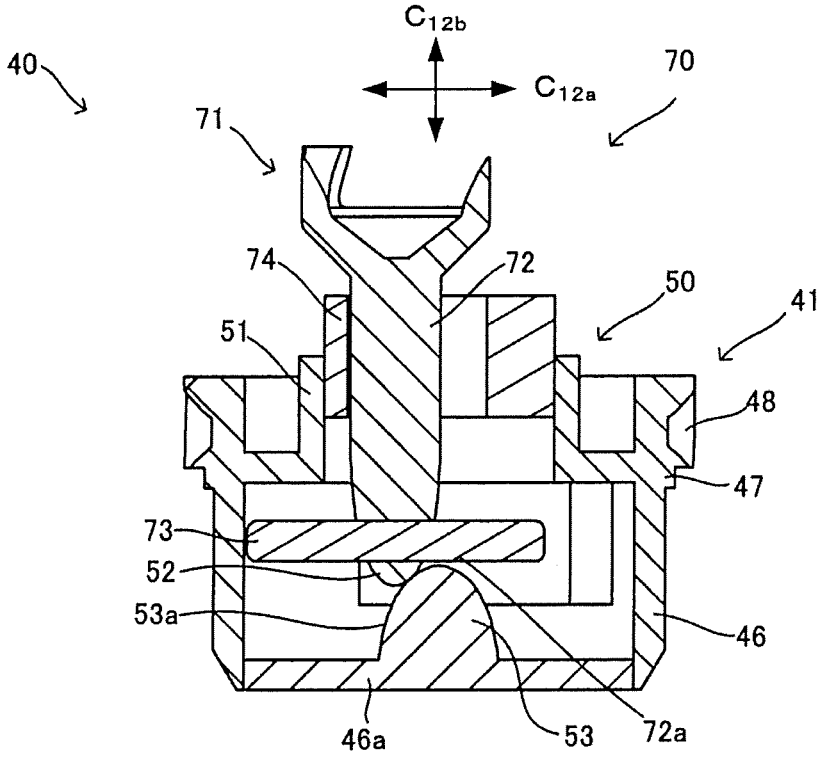
FIG. 12A is a view illustrating an example of a posture in which the shaft member 70 is deformed in one section of the end member 40.
Figure 12B:
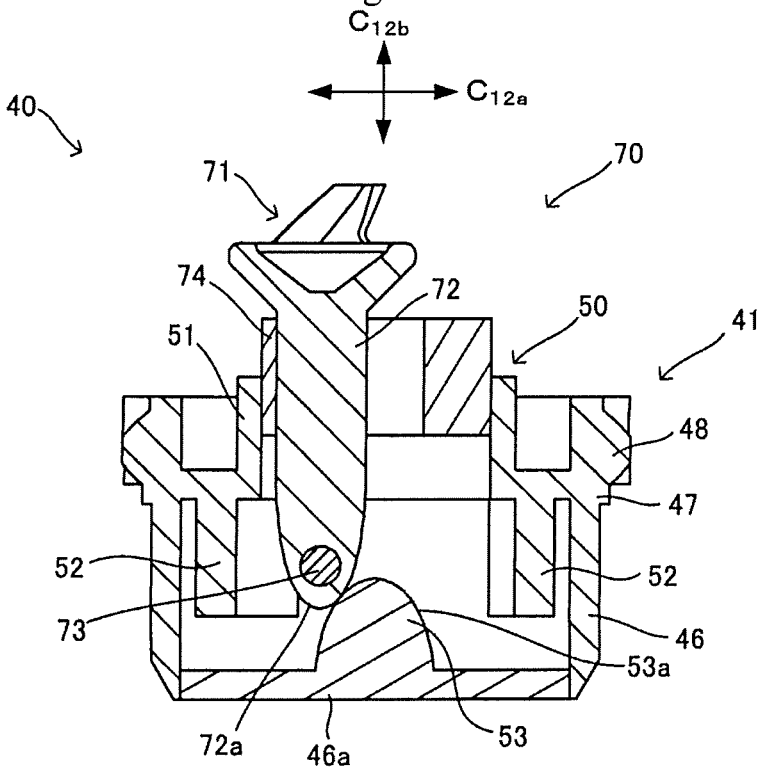
FIG. 12B is a view illustrating an example of the posture in which the shaft member 70 is deformed in another section of the end member 40.

By combining the bearing member 41 and the shaft member 70 with each other as follows, the end member 40 is made. By describing the combination, the shape, the size, or the positional relationship of the bearing member 41 and the shaft member 70 are further understood. FIG. 11A illustrates a sectional view of the end member 40 from the same viewpoint as that in FIG. 8, and FIG. 11B illustrates a sectional view at a position deviated by 90 degrees around the shaft line from FIG. 11A, respectively. In addition, FIG. 12A illustrates one example of the posture in which the shaft member 70 moves in the viewpoint illustrated in FIG. 11A, and FIG. 12B illustrates one example of the posture in which the shaft member 70 moves in the viewpoint illustrated in FIG. 11B, respectively.

As can be ascertained from FIGS. 11A and 11B, the rotating shaft 72 of the shaft member 70 has passed through the shaft member accommodation portion 51 provided in the holding portion 50 of the bearing member 41. At this time, the elastic member 74 is disposed so as to be wound around the rotating shaft 72, and the elastic member 74 is positioned between the rotating shaft 72 and the shaft member accommodation portion 51. In addition, the end portion (base end portion side) of the side on which the rotating force transmission pin 73 is provided in the shaft member 70 is oriented toward the cam projection 53 side, and the coupling member 71 is disposed so as to protrude to the outside of the bearing member 41.

When the shaft member 70 is disposed on the bearing member 41, as can be ascertained from FIGS. 11A and 11B, the surface of the base end portion 72*a* of the rotating shaft 72 is disposed to be brought into contact with the cam surface 53*a* of the cam projection 53. Accordingly, as will be described later, the surface of the base end portion 72*a* moves so as to slide on the cam surface 53*a*, the shaft member 70 can be moved.

In addition, when the shaft member 70 is disposed on the bearing member 41, both end portions of the rotating force transmission pin 73 are disposed so as to enter between the pin engaging portions 52 provided in the holding portion 50 of the bearing member 41 (the gap 52*a*). Accordingly, when the shaft member 70 rotates, the rotating force transmission pin 73 is hooked to the pin engaging portion 52, and the rotating force can be transmitted to the bearing member 41.

By disposing the shaft member 70 on the inside of the bearing member 41 in this manner, the shaft member 70 can move as illustrated in FIGS. 12A and 12B.

Similar to the posture illustrated in FIGS. 11A and 11B, when the shaft line of the shaft member 70 matches the shaft line of the bearing member 41, the tip end of the base end portion 72*a* of the shaft member 70 is disposed at a top portion of a cam surface 53*a* of the cam projection 53 of the bearing member 41, and accordingly, the coupling member 71 is in a posture of protruding the most protruding from the bearing member 41. The elastic member 74 biases the shaft member 70 so as to have a posture illustrated in FIGS. 11A and 11B.

From the posture illustrated in FIG. 11A, as illustrated by an arrow $C_{12a}$ in FIGS. 12A and 12B, when the shaft member 70 is moved in a direction orthogonal to the shaft line against the biasing force of the elastic member 74, the tip end of the base end portion 72*a* of the shaft member 70 moves so as to slide on the cam surface 53*a* of the cam projection 53 of the bearing member 41. Accordingly, the shaft member 70 moves also in the direction along the shaft line with respect to the posture illustrated in FIGS. 11A and 11B, and the coupling member 71 moves so as to approach the bearing member 41. Therefore, the shaft member 70 can also move along the shaft line direction as indicated by an arrow $C_{12b}$ in FIGS. 12A and 12B.

In addition, when receiving the driving force from the apparatus main body 10, the shaft member 70 receives the rotating force around the shaft line as indicated by an arrow $C_{11a}$ in FIG. 11A. At this time, the shaft member 70 rotates around the shaft line, and accordingly, the rotating force transmission pin 73 presses the pin engaging portion 52 of the bearing member 41, the bearing member rotates, and the rotating force can be transmitted to the photoreceptor drum 35.

According to the end member 40, as will be described later, since the shaft member 70 can move and disengage with respect to the driving shaft 12 without swinging, it is possible to more smoothly attach and detach to and from the apparatus main body 10.

Attachment of the end member 40 to the photoreceptor drum 35 is performed as the end portion on a side on which the shaft member 70 of the end member 40 does not protrude is inserted into the photoreceptor drum 35 after the end member 40 is assembled as illustrated in FIGS. 11A and 11B. By the end member 40, when mounting the process cartridge 20 to the apparatus main body 10, it is possible to appropriately apply a rotating force to the photoreceptor drum 35 and to easily attach and detach the process cartridge 20.

As described above, on the inside of the housing 21 of the process cartridge 20 (refer to FIG. 2), the photoreceptor drum unit 30, the charging roller unit 22, the developing roller unit 23, the regulating member 24, and the cleaning blade 25 are housed. At this time, each member is disposed to be rotatable as necessary on the inside of the housing 21 to exert the function thereof.

In addition, in the aspect, in the shaft members 70 of the photoreceptor drum unit 30, at least the coupling member 71 is disposed to be exposed from the housing 21. Accordingly, as will be described later, it is possible to obtain a rotation driving force from the apparatus main body 10, and to easily attach and detach the apparatus main body 10 and the process cartridge 20.

Here, although each member included in the process cartridge 20 is exemplified, the member included therein is not limited thereto, and it is preferable that other members, parts, developers and the like which are generally provided for the process cartridge are provided.

In addition, the driving shaft 12 is disposed to protrude on a trajectory of the attachment and detachment movement at a substantially right angle with respect to the moving direction for attaching and detaching the process cartridge 20 illustrated in FIG. 1 to and from the apparatus main body 10. Therefore, when attaching and detaching the process cartridge 20, it is necessary to mount and disengage the shaft member 70 to and from the driving shaft 12 as described above. In addition, according to the above-described end member 40, attachment and detachment between the shaft member 70 and the driving shaft 12 becomes easy. A specific aspect of attachment and detachment will be described later.

Figure 13:
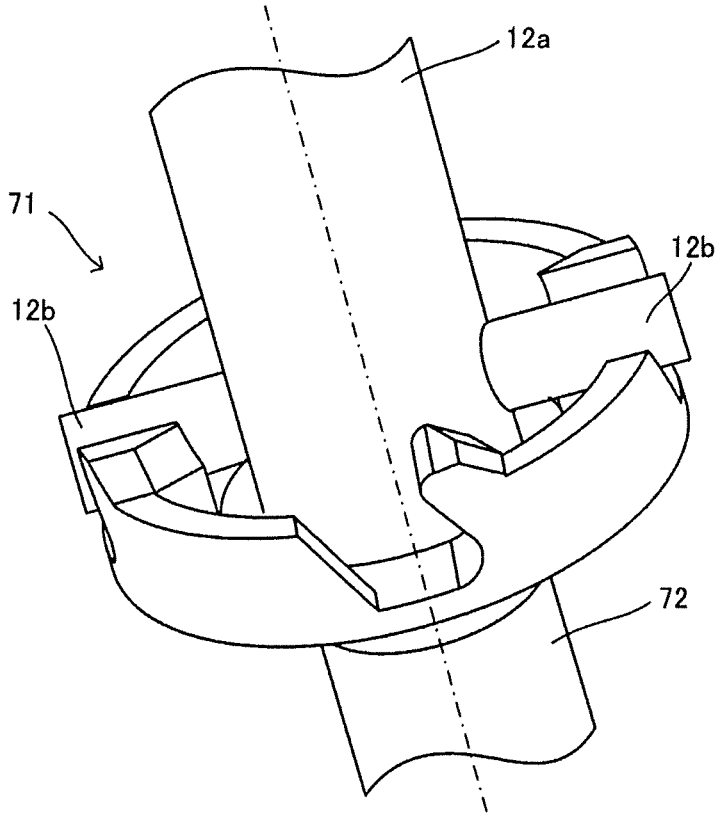
FIG. 13 is a view for describing a posture in which the driving shaft 12 is linked to a coupling member 71.

In the posture in which the process cartridge 20 is mounted on the apparatus main body 10, the driving shaft 12 and the coupling member 71 of the shaft member 70 of the end member 40 are engaged with each other, and the rotating force is transmitted. FIG. 13 illustrates a situation in which the coupling member 71 of the end member 40 is engaged with the driving shaft 12. As can be ascertained from FIG. 13, in such a posture in which the driving shaft 12 and the coupling member 71 are engaged with each other, the driving shaft 12 and the coupling member 71 are disposed to abut against each other such that the shaft line of the shaft portion 12*a* of the driving shaft 12 and the shaft line of the coupling member 71 match each other. At this time, the pin 12*b* of the driving shaft 12 is disposed in a groove which opposes the coupling member 71, or on the inside of the groove. Accordingly, when the coupling member 71 rotates following the rotation of the driving shaft 12 to rotate the shaft member 70, and the shaft member 70 rotates, the rotating force transmission pin 73 of the shaft member 70 is hooked to the pin engaging portion 52 of the bearing member 41, the bearing member 41 rotates, and accordingly, the photoreceptor drum 35 rotates and the whole photoreceptor drum unit 30 rotates.

Figure 14A:
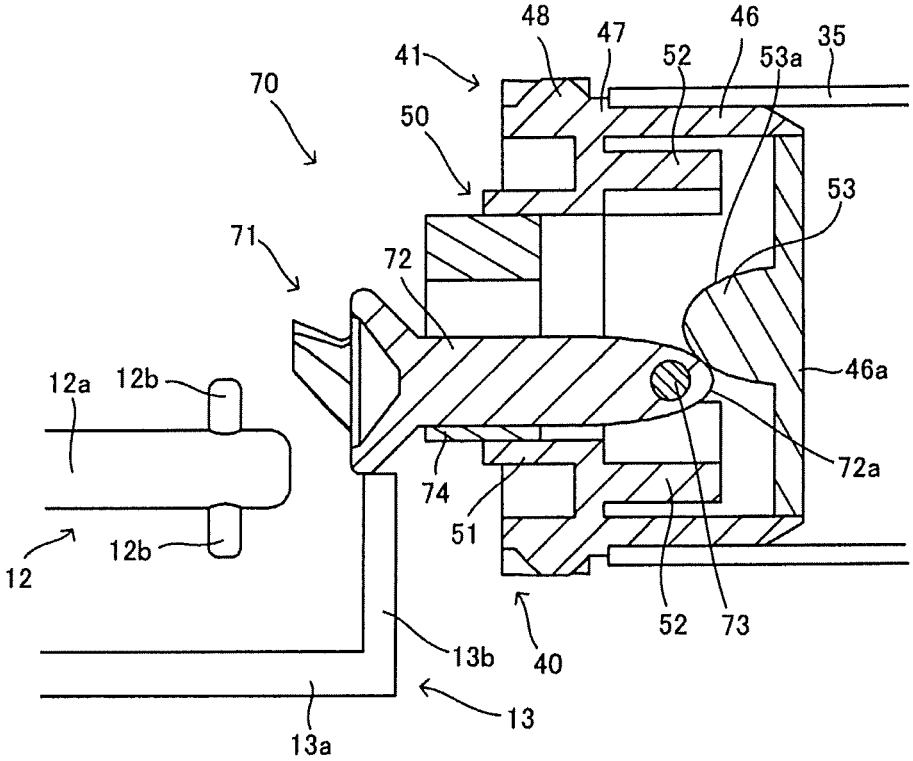
FIG. 14A is a view for describing one situation in which the process cartridge is mounted on the apparatus main body.
Figure 14B:
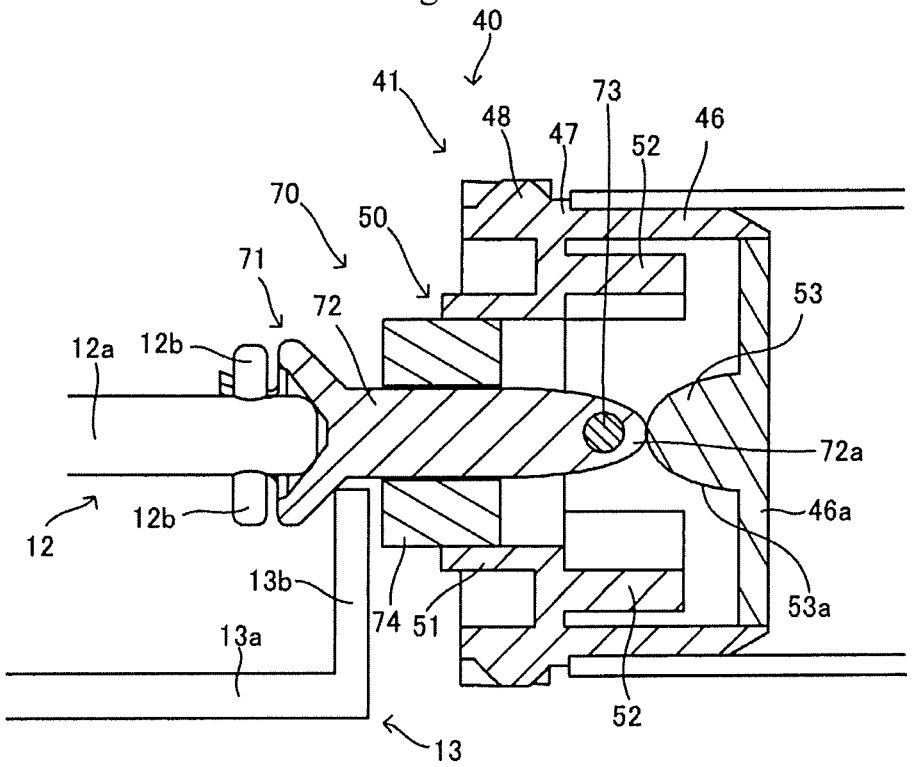
FIG. 14B is a view for describing another situation in which the process cartridge is mounted on the apparatus main body.

Next, an example in which the operation of the driving shaft 12 and photoreceptor drum unit 30 when mounting the process cartridge 20 on the apparatus main body 10 will be described. FIG. 14 illustrates a view for the description. FIG. 14A is a view illustrating one situation in which the end member 40 is engaged with the driving shaft 12, and FIG. 14B is a view illustrating another situation in which the end member 40 is engaged with the driving shaft 12. In FIG. 14, the order of the operation is illustrated in FIG. 14A and FIG. 14B, and the left and right sides of the paper surface are directions in which the shaft line of the end member 40 and the driving shaft 12 extends. In addition, this is a situation in which the process cartridge 20 is mounted and moved downward in the paper surface.

First, as illustrated in FIG. 14A, the shaft member 70 is held in a posture in which the shaft member 70 is moved in a direction of being deviated from the shaft line of the bearing member 41. The moving direction is a direction of approaching the auxiliary member 13 side provided in the guide groove 11 of the above-described apparatus main body 10 in a direction (refer to $C_1$ in FIG. 1) in which the process cartridge 20 is inserted into the apparatus main body 10. A method for holding the shaft member 70 in this manner is not particularly limited, but can be performed by providing an elastic member, such as a spring, in the process cartridge, for example. Here, the force applied to move the shaft member 70 may include a force that moves the shaft member 70 in a direction perpendicular to the shaft line as illustrated in FIG. 14A, and may include a force in the direction indicated by $C_{12a}$ illustrated in FIG. 12. However, the present invention is not limited thereto, and a force in the direction along the shaft line of the shaft member 70 may be further included, and accordingly, a force in an oblique direction may be used.

In the posture, as described above, the shaft member 70 moves in the direction of retracting to the bearing member 41 side.

When the process cartridge 20 is moved downward on the paper surface from the posture, the auxiliary member 13 presses the shaft member 70 as illustrated in FIG. 14A. Finally, as illustrated in FIG. 14B, the shaft member 70 can be moved so as to match the shaft line of the bearing member 41. At this time, the shaft member 70 moves in a direction of protruding from the bearing member 41 as described above. Accordingly, the shaft member 70 can be engaged with the driving shaft 12, and is in a posture in which the shaft line of the shaft member 70 matches the shaft line of the driving shaft 12 and the shaft lines of the driving shaft 12, the shaft member 70, the bearing member 41, and the photoreceptor drum 35 match each other. Accordingly, the rotating force is appropriately applied from the driving shaft 12 to the shaft member 70, the bearing member 41, and the photoreceptor drum 35, and finally the rotating force is applied to each of the members provided in the process cartridge 20.

Meanwhile, the operation of the driving shaft 12 and the photoreceptor drum unit 30 when disengaging the process cartridge 20 from the apparatus main body 10 may be traced back to the above-described order.

As described above, the process cartridge 20 can be disengaged from the apparatus main body 10 so as to be pulled out in a direction different from the shaft line direction of the driving shaft 12 of the apparatus main body 10, and can be mounted on the apparatus main body 10 so as to be pushed in.

Figure 15:
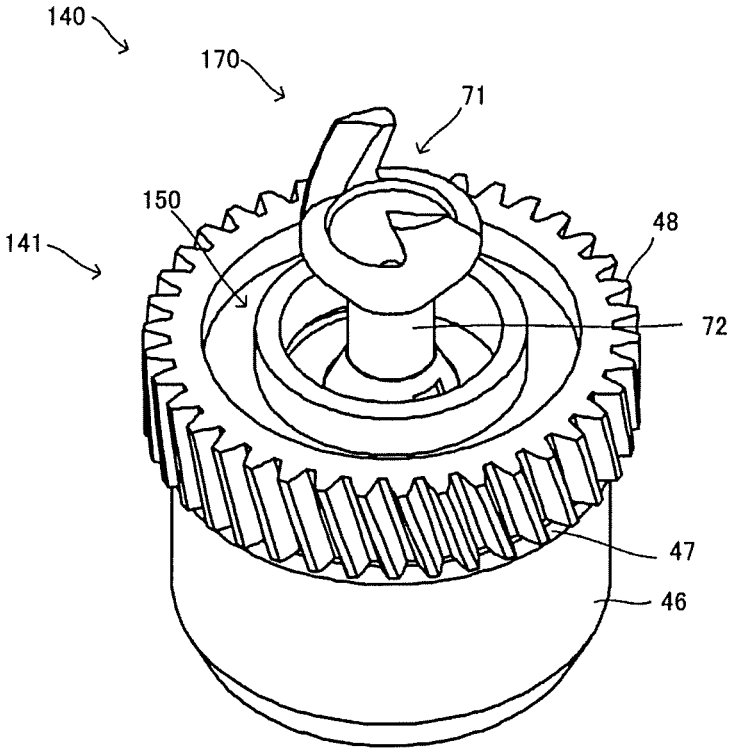
FIG. 15 is a perspective view of an end member 140.
Figure 16:
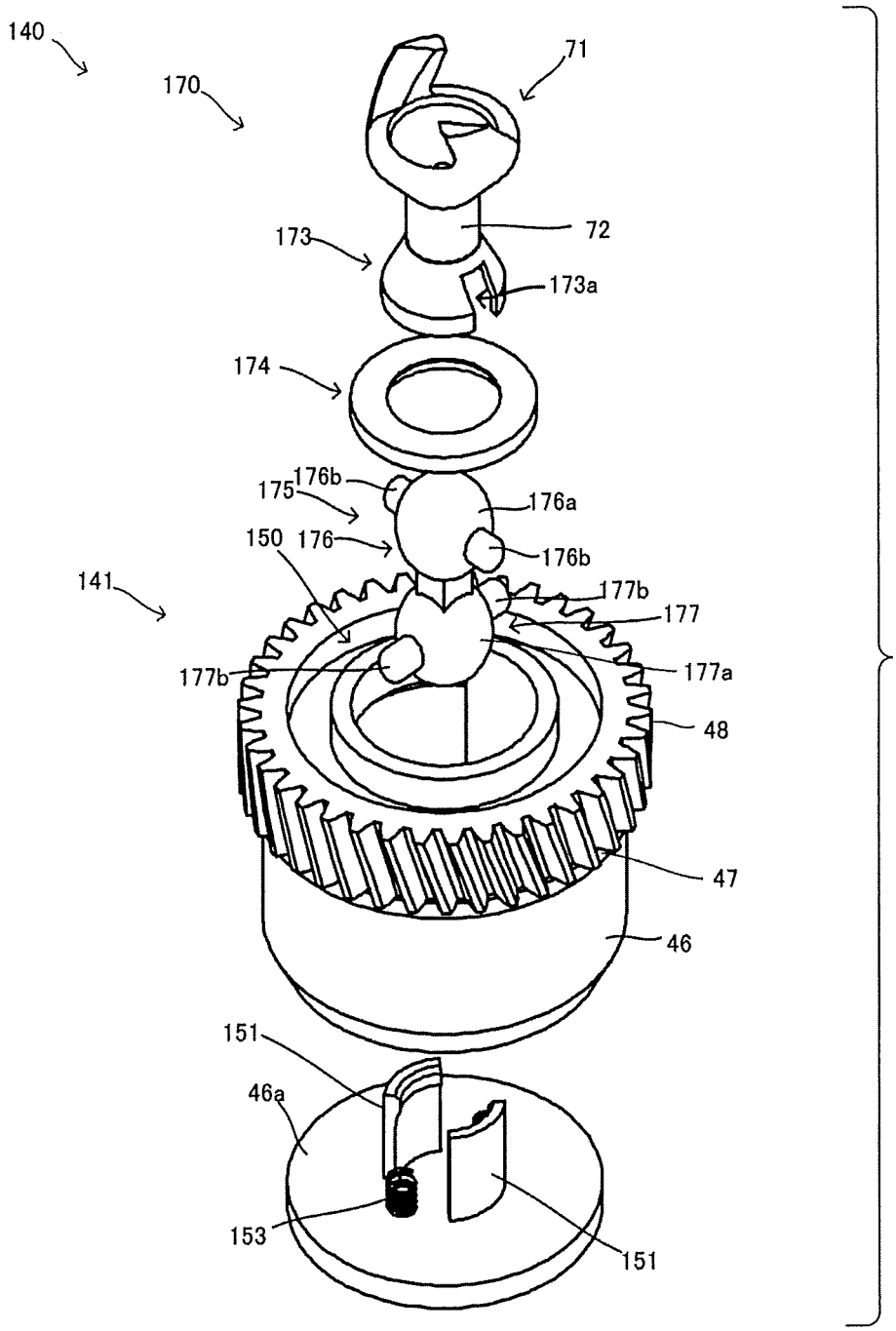
FIG. 16 is an exploded perspective view of the end member 140.

FIGS. 15 and 16 illustrate views for describing a second aspect. FIG. 15 is a perspective view of an end member 140, and FIG. 16 is an exploded perspective view of the end member 140. The end member 140 is also a member which is attached to the end portion opposite to the lid material 36 among the end portions of the photoreceptor drum 35. The end member 140 is provided with a bearing member 141 and a shaft member 170.

Figure 17A:
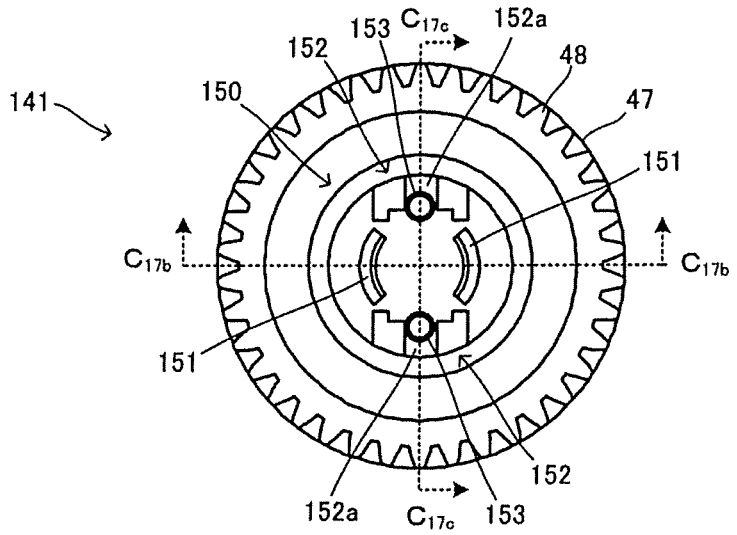
FIG. 17A is a plan view of a bearing member 141.
Figure 17B:
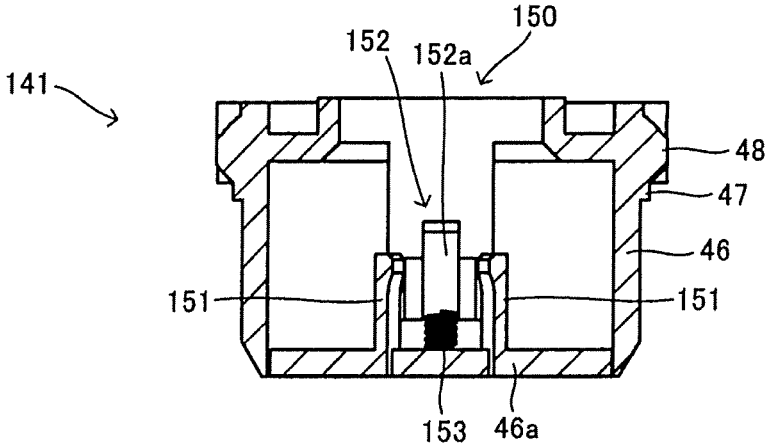
FIG. 17B is one sectional view of the bearing member 141.

The bearing member 141 is a member fixed to the end portion of the photoreceptor drum 35. FIG. 17A illustrates a plan view of the bearing member 141 when viewed from the shaft line direction, FIG. 17B illustrates a sectional view of the bearing member 141 along the line indicated by $C_{17b}$-

Figure 17C:
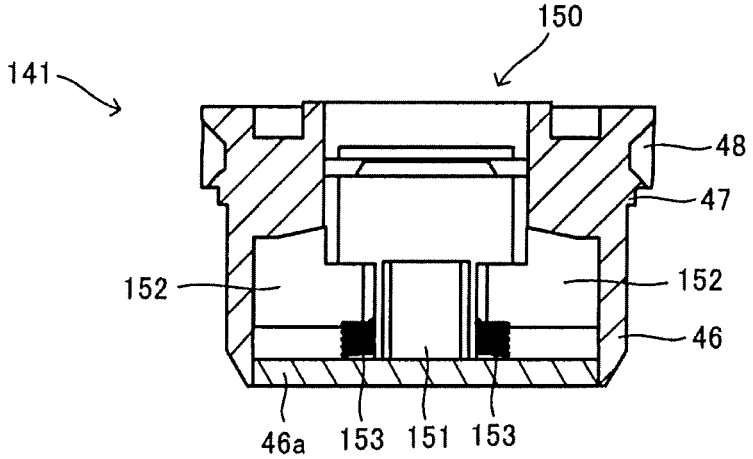
FIG. 17C is another sectional view of the bearing member 141.

$C_{17b}$ in FIG. 17A, and FIG. 17C illustrates a sectional view of the bearing member 141 along the line indicated by $C_{17c}$-$C_{17c}$ in FIG. 17A.

In the aspect, the bearing member 141 also includes the tubular body 46, the contact wall 47, and the gear 48. Since these can be employed with the same configuration as that of the bearing member 41 which is already described, the description thereof will be omitted here. In addition, in the aspect, in the tubular body 46, a bottom portion 46*a* is also provided on the side opposite to the side on which the coupling member 71 of the shaft member 170 is disposed to protrude, and at least a part thereof is blocked.

A holding portion 150 is provided on the tubular inside of the tubular body 46. The holding portion 150 is a part which holds one end side of the shaft member 170 which will be described later on the inside thereof. As can be ascertained from FIGS. 17A to 17C, the holding portion 150 includes a base end holding portion 151, a pin engaging portion 152, and an elastic member 153.

The base end holding portion 151 includes two plate-like members which stand upright from the bottom portion 46*a* across the shaft line of the tubular body 46, and a predetermined interval is provided between the two base end holding portions 151. One end (end portion on the base end portion side) of the shaft member 170 is accommodated between the two base end holding portions 151. In the aspect, the base end holding portion 151 is a part of a tubular body which is coaxial to the tubular body 46, and is a part of a tubular body having an inner diameter that is approximately the same as the diameter of the spherical body of a spherical portion 177*a* (refer to FIG. 18) of a second regulating portion 177 of the shaft member 170. Accordingly, the shaft member 170 is stably held by the bearing member 141 as will be described later.

The pin engaging portion 152 is provided with a member which stands upright from the bottom portion 46*a* across the shaft line of the tubular body 46 and is disposed at a position between the end portions of the two base end holding portions 151. A groove 152*a* which extends in the shaft line direction is provided in the pin engaging portion 152. As will be described later, the tip end portion of a regulating pin engaging portion 173 provided in the shaft member 170 is disposed in the groove 152*a*, and the rotating force is transmitted as the regulating pin engaging portion 173 is hooked to the pin engaging portion 152.

The elastic member 153 is disposed at the inner part of the groove 152*a* at the bottom portion 46*a*, and the shaft line direction is the biasing direction. In the aspect, a spring is used as the elastic member. However, it is not necessarily to provide a spring, and a sponge, rubber, or the like can also be used.

The material which configures the bearing member 141 can be considered similar to the above-described bearing member 41.

Figure 18:
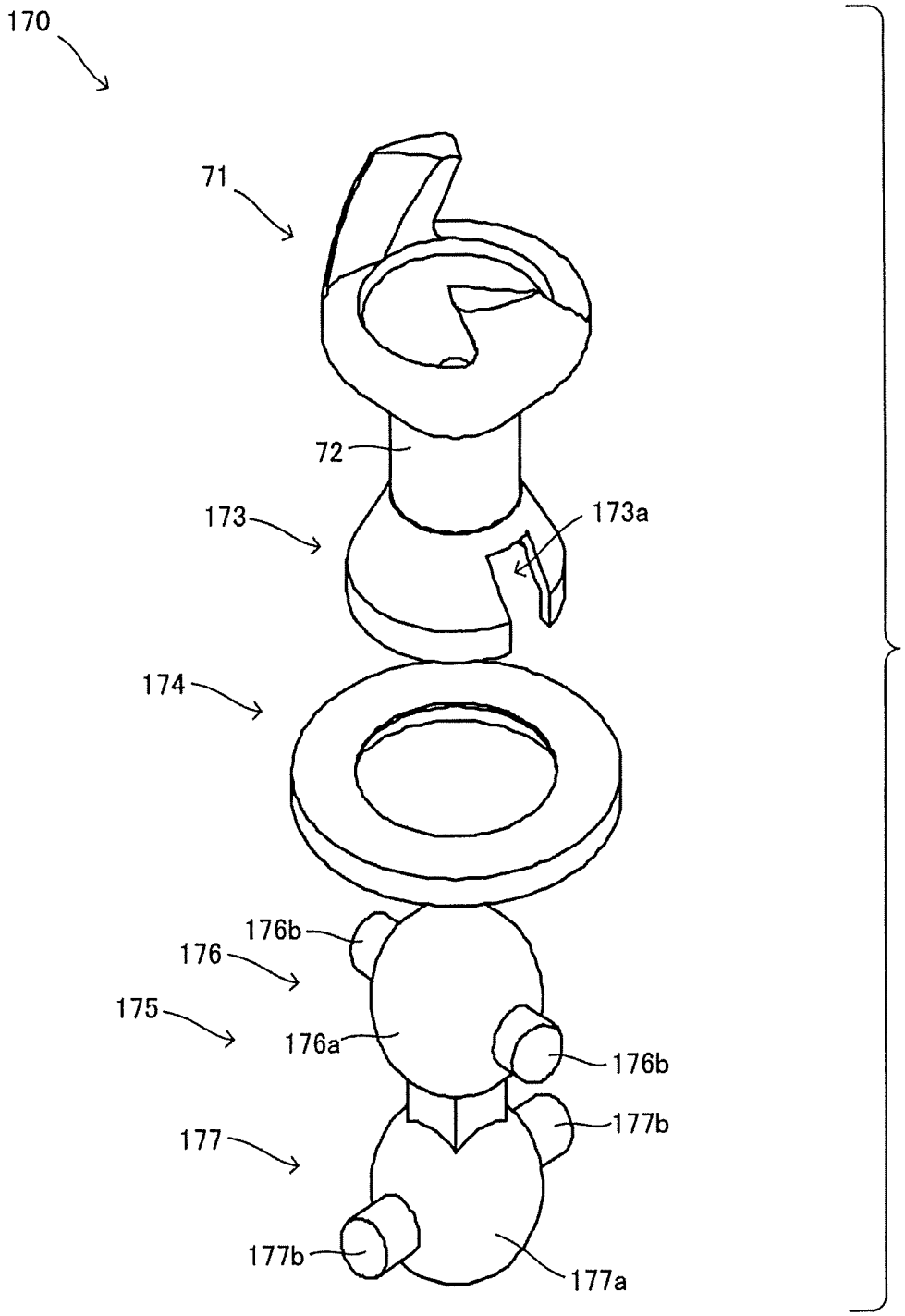
FIG. 18 is an exploded perspective view of a shaft member 170.
Figure 19A:
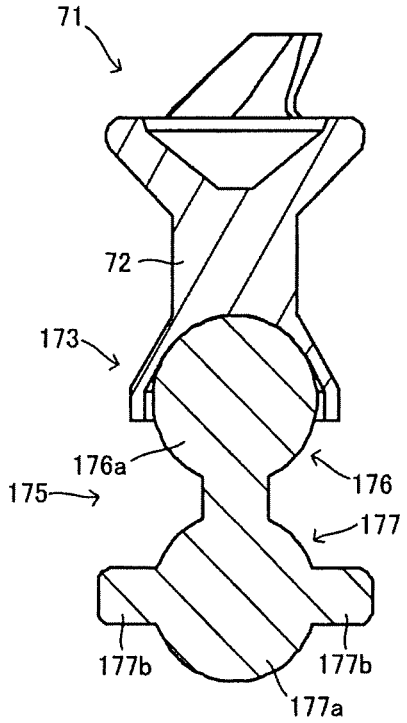
FIG. 19A is one sectional view of the shaft member 170.
Figure 19B:
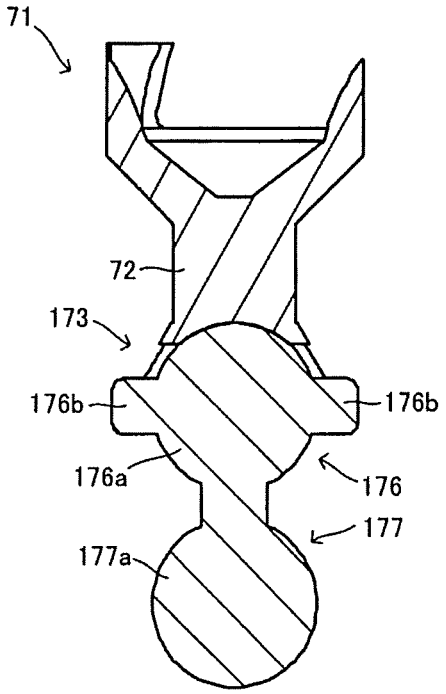
FIG. 19B is another sectional view of the shaft member 170.

Next, the shaft member 170 of the end member 140 will be described. FIG. 18 illustrates an exploded perspective view of the shaft member 170, FIG. 19A illustrates a sectional view of the shaft member 170 along the shaft line of the shaft member 170, and FIG. 19B illustrates a sectional view deviated by 90 degrees around the shaft line with respect to FIG. 19A. As can be ascertained from the drawings, the shaft member 170 is provided with the coupling member 71, the rotating shaft 72, the regulating pin engaging portion 173, a regulating ring 174, and a cam member 175.

Since the coupling member 71 is the same as that which has been already described, the description thereof will be omitted here.

The rotating shaft 72 is a columnar shaft-like member that functions as a rotating force transmission portion which transmits the rotating force received by the coupling member 71. Therefore, the coupling member 71 is provided at one end of the rotating shaft 72. In the aspect, in the end portion of the rotating shaft 72, the regulating pin engaging portion 173 is provided in the end portion opposite to the side on which the coupling member 71 is disposed.

The regulating pin engaging portion 173 is a member which is engaged with and regulates a regulating pin 176*b* of the cam member 175. Therefore, the regulating pin engaging portion 173 is a dish-shaped member, is configured to be able to receive a part of a spherical first regulating portion 176, and has a slit 173*a* for inserting the end portion of the regulating pin 176*b* on a side wall thereof. Therefore, two slits 173*a* are provided so as to oppose each other across the shaft line of the rotating shaft 72.

The regulating ring 174 is an annular member that presses the cam member 175 so as to be held on the inside of the bearing member 141.

The cam member 175 is a member which also functions as a mechanism for moving the rotating force receiving portion in the shaft line direction without being inclined by the movement in the direction orthogonal to the shaft line direction of the rotating force receiving portion. Therefore, the cam member 175 includes the first regulating portion 176 and the second regulating portion 177. In addition, the first regulating portion 176 and the second regulating portion 177 are connected to each other.

In the aspect, the first regulating portion 176 has a spherical portion 176*a* and a regulating pin 176*b*. The regulating pin 176*b* is provided on the spherical portion 176*a* so as to protrude from both sides in the diameter direction of the spherical portion 176*a*.

In the aspect, the second regulating portion 177 functions as a base end portion of the shaft member 170 and has the spherical portion 177*a* and a rotating force transmission pin 177*b*. The rotating force transmission pin 177*b* is provided on the spherical portion 177*a* so as to protrude from both sides in the diameter direction of the spherical portion 177*a* and is formed along the shaft line which is a twist position from the shaft line of the regulating pin 176*b*.

In the shaft member 170, as can be ascertained from FIGS. 19A and 19B, a part of the spherical portion 176*a* of the first regulating portion 176 is disposed on the inside of the dish shape of the regulating pin engaging portion 173, the regulating pin 176*b* is inserted into the slit 173*a*.

A material of the shaft member 170 is not particularly limited, but a resin, such as polyacetal, polycarbonate, or PPS can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

Figure 20A:
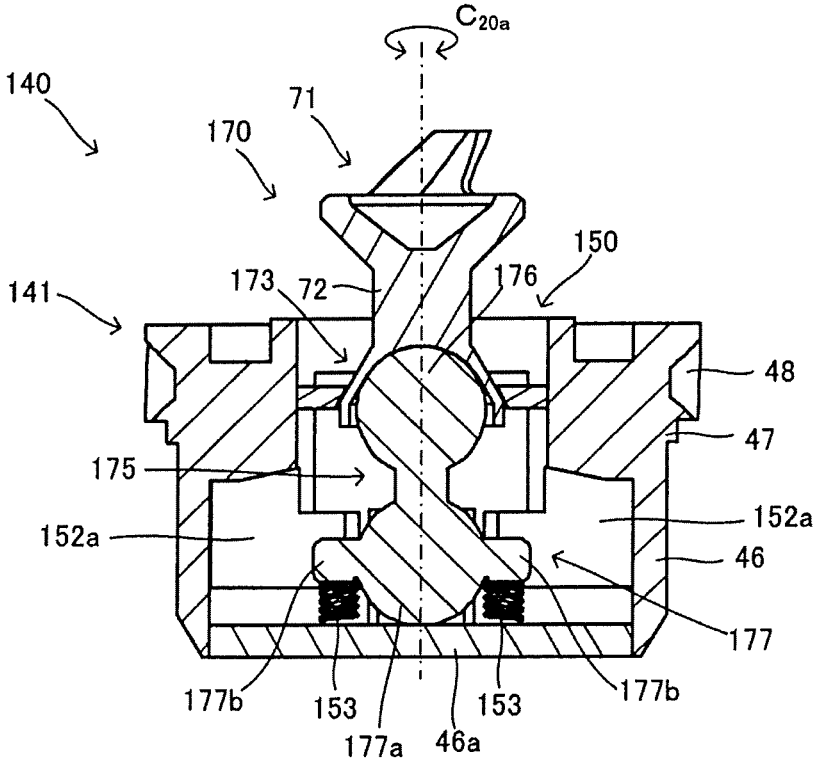
FIG. 20A is one sectional view of the end member 140.
Figure 20B:
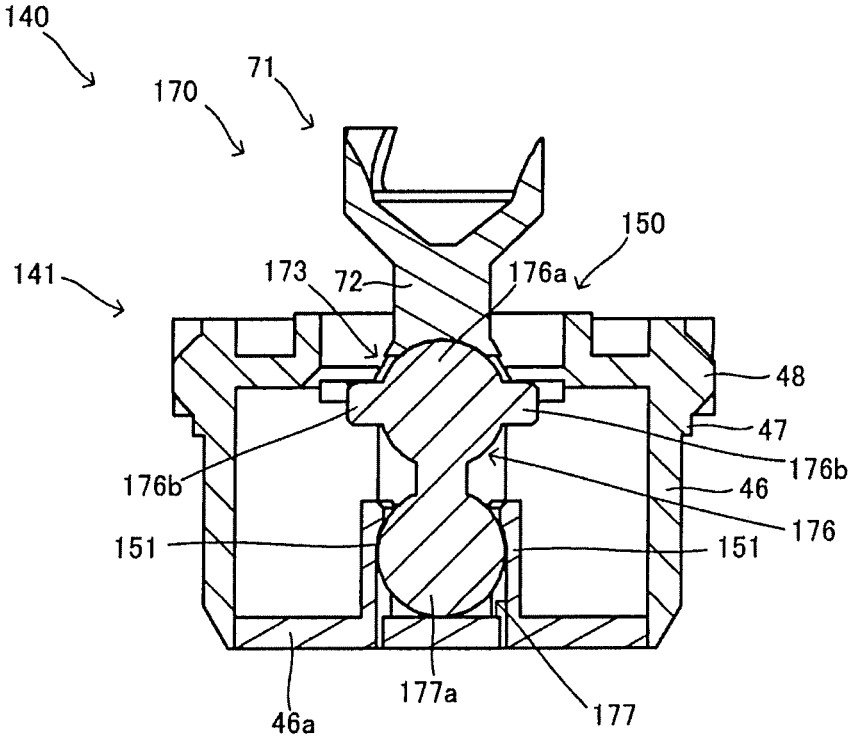
FIG. 20B is another sectional view of the end member 140.

By combining the bearing member 141 and the shaft member 170 with each other as follows, the end member 140 is made. By describing the combination, the shape, the size, or the positional relationship of the bearing member 141 and the shaft member 170 are further understood. FIG. 20A illustrates a sectional view of the end member 140 from the same viewpoint as that in FIG. 17C, and FIG. 20B illustrates a sectional view at a position deviated by 90 degrees around the shaft line from FIG. 20A, respectively. In addition, FIG.

Figure 21A:
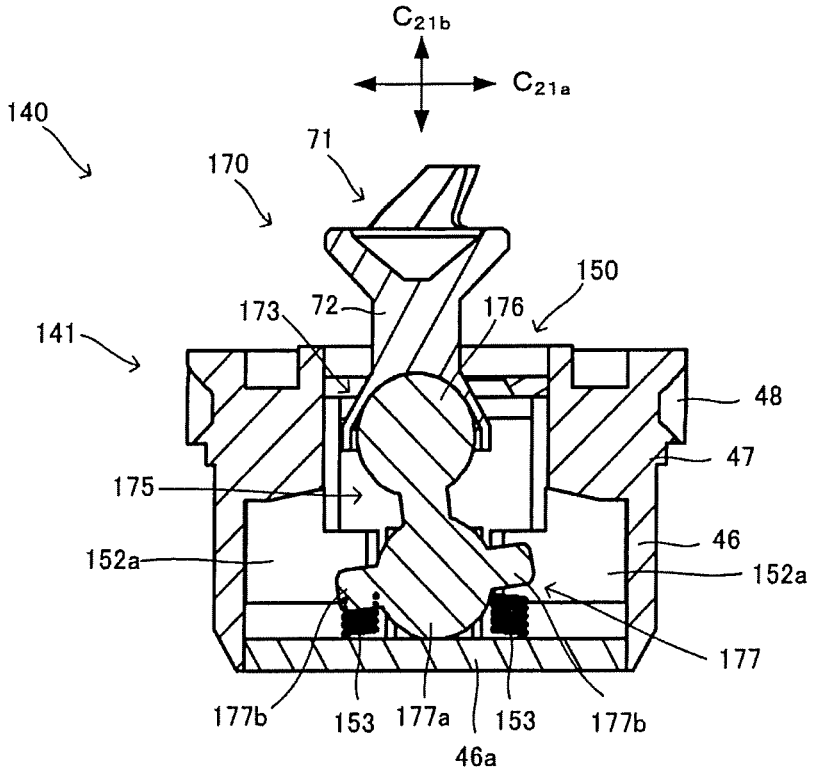
FIG. 21A is a view illustrating an example of a posture in which the shaft member 170 is deformed in one section of the end member 140.
Figure 21B:
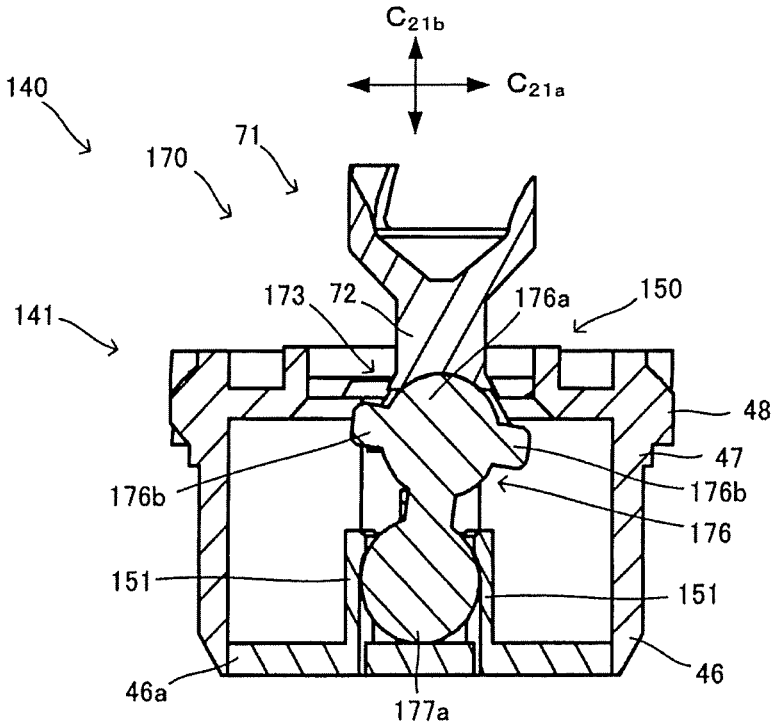
FIG. 21B is a view illustrating an example of the posture in which the shaft member 170 is deformed in another section of the end member 140.

21A illustrates one example of the posture in which the coupling member 71 of the shaft member 170 moves in the viewpoint illustrated in FIG. 20A, and FIG. 21B illustrates one example of the posture in which the coupling member 71 of the shaft member 170 moves in the viewpoint illustrated in FIG. 20B.

As can be ascertained from FIGS. 20A and 20B, the spherical portion 177*a* of the second regulating portion 177 of the shaft member 170 is held between the two base end holding portions 151 provided in the holding portion 150 of the bearing member 141. At this time, the rotating force transmission pin 177*b* of the second regulating portion 177 is inserted into the groove 152*a* of the pin engaging portion 152 and is biased by the elastic member 153 from the bottom portion 46*a* side. Accordingly, when the shaft member 170 rotates, the rotating force transmission pin 177*b* is hooked to the pin engaging portion 152, and the rotating force can be transmitted to the bearing member 141. In addition, the coupling member 71 of the shaft member 170 is disposed so as to protrude from the side opposite to the side on which the bottom portion 46*a* is provided in the bearing member 141.

By disposing the shaft member 170 on the inside of the bearing member 141 in this manner, the shaft member 170 can be deformed to a posture illustrated in FIGS. 21A and 21B.

Similar to the posture illustrated in FIGS. 20A and 20B, when the shaft lines of the coupling member 71 of the shaft member 170, the rotating shaft 72, and the cam member 175 match each other and match the shaft line of the bearing member 141, the shaft member 170 is in a posture in which the coupling member 71 protrudes the most from the bearing member 141.

From the posture illustrated in FIG. 20A, as indicated by an arrow $C_{21a}$ in FIGS. 21A and 21B, when the coupling member 71 is moved in the direction orthogonal to the shaft line, the cam member 175 of the shaft member 170 is inclined. Accordingly, the shaft member 170 moves also in the direction along the shaft line with respect to the posture illustrated in FIGS. 21A and 21B, and the coupling member 71 moves so as to approach the bearing member 141. Therefore, the shaft member 170 can also move along the shaft line direction as indicated by an arrow $C_{21b}$ in FIGS. 21A and 21B.

In addition, when receiving the driving force from the apparatus main body 10, the shaft member 170 receives the rotating force around the shaft line as indicated by an arrow $C_{20a}$ in FIG. 20A. At this time, the coupling member 71, the rotating shaft 72, and the regulating pin engaging portion 173 rotate, and the cam member 175 engaged with the regulating pin engaging portion 173 rotates. When the cam member 175 rotates, the rotating force transmission pin 177*b* of the cam member 175 rotates, the rotating force transmission pin 177*b* presses the pin engaging portion 152 of the bearing member 141, the bearing member 141 rotates, and the rotating force can be transmitted to the photoreceptor drum 35.

According to the end member 140, due to the movement, it is possible to smoothly attach and detach the process cartridge to and the apparatus main body 10 similar to the end member 40.

Figure 22:
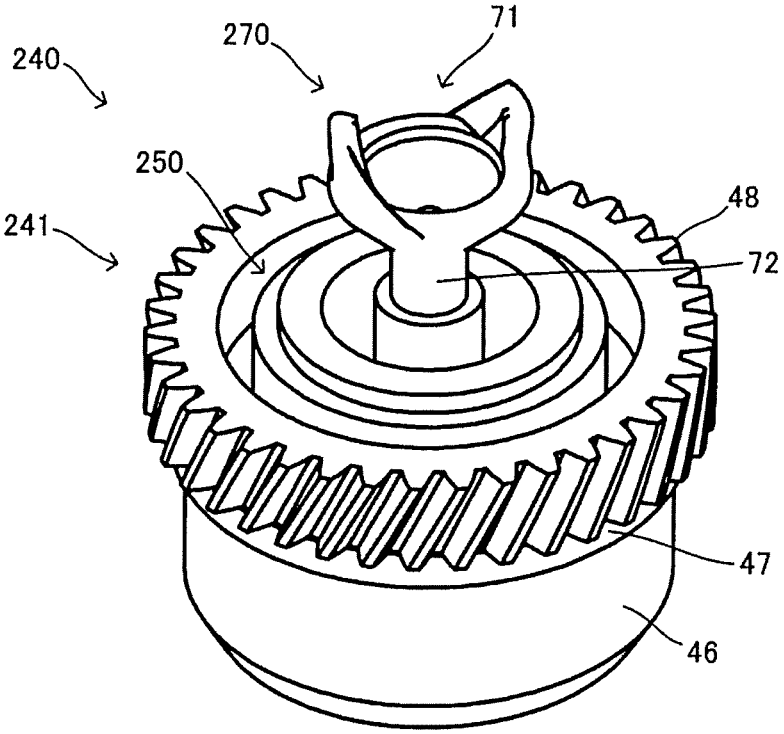
FIG. 22 is a perspective view of an end member 240.
Figure 23:
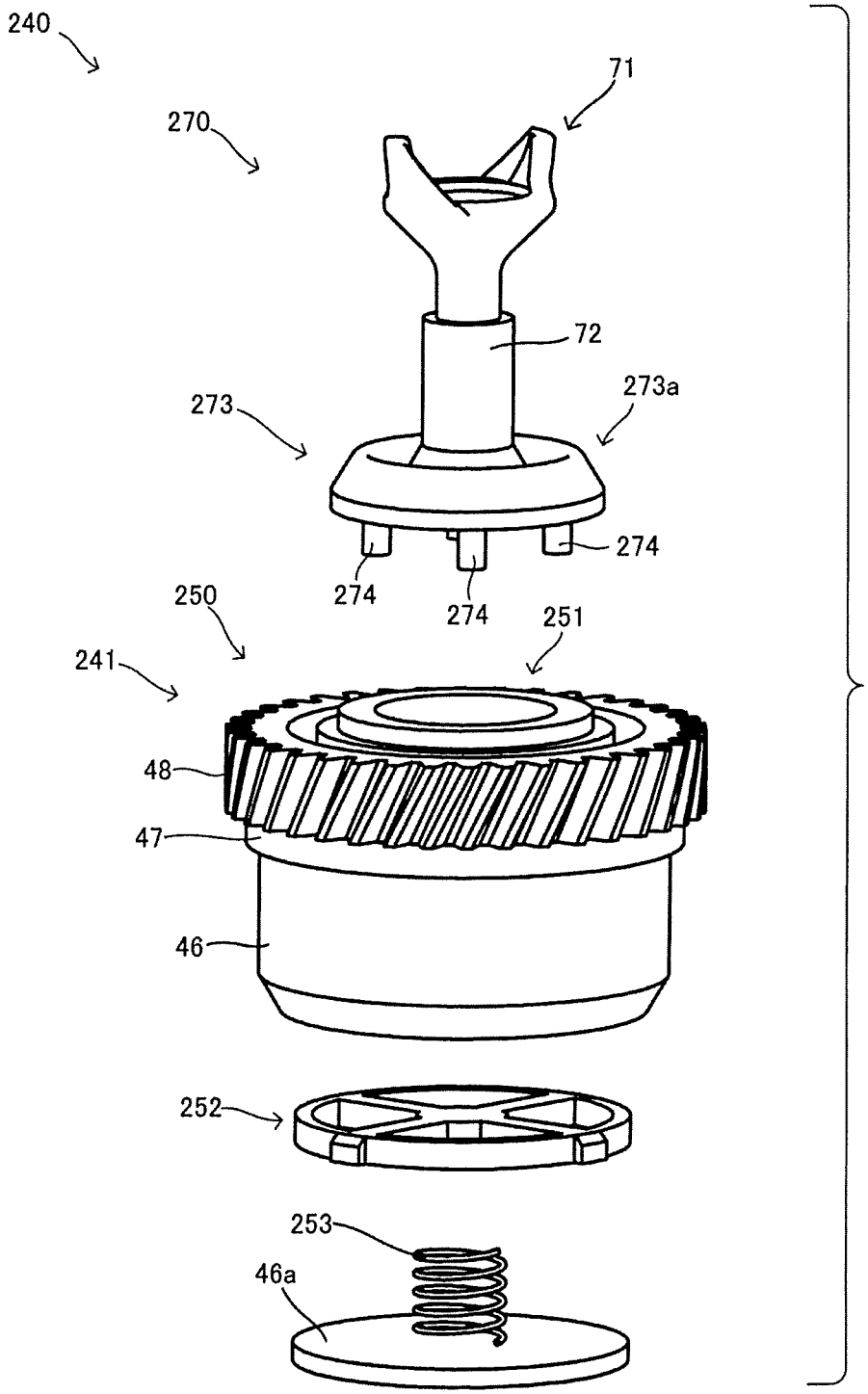
FIG. 23 is an exploded perspective view of the end member 240.

FIGS. 22 and 23 illustrate views for describing a third aspect. FIG. 22 is a perspective view of an end member 240, and FIG. 23 is an exploded perspective view of the end member 240. The end member 240 is also a member which is attached to the end portion of the photoreceptor drum 35. The end member 240 is provided with a bearing member 241 and a shaft member 270.

The bearing member 241 is a member fixed to the end portion of the photoreceptor drum 35. In the aspect, the bearing member 241 also includes the tubular body 46, the contact wall 47, and the gear 48. Since these can be employed with the same configuration as that of the bearing member 41 which is already described, the description thereof will be omitted here. In addition, in the aspect, in the tubular body 46, the bottom portion 46*a* is also provided on the side opposite to the side on which the coupling member 71 of the shaft member 270 is disposed to protrude, and at least a part thereof is blocked.

A holding portion 250 is provided on the tubular inside of the tubular body 46. The holding portion 250 is a part which holds one end side of the shaft member 270 which will be described later on the inside thereof. In addition, the holding portion 250 includes a base end holding portion 251, a pin engaging member 252, and an elastic member 253.

Figure 24A:
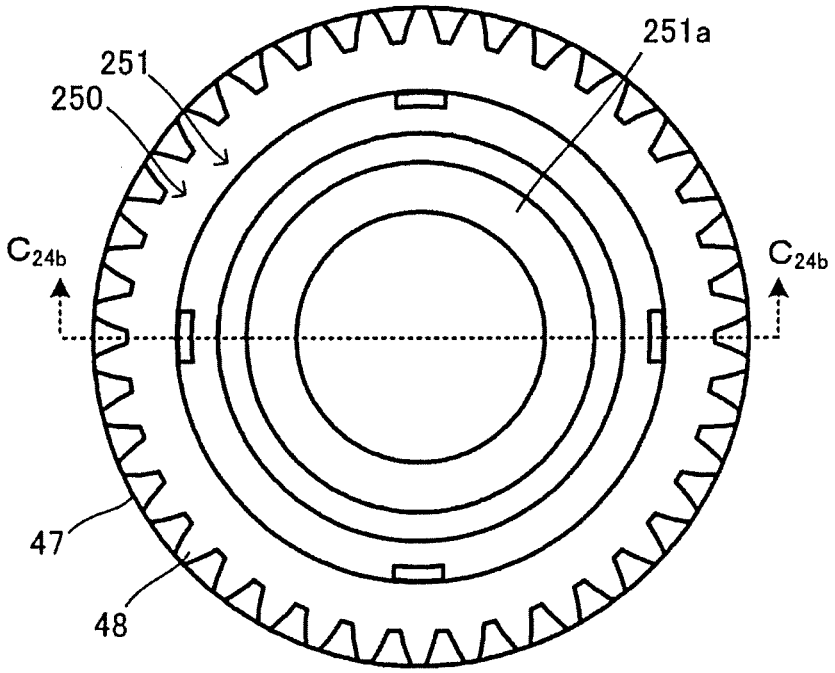
FIG. 24A is a plan view of a bearing member 241.
Figure 24B:
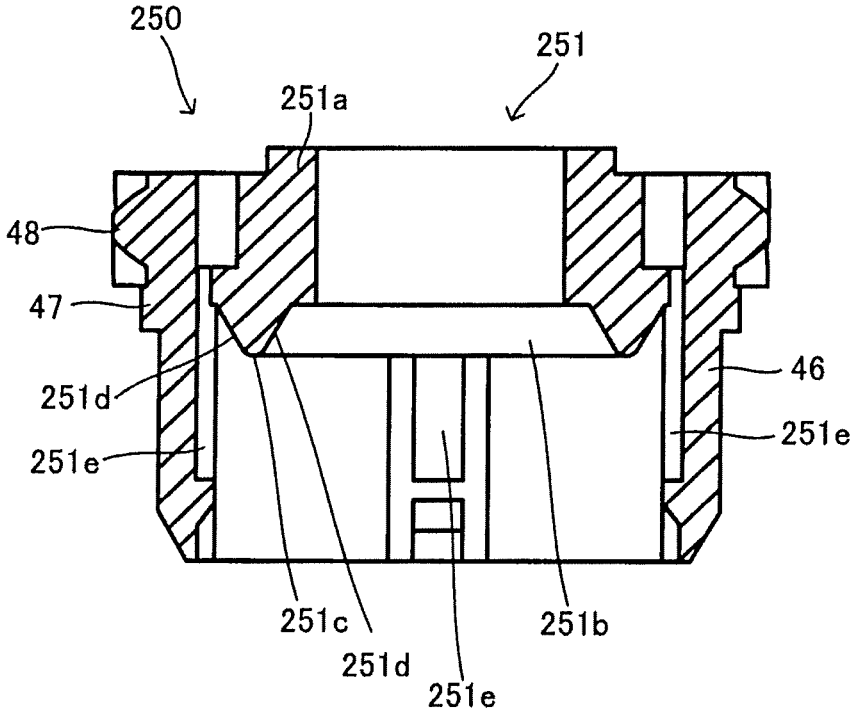
FIG. 24B is one sectional view of the bearing member 241.
Figure 25A:
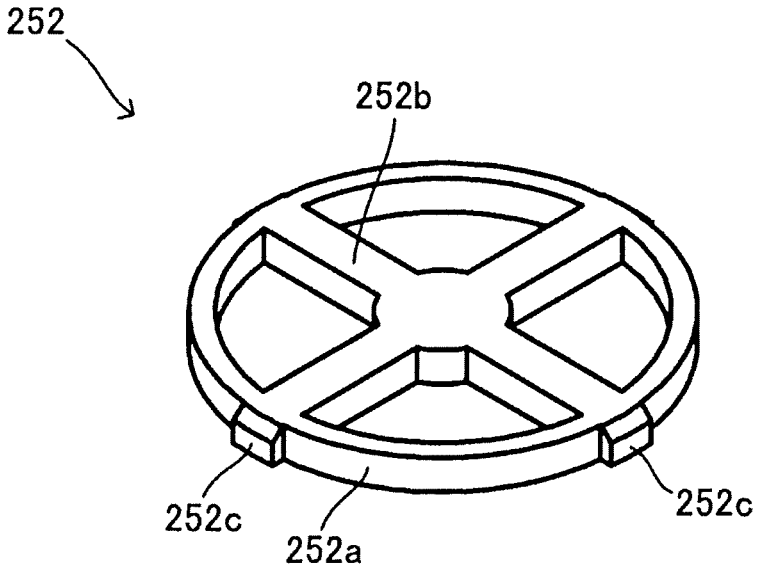
FIG. 25A is a perspective view of a pin engaging member 252.
Figure 25B:
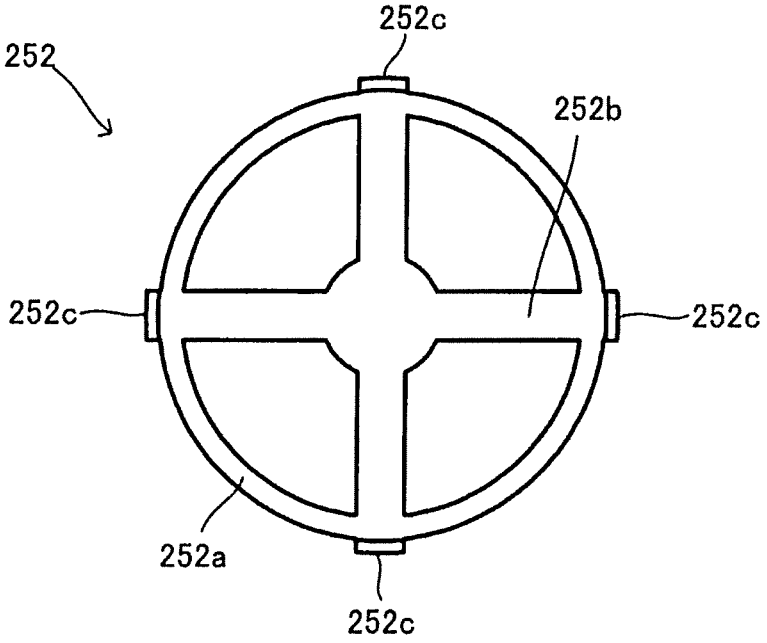
FIG. 25B is a plan view of the pin engaging member 252.

FIG. 24A illustrates a plan view of the bearing member 241 when viewed from the shaft line direction excluding the bottom portion 46*a*, the pin engaging member 252, and the elastic member 253, and FIG. 24B illustrates a sectional view along the line indicated by $C_{24b}$-$C_{24b}$ in FIG. 24A. In addition, FIG. 25A illustrates a perspective view of a pin engaging member 252, and FIG. 25B illustrates a plan view of the pin engaging member 252, respectively.

The base end holding portion 251 includes a tubular portion 251*a* having a tubular shape which is coaxial to the shaft line of the tubular body 46, and includes a cam projection 251*b* on the end surface disposed on the inside of the tubular body on the end surface of the tubular portion 251*a*. Therefore, in the aspect, the cam projection 251*b* is annular. In addition, the tubular inner diameter of the tubular portion 251*a* has a size by which the rotating shaft 72 of the shaft member 270 can pass therethrough and the base end portion 273 cannot pass therethrough.

The cam projection 251*b* functions as a mechanism in which the rotating force receiving portion (coupling member) moves also in the shaft line direction without being inclined by the movement in the direction orthogonal to the shaft line direction of the rotating force receiving portion (coupling member). In the aspect, the cam projection 251*b* is a projection having a curved surface provided on the end surface disposed so as to oppose the bottom portion 46*a* on the end surface of the tubular portion 251*a*. As illustrated in FIG. 24B, the cam projection 251*b* has a cam surface 251*d* which is a surface inclined to both sides thereof across a top portion 251*c* on the section thereof, and the cam surface 251*d* is inclined in a curved or linear shape so as to be separated from the bottom portion 46*a* as being separated from the top portion 251*c*. The aspect of the cam surface 251*d* is not particularly limited, but a spherical surface, a parabolic surface, a tapered surface, or the like can be employed.

In addition, the base end holding portion 251 has a groove 251*e* which extends in parallel to the shaft line of the tubular body 46 on the inner wall of the tubular body 46. The groove 251*e* is configured to be movable in a direction in which a projection 252*c* of the pin engaging member 252 which will be described later is inserted thereinto and the groove 251*e* extends. In the aspect, four grooves 251*e* are provided on the inner wall surface of the tubular body 46 at the center of the shaft line at intervals of 90 degrees.

The pin engaging member 252 has a function of receiving a rotating force from the shaft member 270 and transmitting the rotating force to the tubular body 46. In the aspect, the pin engaging member 252 includes an annular portion 252*a*, a partition portion 252*b*, and a projection 252*c* as can be ascertained from FIGS. 25A and 25B.

The annular portion 252*a* is an annular part having a size that can be contained on the inside of the tubular body 46 when the center thereof matches the shaft line of the tubular body 46.

The partition portion 252*b* is a part provided so as to partition the inside of the annular portion 252*a*, and in the aspect, the partition portions 252*b* partition the inside with "+" so as to intersect with each other. In the aspect, as will be described later, a rotating force transmission pin 274 of the shaft member 270 is disposed in each space partitioned by the partition portion 252*b*.

The projection 252*c* is a projection provided so as to protrude from the outer circumferential surface of the annular portion 252*a*. The projection 252*c* is a projection inserted into a groove 251*e* provided in the bearing member 241. In the aspect, four projections 252*c* are disposed at an interval of 90 degrees around the center of the annular portion 252*a*.

The elastic member 253 is disposed between the bottom portion 46*a* and the pin engaging member 252, and the shaft line direction is the biasing direction. In the aspect, a spring is used as the elastic member. However, it is not necessarily to provide a spring, and a sponge, rubber, or the like can also be used.

The material which configures the bearing member 241 can be considered similar to the above-described bearing member 41.

Figure 26A:
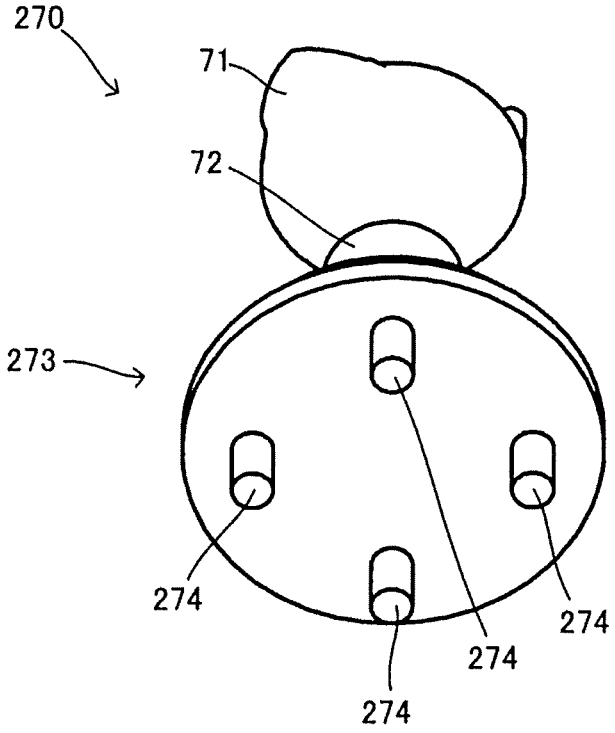
FIG. 26A is a perspective view of a shaft member 270.
Figure 26B:
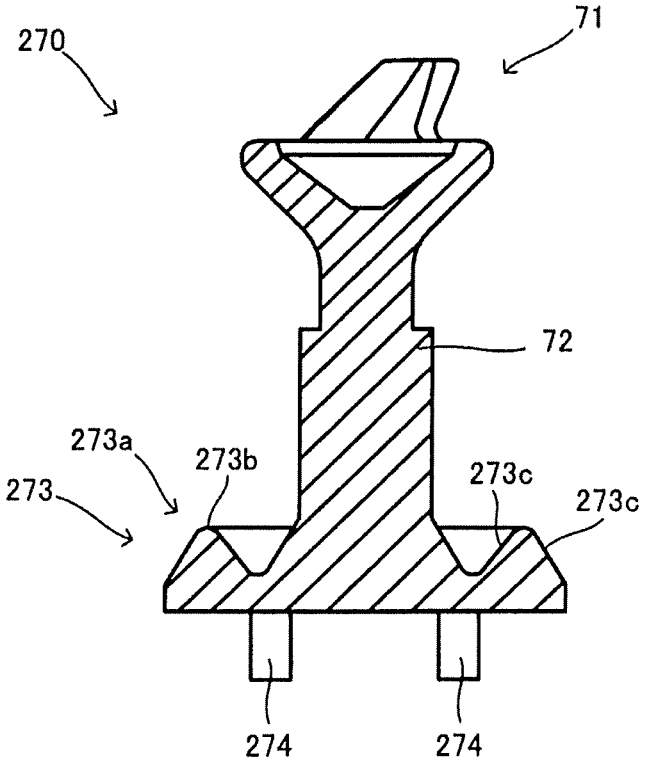
FIG. 26B is a sectional view of the shaft member 270.

Next, the shaft member 270 of the end member 240 will be described. FIG. 26A illustrates a perspective view of the shaft member 270 when viewed from the base end portion 273 side, and FIG. 26B illustrates a sectional view of the shaft member 170 along the shaft line of the shaft member 270. As can be ascertained from the drawings, the shaft member 270 is provided with the coupling member 71, the rotating shaft 72, the base end portion 273, and the rotating force transmission pin 274.

Since the coupling member 71 is the same as that which has been already described, the description thereof will be omitted here.

The rotating shaft 72 is a columnar shaft-like member that functions as a rotating force transmission portion which transmits the rotating force received by the coupling member 71. Therefore, the coupling member 71 is provided at one end of the rotating shaft 72. In the aspect, in the end portion of the rotating shaft 72, the base end portion 273 is provided in the end portion opposite to the side on which the coupling member 71 is disposed.

The base end portion 273 is a part which is provided on the side opposite to the coupling member 71 in the end portion of the rotating shaft 72, and is a disk-shaped part which is coaxial to the shaft line of the rotating shaft 72. In addition, a cam projection 273*a* is provided on a surface that becomes the coupling member 71 side on the disk-shaped surface. In the aspect, the movement of the shaft member 270 is controlled by disposing the cam projection 273*a* and the cam projection 251*b* of the bearing member 241 to be in contact with each other. Therefore, in the aspect, the cam projection 273*a* is annular and is provided so as to surround the rotating shaft 72.

As illustrated in FIG. 26B, the cam projection 273*a* of the aspect has a cam surface 273*c* which is a surface inclined to both sides thereof across a top portion 273*b* on the section thereof, and the cam surface 273*c* is inclined in a curved or linear shape so as to be separated from the coupling member 71 as being separated from the top portion 273*b*. The aspect of the cam surface 273*c* is not particularly limited, but a spherical surface, a parabolic surface, a tapered surface, or the like can be employed.

The rotating force transmission pin 274 is a pin-shaped projection provided on a surface opposite to a side on which the rotating shaft 72 and the cam projection 273*a* are disposed, on the surface of the base end portion 273. In the aspect, four rotating force transmission pins 274 are disposed at intervals of 90 degrees around the shaft line of the rotating shaft 72.

A material of the shaft member 270 is not particularly limited, but a resin, such as polyacetal, polycarbonate, or PPS can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

Figure 27A:
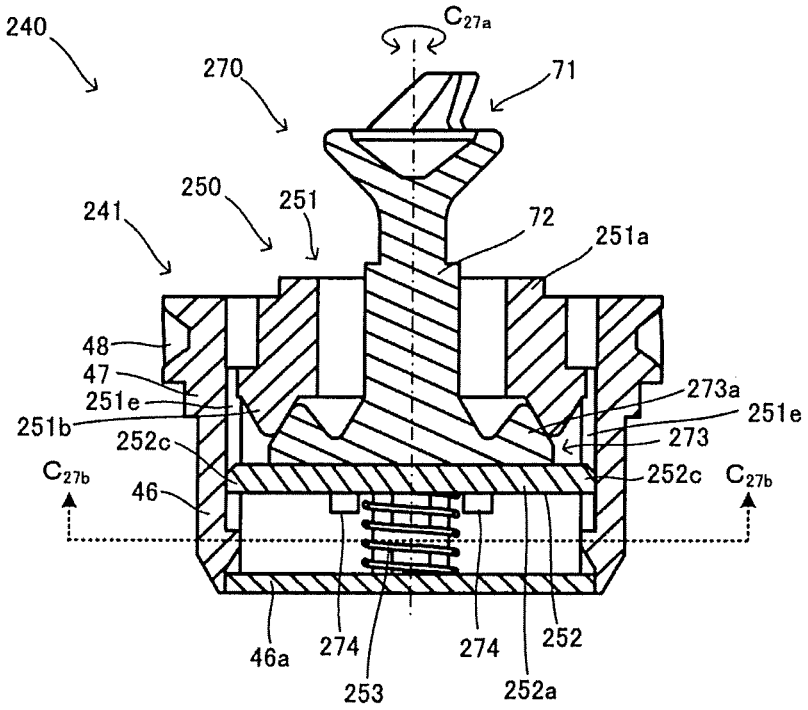
FIG. 27A is a sectional view in a shaft line direction of the end member 240.
Figure 27B:
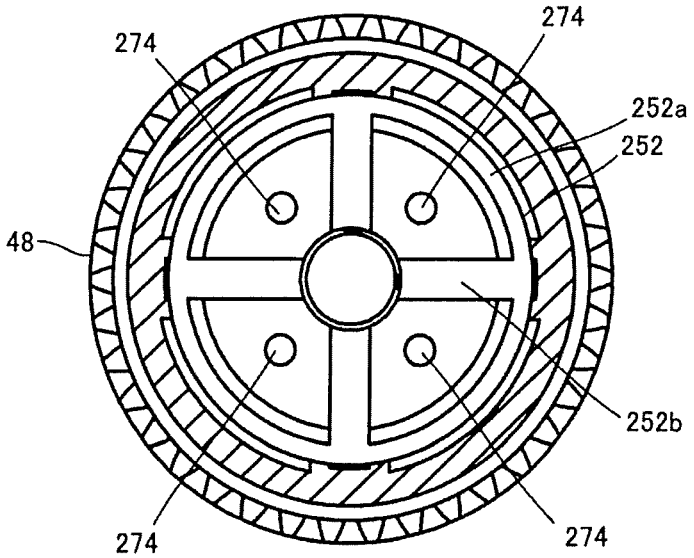
FIG. 27B is a sectional view orthogonal to the shaft line direction of the end member 240.
Figure 28A:
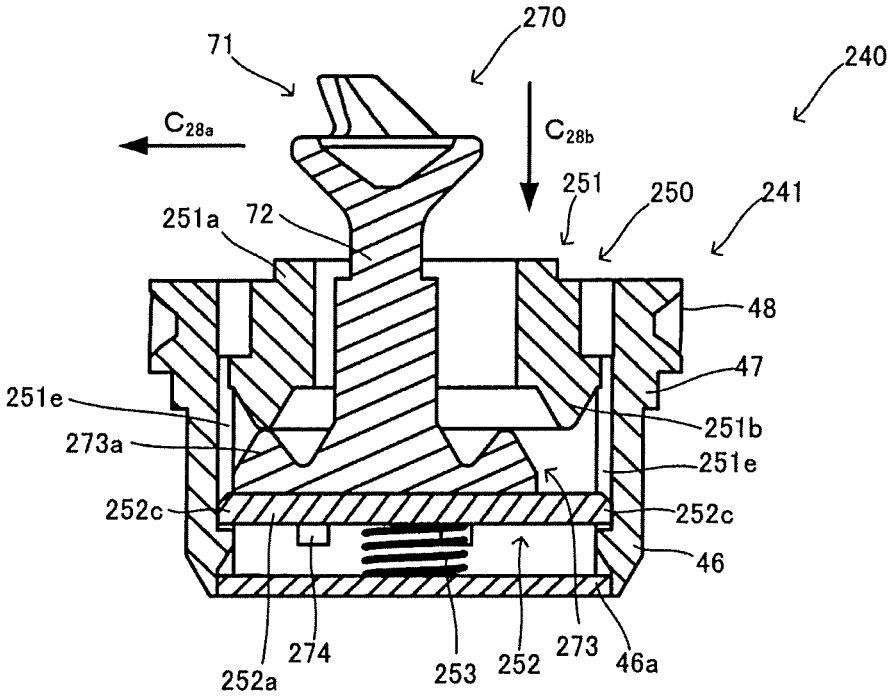
FIG. 28A is a sectional view in the shaft line direction of the end member 240.
Figure 28B:
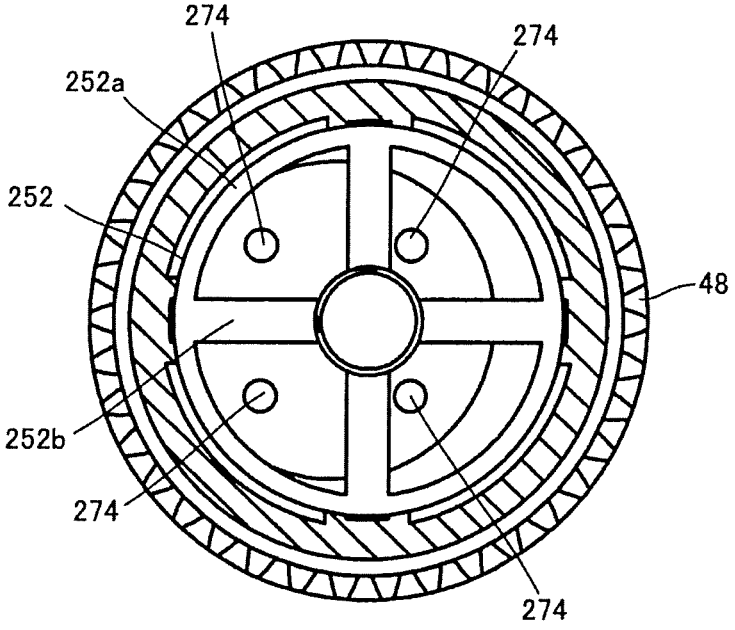
FIG. 28B is a sectional view orthogonal to the shaft line direction of the end member 240.

By combining the bearing member 241 and the shaft member 270 with each other as follows, the end member 240 is made. By describing the combination, the shape, the size, or the positional relationship of the bearing member 241 and the shaft member 270 are further understood. FIG. 27A illustrates a sectional view of the end member 240 along the shaft line direction, and FIG. 27B illustrates a sectional view along the line indicated by $C_{27b}$-$C_{27b}$ in FIG. 27A. In addition, FIG. 28A illustrates one example of the posture in which the shaft member 270 moves in the viewpoint illustrated in FIG. 27A, and FIG. 28B illustrates one example of the posture in which the shaft member 270 moves in the viewpoint illustrated in FIG. 27B, respectively.

As can be ascertained from FIGS. 27A and 27B, the elastic member 253 is disposed on the inside of the tubular body 46 on the surface of the bottom portion 46*a*. The biasing force is parallel to the shaft line of the tubular body 46. In addition, the pin engaging member 252 is mounted on a side opposite to the bottom portion 46*a* side in the end portion of the elastic member 253. At this time, the projection 252*c* provided at the outer circumference of the pin engaging member 252 is inserted into the groove 251*e* provided on the inside of the tubular body 46.

The base end portion 273 of the shaft member 270 is placed on the side opposite to the side on which the elastic member 253 is disposed on the surface of the pin engaging member 252. At this time, the rotating force transmission pin 274 which protrudes from the base end portion 273 is inserted into the space formed between the partition portions 252*b* of the pin engaging member 252.

In addition, the rotating shaft 72 of the shaft member 270 passes through the inside of the tubular portion 251*a* of the bearing member 241, and the coupling member 71 is disposed to protrude from the bearing member 241.

At this time, the cam projection 273*a* provided in the base end portion 273 of the shaft member 270 and the cam projection 251*b* provided in the holding portion 250 of the bearing member 241 are disposed to face each other, and in the posture illustrated in FIGS. 27A and 27B, the cam surface 251*d* and the cam surface 273*c* are positioned to be in contact with each other. In this manner, when the cam projection 273*a* and the cam projection 251*b* come into contact with each other through the cam surfaces that are not the top portion 251*c* and the top portion 273*b*, the shaft line of the shaft member 270 and the shaft line of the bearing member 241 are configured to match each other.

By disposing the shaft member 270 on the inside of the bearing member 241 in this manner, the shaft member 270 can be deformed to a posture illustrated in FIGS. 28A and 28B from the posture illustrated in FIGS. 27A and 27B.

Similar to the posture illustrated in FIGS. 27A and 27B, when the shaft lines of the coupling member 71 of the shaft member 270, the rotating shaft 72, and the base end portion 273 match each other and match the shaft line of the bearing member 241, the shaft member 270 is in a posture in which the coupling member 71 protrudes the most from the bearing member 241.

From the posture illustrated in FIG. 27A, as indicated by an arrow $C_{28a}$ in FIG. 28A, when the coupling member 71 is moved in the direction orthogonal to the shaft line, the cam projection 273*a* of the shaft member 270 moves and slides on the cam projection 251*b* of the bearing member 241, and the top portion 251*c* and the top portion 273*b* come into contact with each other. Accordingly, the shaft member 270 moves also in the direction along the shaft line with respect to the posture illustrated in FIGS. 27A and 27B, and the coupling member 71 moves so as to approach the bearing member 241. Therefore, the shaft member 270 can also move along the shaft line direction as indicated by an arrow $C_{28b}$ in FIG. 28A. At this time, the rotating force transmission pin 274 moves within the space on the inside of the pin engaging member 252. In addition, the pin engaging member 252 moves in the shaft line direction against the biasing force of the elastic member 253 as the projection 252*c* is guided to the groove 251*e*.

In addition, when receiving the driving force from the apparatus main body 10, the shaft member 270 receives the rotating force around the shaft line as indicated by an arrow $C_{27a}$ in FIG. 27A. At this time, the coupling member 71, the rotating shaft 72, the base end portion 273, and the rotating force transmission pin 274 rotate, the rotating force transmission pin 274 is hooked to the partition portion 252*b* of the pin engaging member 252, and the pin engaging member 252 rotates. Furthermore, the projection 252*c* of the pin engaging member 252 is hooked to the side wall of the groove 251*e* of the tubular body 46, the bearing member 241 rotates, and the rotating force can be transmitted to the photoreceptor drum 35.

According to the end member 240, due to the movement, it is possible to smoothly attach and detach the process cartridge to and the apparatus main body 10 similar to the end member 40.

Figure 29:
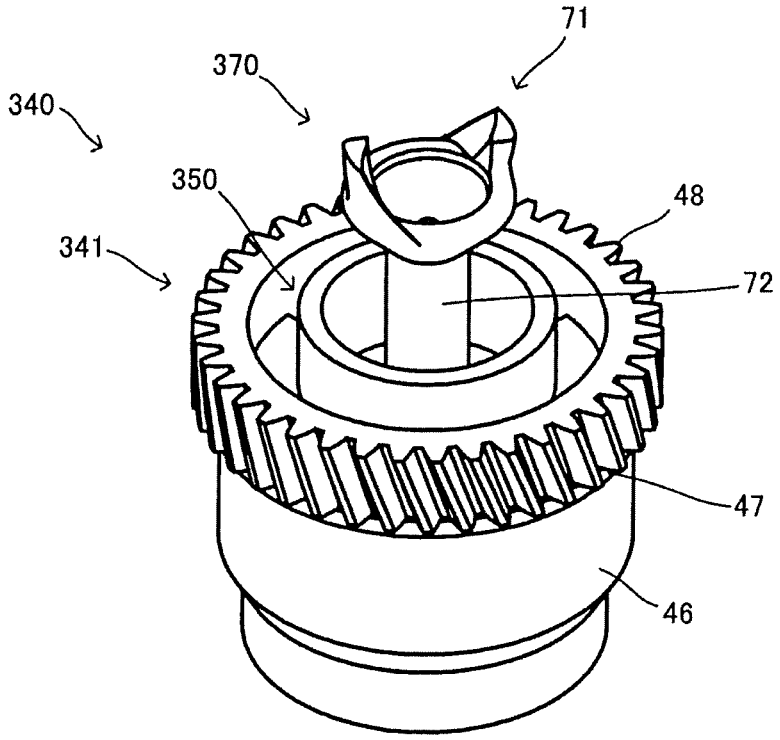
FIG. 29 is a perspective view of an end member 340.
Figure 30:
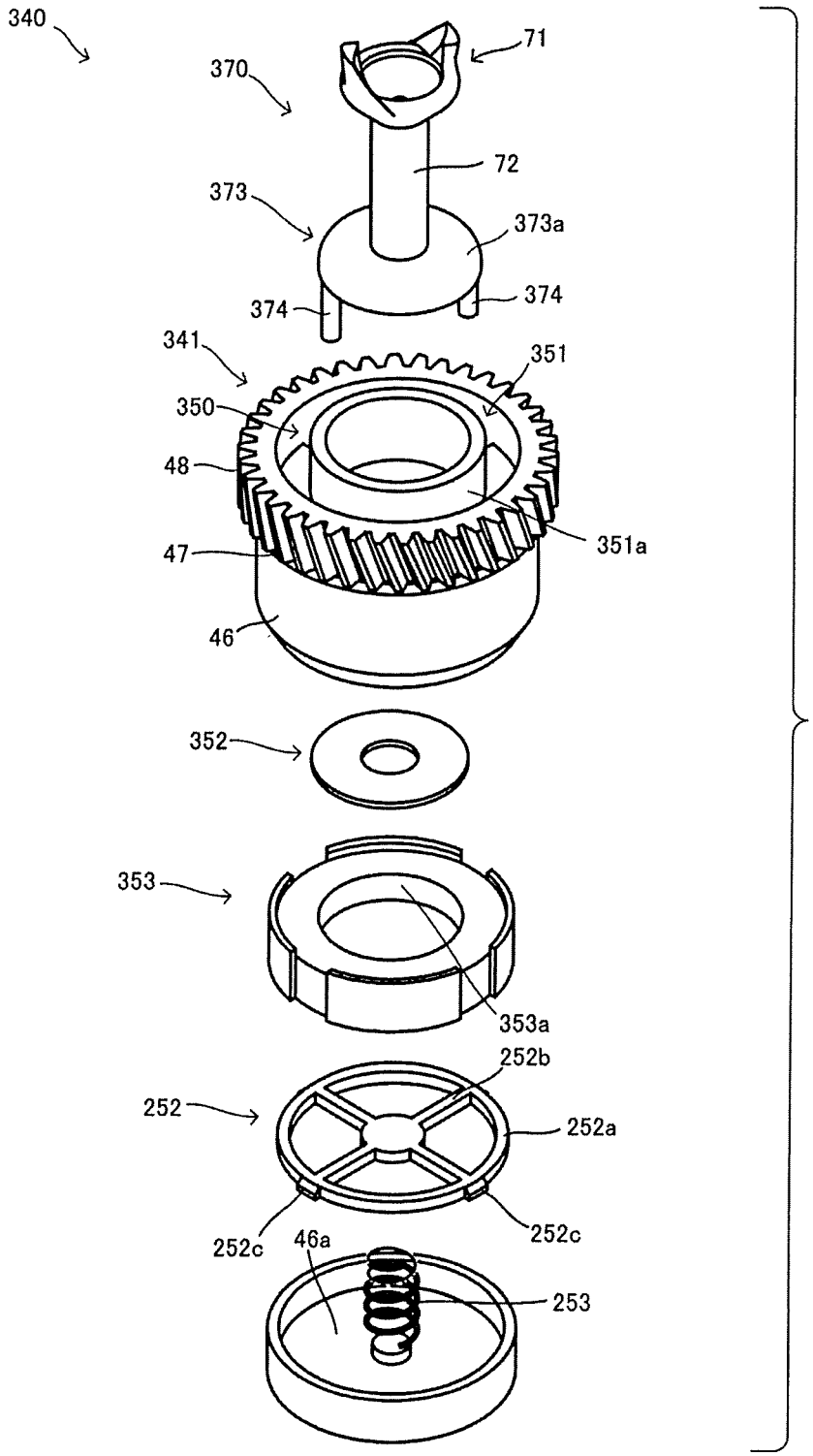
FIG. 30 is an exploded perspective view of the end member 340.

FIGS. 29 and 30 illustrate views for describing the fourth aspect. FIG. 29 is a perspective view of an end member 340, and FIG. 30 is an exploded perspective view of the end member 340. The end member 340 is also a member which is attached to the end portion of the photoreceptor drum 35. The end member 340 is provided with a bearing member 341 and a shaft member 370.

The bearing member 341 is a member fixed to the end portion of the photoreceptor drum 35. In the aspect, the bearing member 341 also includes the tubular body 46, the contact wall 47, and the gear 48. Since these can be employed with the same configuration as that of the bearing member 41 which is already described, the description thereof will be omitted here. In addition, in the aspect, in the tubular body 46, the bottom portion 46*a* is also provided on the side opposite to the side on which the coupling member 71 of the shaft member 370 is disposed to protrude, and at least a part thereof is blocked.

A holding portion 350 is provided on the tubular inside of the tubular body 46. The holding portion 350 is a part which holds one end side (base end portion side) of the shaft member 370 which will be described later on the inside thereof. In addition, the holding portion 350 includes a base end holding portion 351, a tilting prevention member 352, a cam member 353, the pin engaging member 252, and the elastic member 253.

Figure 31:
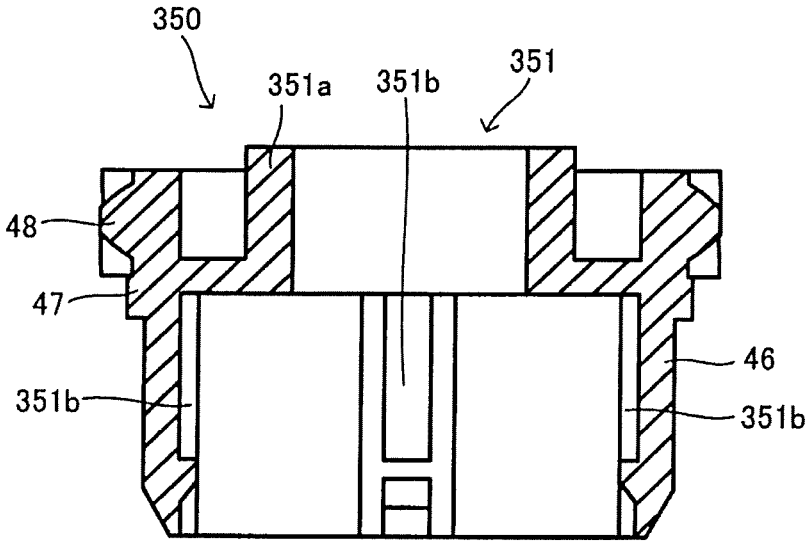
FIG. 31 is a sectional view of a bearing member 341.
Figure 32A:
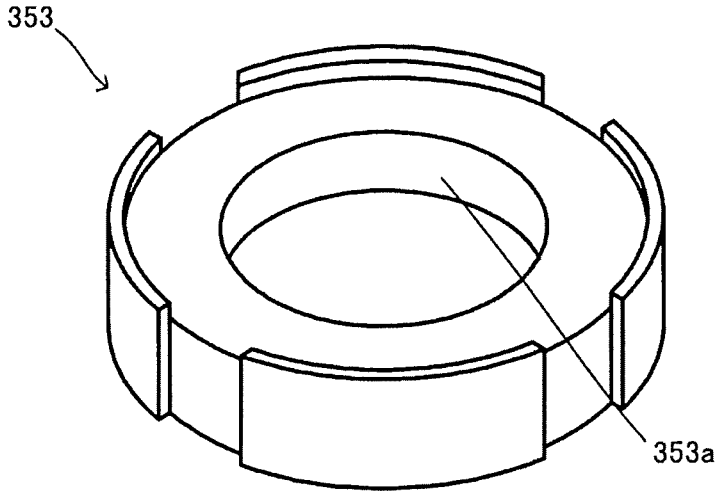
FIG. 32A is a perspective view of a cam member 353.
Figure 32B:
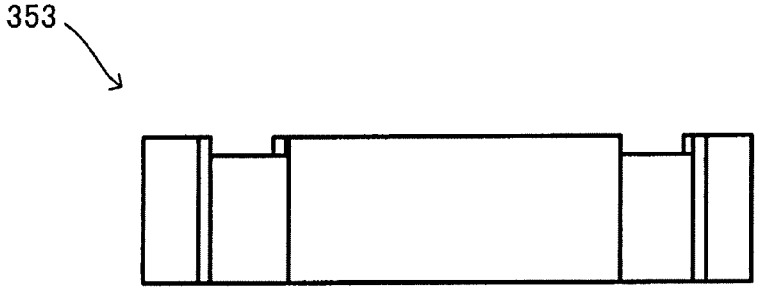
FIG. 32B is a front view of the cam member 353.
Figure 32C:
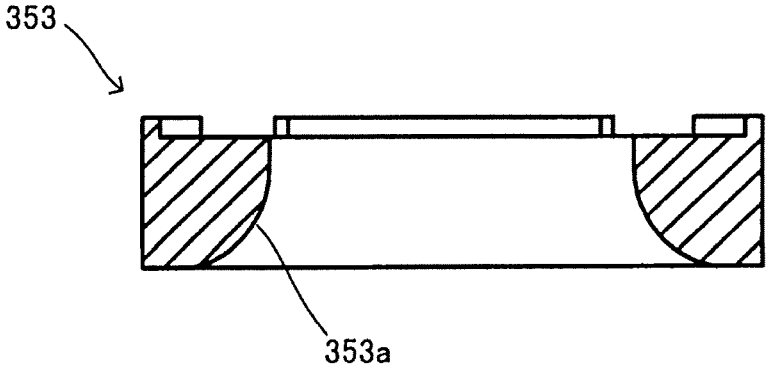
FIG. 32C is a sectional view of the cam member 353.

FIG. 31 illustrates a sectional view along the shaft line excluding the bottom portion 46*a*, the tilting prevention member 352, the cam member 353, the pin engaging member 252, and the elastic member 253 of the bearing member 341. In addition, FIG. 32A illustrates a perspective view of the cam member 353, FIG. 32B illustrates a front view of the cam member 353, and FIG. 32C illustrates a sectional view of the cam member 353, respectively.

In addition, since the pin engaging member 252 and the elastic member 253 are the same as those provided in the end member 240, the same reference numerals will be given and the description thereof will be omitted.

The base end holding portion 351 has a tubular portion 351*a* having a tubular shape which is coaxial to the shaft line of the tubular body 46, and the tubular inner diameter thereof has a size by which the rotating shaft 72 of the shaft member 370 can pass therethrough and a base end portion 373 cannot pass therethrough.

In addition, the base end holding portion 351 has a groove 351*b* which extends in parallel to the shaft line of the tubular body 46 on the inner wall of the tubular body 46. The groove 351*b* is configured to be movable in a direction in which the projection 252*c* of the pin engaging member 252 is inserted thereinto and the groove 351*b* extends. In the aspect, four grooves 351*e* are provided on the inner wall surface of the tubular body 46 at the center of the shaft line at intervals of 90 degrees.

The tilting prevention member 352 is an annular member. The inner diameter of the inner hole having an annular shape is generally the same as the outer diameter of the rotating shaft 72 of the shaft member 370, and accordingly, the shaft member 370 is prevented from being tilted.

The cam member 353 functions as a mechanism in which the rotating force receiving portion (coupling member 71) moves also in the shaft line direction without being inclined by the movement in the direction orthogonal to the shaft line direction of the rotating force receiving portion (coupling member 71), and has an annular shape in the aspect.

As can be ascertained from FIG. 32C, the inner wall surface which forms the annular inner hole of the cam member 353 is inclined to be curved or linear such that the diameter changes along the annular shaft line direction, and this becomes a cam surface 353*a*. The aspect of the cam surface 353*a* is not particularly limited, but a spherical surface, a parabolic surface, a tapered surface, or the like can be employed.

The material which configures the bearing member 341 can be considered similar to the above-described bearing member 41.

Figure 33A:
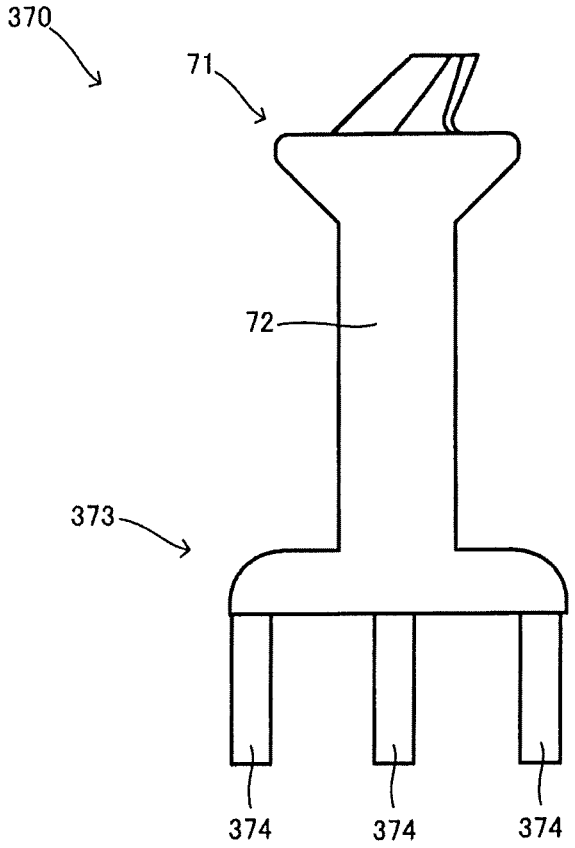
FIG. 33A is a front view of a shaft member 370.
Figure 33B:
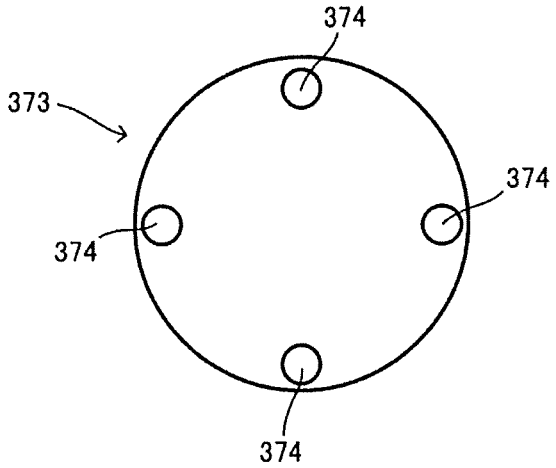
FIG. 33B is a plan view of the shaft member 370.

Next, the shaft member 370 of the end member 340 will be described. FIG. 33A illustrates a front view of the shaft member 370, and FIG. 33B illustrates a plan view of the shaft member 370 viewed from the base end portion 373 side. As can be ascertained from the drawings, the shaft member 370 is provided with the coupling member 71, the rotating shaft 72, the base end portion 373, and a rotating force transmission pin 374.

Since the coupling member 71 is the same as that which has been already described, the description thereof will be omitted here.

The rotating shaft 72 is a columnar shaft-like member that functions as a rotating force transmission portion which transmits the rotating force received by the coupling member 71. Therefore, the coupling member 71 is provided at one end of the rotating shaft 72. In the aspect, in the end portion of the rotating shaft 72, the base end portion 373 is provided in the end portion opposite to the side on which the coupling member 71 is disposed.

The base end portion 373 is a part which is provided on the side opposite to the coupling member 71 in the end portion of the rotating shaft 72, and is a disk-shaped part which is coaxial to the shaft line of the rotating shaft 72. In addition, a cam surface 373*a* is provided on the outer circumferential surface on the disk-shaped surface. In the aspect, the movement of the shaft member 370 is controlled by disposing the cam surface 373*a* and the cam surface 353*a* of the above-described bearing member 341 to be in contact with each other.

In the cam surface 373*a* of the aspect, as illustrated in FIG. 33A, the diameter of the disk changes along the shaft line direction and is inclined in a curved or linear shape. The aspect of the inclination of a cam surface 373*c* is not particularly limited, but a spherical surface, a parabolic surface, a tapered surface, or the like can be employed.

The rotating force transmission pin 374 is a pin-shaped projection provided on a surface opposite to the side on which the rotating shaft 72 is disposed, on the surface of the base end portion 373. In the aspect, four rotating force transmission pins 374 are disposed at intervals of 90 degrees around the shaft line of the rotating shaft 72.

A material of the shaft member 370 is not particularly limited, but a resin, such as polyacetal, polycarbonate, or PPS can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

Figure 34A:
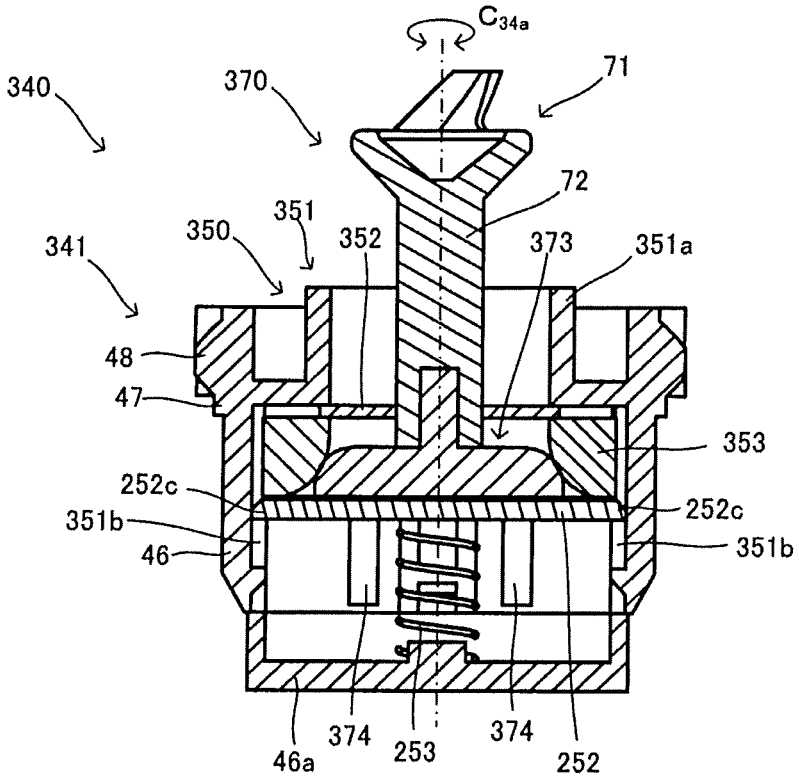
FIG. 34A is a sectional view in the shaft line direction of the end member 340.
Figure 34B:
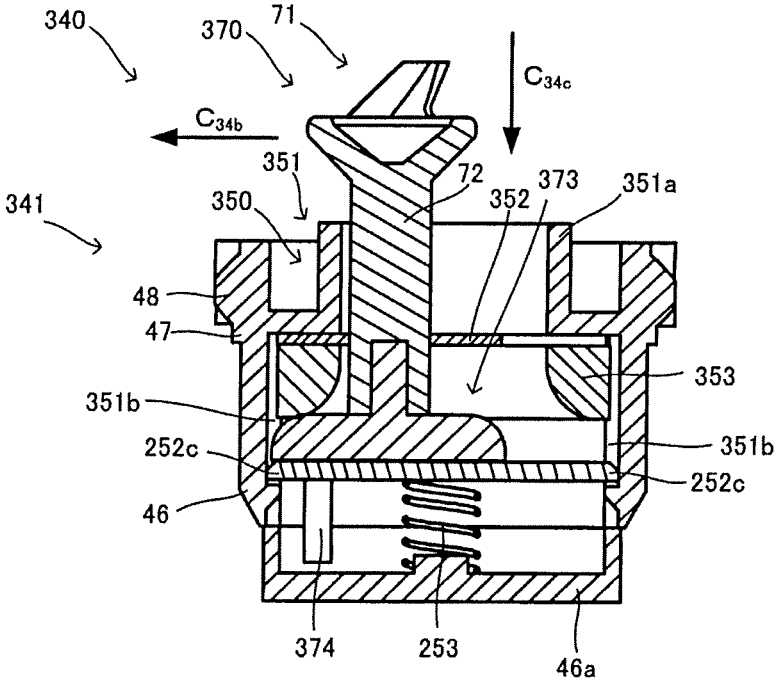
FIG. 34B is a sectional view in the shaft line direction of the end member 340 in another posture.

By combining the bearing member 341 and the shaft member 370 with each other as follows, the end member 340 is made. By describing the combination, the shape, the size, or the positional relationship of the bearing member 341 and the shaft member 370 are further understood. FIG. 34A illustrates a sectional view of the end member 340 along the shaft line direction. In addition, FIG. 34B illustrates one example of the posture in which the shaft member 370 moves in the viewpoint illustrated in FIG. 34A.

As can be ascertained from FIG. 34A, the elastic member 253 is disposed on a side that becomes the inside of the tubular body 46 on the surface of the bottom portion 46*a*. The biasing force is parallel to the shaft line of the tubular body 46. In addition, the pin engaging member 252 is mounted on a side opposite to the bottom portion 46*a* side in the end portion of the elastic member 253. At this time, the projection 252*c* provided at the outer circumference of the pin engaging member 252 is inserted into the groove 351*b* provided on the inside of the tubular body 46.

Furthermore, on the side opposite to the side on which the elastic member 253 is disposed on the surface of the pin engaging member 252, the cam member 353 is placed so as to be coaxial to the pin engaging member 252, and the tilting prevention member 352 is further coaxially disposed thereon.

At this time, as can be ascertained from FIG. 34A, the cam member 353 is oriented such that the inner diameter of the cam surface 353*a* increases on the pin engaging member 252 side.

In addition, the base end portion 373 of the shaft member 370 is placed on the side opposite to the side on which the elastic member 253 is disposed on the surface of the pin engaging member 252. At this time, the rotating force transmission pin 374 which protrudes from the base end portion 373 is inserted into the space formed between the partition portions 252*b* of the pin engaging member 252.

In addition, the rotating shaft 72 of the shaft member 370 passes through the cam member 353, the tilting prevention member 352, and the tubular portion 351*a*, and the coupling member 71 is disposed to protrude from the bearing member 341.

At this time, the cam surface 373*a* provided in the base end portion 373 of the shaft member 370 and the cam surface 353*a* provided in the holding portion 350 of the bearing member 341 are disposed to be in contact with each other over the entire circumference so as to face each other, and the shaft line of the shaft member 370 and the shaft line of the bearing member 341 are configured to match each other.

By disposing the shaft member 370 on the inside of the bearing member 341 in this manner, the shaft member 370 can be deformed to a posture illustrated in FIG. 34B from the posture illustrated in FIG. 34A.

Similar to the posture illustrated in FIG. 34A, when the shaft lines of the coupling member 71 of the shaft member 370, the rotating shaft 72, and the base end portion 373 match each other and match the shaft line of the bearing member 341, the shaft member 370 is in a posture in which the coupling member 71 protrudes the most from the bearing member 341.

When the coupling member 71 is moved in the direction orthogonal to the shaft line as indicated by an arrow $C_{34b}$ in FIG. 34B from the posture illustrated in FIG. 34A, the cam surface 373*a* also moves since the base end portion 373 of the shaft member 370 moves, and slides on the cam surface 353*a* of the bearing member 241. Accordingly, the shaft member 370 moves also in the direction along the shaft line with respect to the posture illustrated in FIG. 34A, and the coupling member 71 moves so as to approach the bearing member 341. Therefore, the shaft member 370 can also move along the shaft line direction as indicated by an arrow $C_{34c}$ in FIG. 34B. At this time, the rotating force transmission pin 374 moves within the space on the inside of the pin engaging member 252. In addition, the pin engaging member 252 moves in the shaft line direction against the biasing force of the elastic member 253 as the projection 252*c* is guided to the groove 351*b* formed on the inside of the tubular body 46.

In addition, when receiving the driving force from the apparatus main body 10, the shaft member 370 receives the rotating force around the shaft line as indicated by an arrow $C_{34a}$ in FIG. 34A. At this time, the coupling member 71, the rotating shaft 72, the base end portion 373, and the rotating force transmission pin 374 rotate, the rotating force transmission pin 374 is hooked to the partition portion 252*b* of the pin engaging member 252, and the pin engaging member 252 rotates. Furthermore, the projection 252*c* of the pin engaging member 252 is hooked to the side wall of the groove 251*e* of the tubular body 46, the bearing member 241 rotates, and the rotating force can be transmitted to the photoreceptor drum 35.

According to the end member 340, due to the movement, it is possible to smoothly attach and detach the process cartridge to and the apparatus main body 10 similar to the end member 40.

Figure 35:
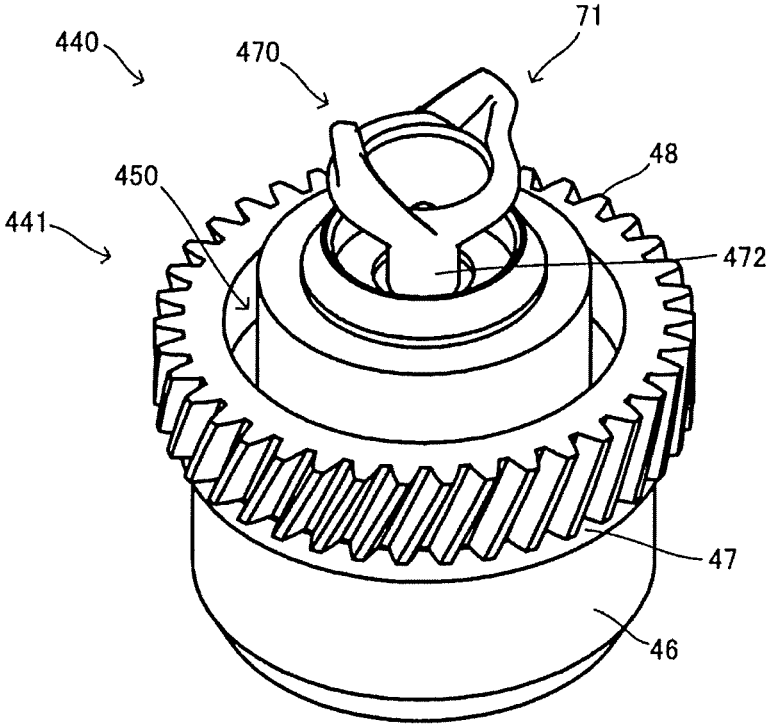
FIG. 35 is a perspective view of an end member 440.
Figure 36:
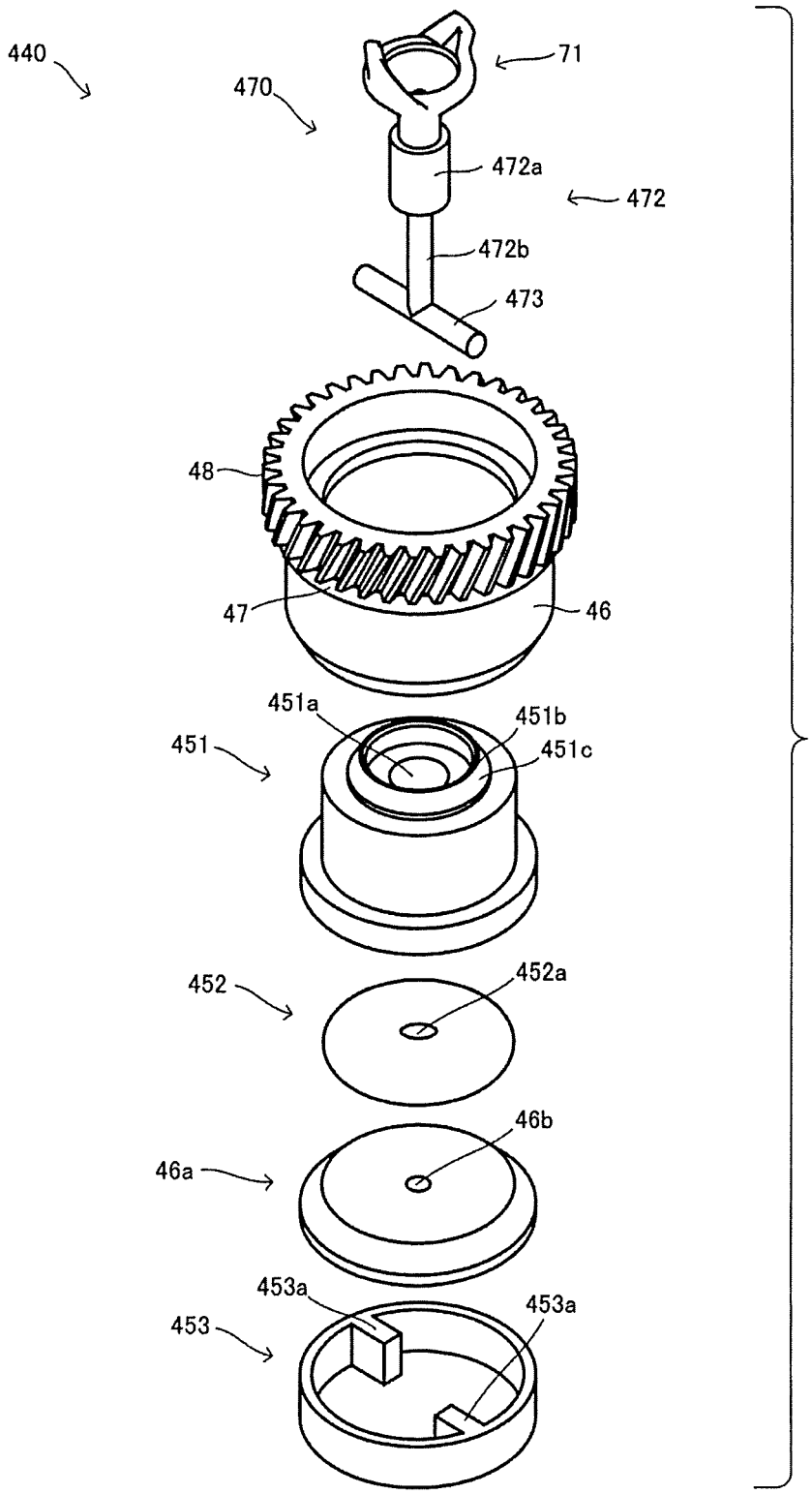
FIG. 36 is an exploded perspective view of the end member 440.

FIGS. 35 and 36 illustrate views for describing a fifth aspect. FIG. 35 is a perspective view of an end member 440, and FIG. 36 is an exploded perspective view of the end member 440. The end member 440 is also a member which is attached to the end portion of the photoreceptor drum 35. The end member 440 is provided with a bearing member 441 and a shaft member 470.

The bearing member 441 is a member fixed to the end portion of the photoreceptor drum 35. In the aspect, the bearing member 441 also includes the tubular body 46, the contact wall 47, and the gear 48. Since these can be employed with the same configuration as that of the bearing member 41 which is already described, the description thereof will be omitted here. In addition, in the aspect, in the tubular body 46, the bottom portion 46*a* is also provided on the side opposite to the side on which the coupling member 71 of the shaft member 470 is provided to protrude, and at least a part thereof is blocked. In addition, in the aspect, in the tubular body 46, a hole 46*b* through which the second rotating shaft 472*b* of the shaft member 470 passes is provided at a position that becomes the center in the bottom portion 46*a*.

A holding portion 450 is provided on the tubular inside of the tubular body 46. The holding portion 450 is a part which holds one end side (base end portion side) of the shaft member 470 which will be described later on the inside thereof. In addition, the holding portion 450 includes a pressing member 451, a deforming member 452, and a pin engaging member 453.

Figure 37A:
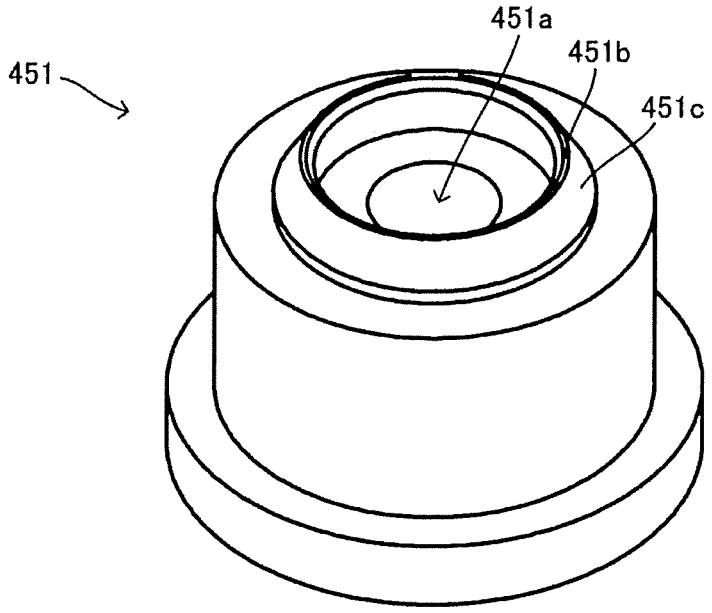
FIG. 37A is a perspective view of a pressing member 451.
Figure 37B:
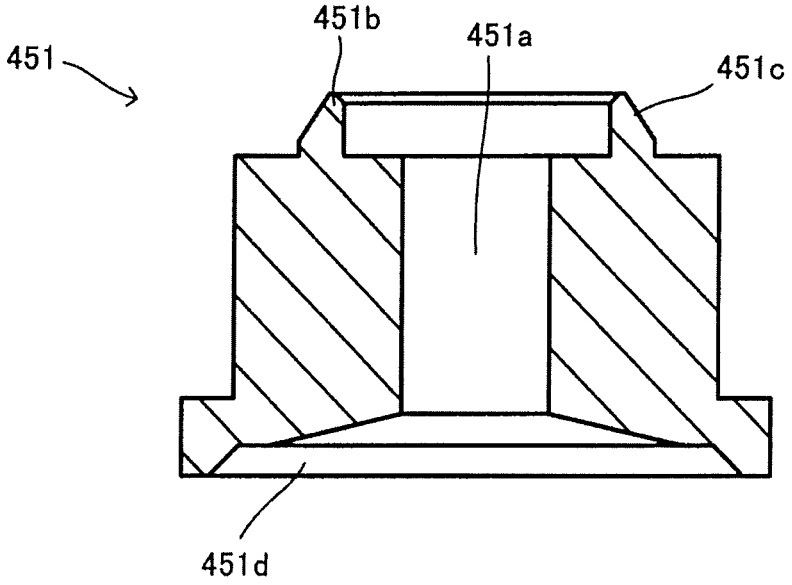
FIG. 37B is a sectional view of the pressing member 451.

FIG. 37A illustrates a perspective view of the pressing member 451, and FIG. 37B illustrates a sectional view of the pressing member 451 along the shaft line direction.

The pressing member 451 is a tubular member which is coaxial to the shaft line of the tubular body 46, and the inner diameter of a tubular inner hole 451*a* has a size by which the first rotating shaft 472*a* formed to be thick in the rotating shaft 472 of the shaft member 470 can pass therethrough.

In addition, a coaxial and annular protruding portion 451*b* is formed on the end surface on one end side of the pressing member 451, and an inclined surface 451*c* is provided on the outer circumference surface of the pressing member 451. The inclined surface 451*c* moves the pressing member 451 in the shaft line direction as will be described later.

Furthermore, a recess portion 451*d* is formed on the end surface of the pressing member 451 on the other end side. As will be described later, a part of the deforming member 452 is disposed here. As can be ascertained from FIG. 37B, the recess portion 451*d* of the aspect is a recess portion which is inclined so as to become deeper as approaching the shaft line. Accordingly, the deformation of the deforming member 452 can be performed more smoothly.

The deforming member 452 is a member that is deformed as being pressed to be crushed. As such a member, for example, a member in which gas or liquid is sealed in a flexible bag-like container can be employed. Accordingly, the deformation is performed by the pressing force by the pressing member 451.

In the aspect, the deforming member 452 is annular with a hole 452*a* at the center thereof.

The pin engaging member 453 is a member which receives the rotating force from a rotating force transmission pin 473 that also serves as a base end portion of the shaft member 470, and rotates the bearing member 441. As can be ascertained from FIG. 36, the pin engaging member 453 is annular and has a pin engaging projection 453*a* which is a projection to which the rotating force transmission pin 473 is hooked on the inside thereof.

The material which configures the bearing member 441 can be considered similar to the above-described bearing member 41.

Figure 38A:
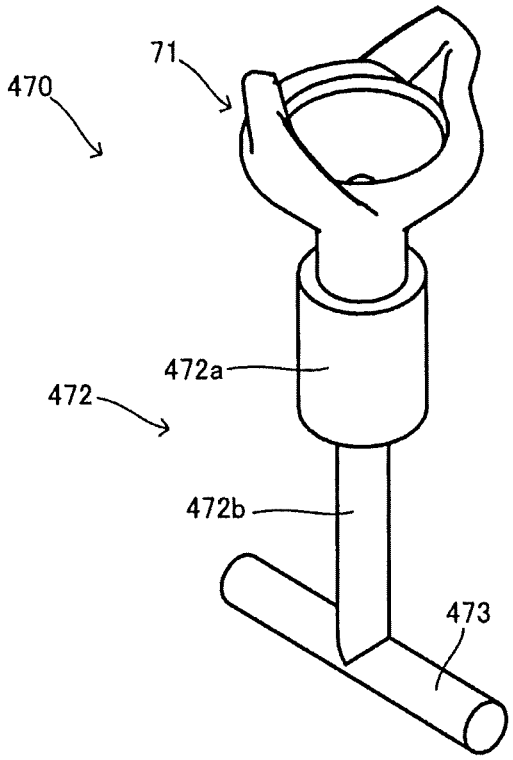
FIG. 38A is a perspective view of a shaft member 470.
Figure 38B:
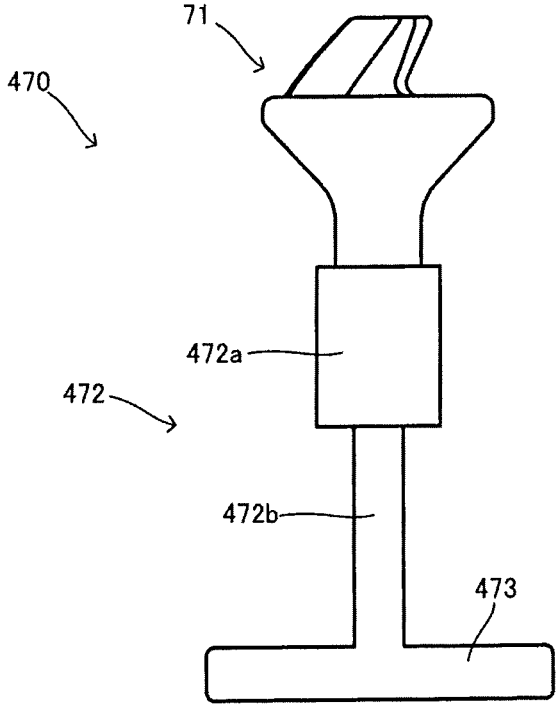
FIG. 38B is a front surface of the shaft member 470.

Next, the shaft member 470 of the end member 440 will be described. FIG. 38A illustrates a perspective view of the shaft member 470, and FIG. 38B illustrates a front view of the shaft member 470. As can be ascertained from the drawings, the shaft member 470 is provided with the coupling member 71, the rotating shaft 472, and the rotating force transmission pin 473 which also serves as the base end portion.

Since the coupling member 71 is the same as that which has been already described, the description thereof will be omitted here.

The rotating shaft 472 is a columnar shaft-like member that functions as a rotating force transmission portion which transmits the rotating force received by the coupling member 71. Therefore, the coupling member 71 is provided at one end of the rotating shaft 472. In the aspect, the rotating shaft 472 is formed as columnar shaft-like members having different thicknesses are linked to each other at one end side, and has the first rotating shaft 472*a* and the second rotating shaft 472*b* smaller than the first rotating shaft 472*a*.

In the end portions of the rotating shaft 472, the coupling member 71 is disposed in the end portion of the first rotating shaft 472*a*, and the rotating force transmission pin 473 is disposed in the end portion of the second rotating shaft 472*b*.

The rotating force transmission pin 473 also functions as a base end portion, and is a rod-like member disposed in the second rotating shaft 472*b* of the end portion of the rotating shaft 472 as described above. The rotating force transmission pin 473 is disposed such that the extending direction in a rod shape is orthogonal to the shaft line of the rotating shaft 472.

A material of the shaft member 470 is not particularly limited, but a resin, such as polyacetal, polycarbonate, or PPS can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

Figure 39A:
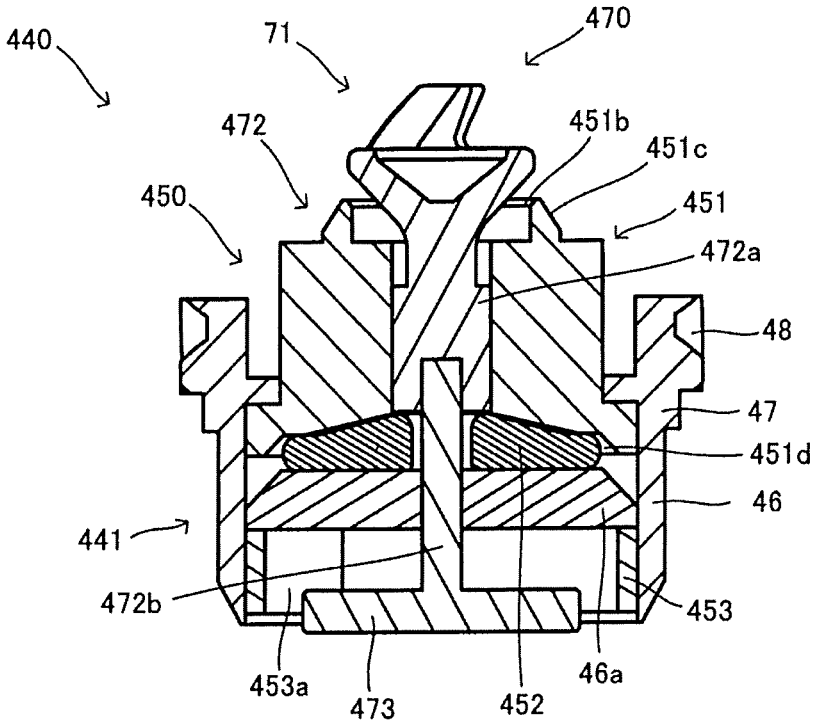
FIG. 39A is a sectional view in the shaft line direction of the end member 440.
Figure 39B:
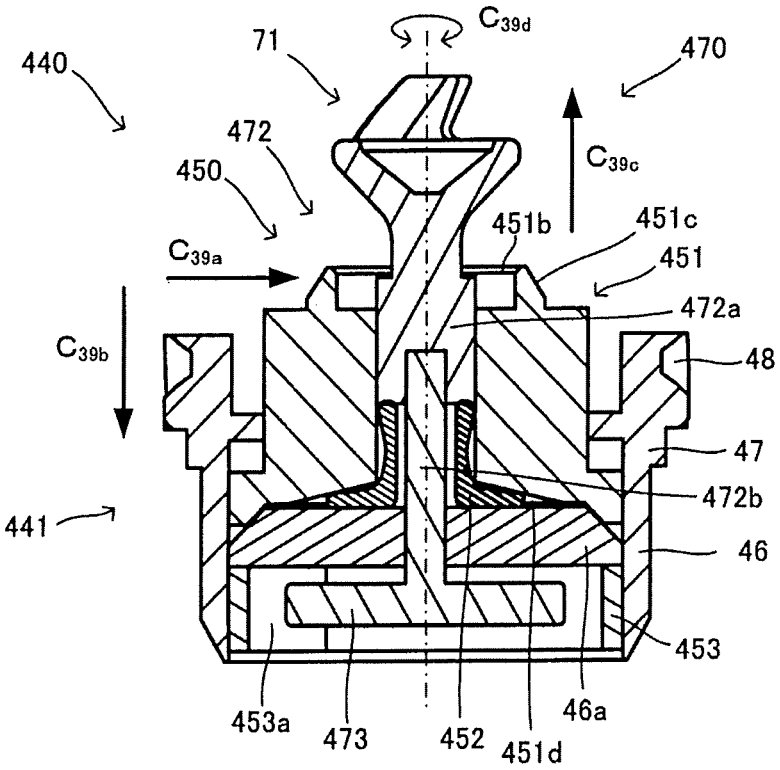
FIG. 39B is a sectional view in the shaft line direction of the end member 440 in another posture.

By combining the bearing member 441 and the shaft member 470 with each other as follows, the end member 440 is made. By describing the combination, the shape, the size, or the positional relationship of the bearing member 441 and the shaft member 470 are further understood. FIG. 39A illustrates a sectional view of the end member 440 along the shaft line direction. In addition, FIG. 39B illustrates one example of the posture in which the shaft member 470 moves in the viewpoint illustrated in FIG. 39A.

As can be ascertained from FIG. 39A, the deforming member 452 is disposed on the side that becomes the inside of the tubular body 46 on the surface of the bottom portion 46*a*. The pressing member 451 is mounted on the side opposite to the bottom portion 46*a* side in the deforming member 452. At this time, a part of the deforming member 452 is configured to enter the inside of the recess portion 451*d* formed in the pressing member 451. In addition, the protruding portion 451*b* of the pressing member 451 is disposed so as to protrude from the bearing member 441.

Furthermore, the pin engaging member 453 is disposed on the side opposite to the side on which the deforming member 452 is disposed on the surface of the bottom portion 46*a*.

Meanwhile, in the shaft member 470, the rotating force transmission pin 473 is disposed on the inside of the pin engaging member 453, the second rotating shaft 472*b* passes through the hole 46*b* provided in the bottom portion 46*a* and the hole 452*a* provided in the deforming member 452, and the first rotating shaft 472*a* passes through the hole 451*a* of the pressing member 451. In addition, the coupling member 71 is positioned so as to protrude from the pressing member 451 and the bearing member 441.

By disposing the shaft member 470 on the inside of the bearing member 441 in this manner, the shaft member 470 can be deformed to a posture illustrated in FIG. 39B from the posture illustrated in FIG. 39A.

When the shaft member 470 is in the posture illustrated in FIG. 39A, the shaft lines of the coupling member 71 of the shaft member 470 and the rotating shaft 472 match each other, and match the shaft line of the bearing member 441, the shaft member 470 is in a posture in which the coupling member 71 protrudes the most from the bearing member 441.

When the inclined surface 451*c* of the pressing member 451 is pressed in a direction orthogonal to the shaft line from the posture illustrated in FIG. 39A as indicated by an arrow $C_{39a}$ in FIG. 39B, the pressing member 451 moves in a direction in which the pressing member 451 enters the inside of the bearing member 441 in the shaft line direction as indicated by arrow $C_{39b}$ due to component force. Accordingly, the deforming member 452 is pressed. The pressed deforming member 452 enters between the second rotating shaft 472*b* and the hole 451*a* provided in the pressing member 451 as a destination after deformation, the deforming member 452 presses the end surface of the first rotating shaft 472*a*, and the shaft member 470 moves in a direction in which the coupling member 71 protrudes from the bearing member 441 in the shaft line direction as indicated by an arrow $C_{39c}$. In this manner, it is possible to move the coupling member 71 in the shaft line direction.

In addition, when receiving the driving force from the apparatus main body 10, the shaft member 470 receives the rotating force around the shaft line as indicated by an arrow $C_{39d}$ in FIG. 39B. At this time, the coupling member 71, the rotating shaft 472, and a rotating force transmission pin 473 rotate, the rotating force transmission pin 473 is hooked to the pin engaging projection 453*a* of the pin engaging member 453, and the pin engaging member 453 rotates. Since the pin engaging member 453 adheres to the tubular body 46, the end member 440 rotates and the rotating force can be transmitted to the photoreceptor drum 35.

According to the end member 440, due to the movement, it is possible to smoothly attach and detach the process cartridge to and the apparatus main body 10 similar to the end member 40.

Figure 40:
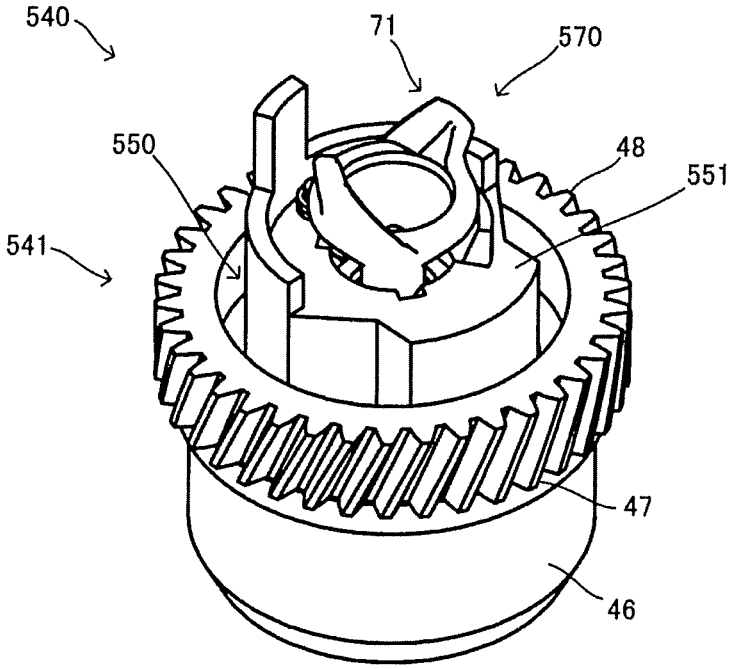
FIG. 40 is a perspective view of an end member 540.
Figure 41:
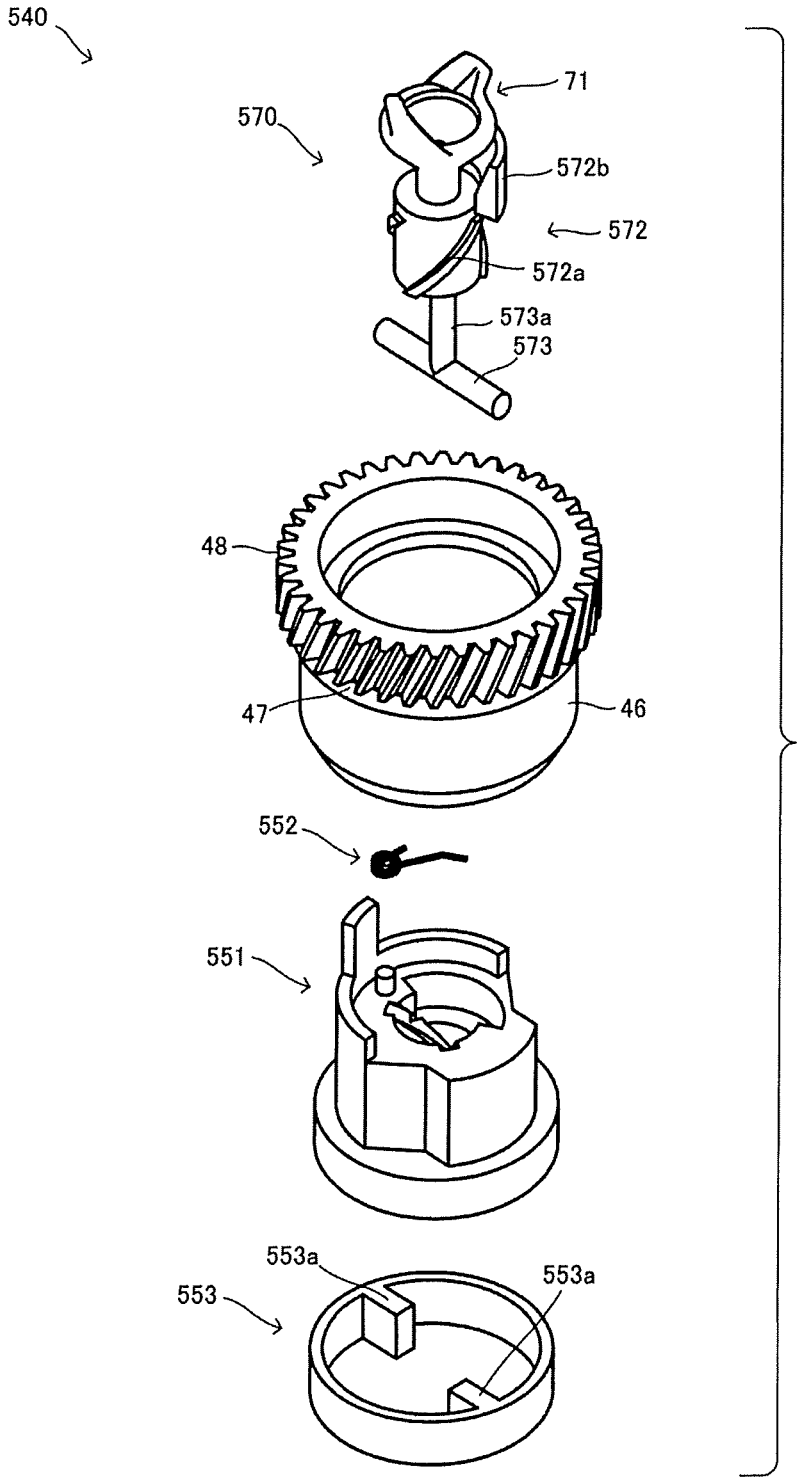
FIG. 41 is an exploded perspective view of the end member 540.

FIGS. 40 and 41 illustrate views for describing a sixth aspect. FIG. 40 is a perspective view of an end member 540, and FIG. 41 is an exploded perspective view of the end member 540. The end member 540 is also a member which is attached to the end portion of the photoreceptor drum 35. The end member 540 is provided with a bearing member 541 and a shaft member 570.

The bearing member 541 is a member fixed to the end portion of the photoreceptor drum 35. In the aspect, the bearing member 541 also includes the tubular body 46, the contact wall 47, and the gear 48. Since these can be employed with the same configuration as that of the bearing member 41 which is already described, the description thereof will be omitted here.

A holding portion 550 is provided on the inside of the tubular body 46 which has a tubular shape. The holding portion 550 is a part which holds one end side (base end portion side) of the shaft member 570 which will be described later on the inside thereof. In addition, the holding portion 550 includes a guide member 551, an elastic member 552, and a pin engaging member 553.

Figure 42A:
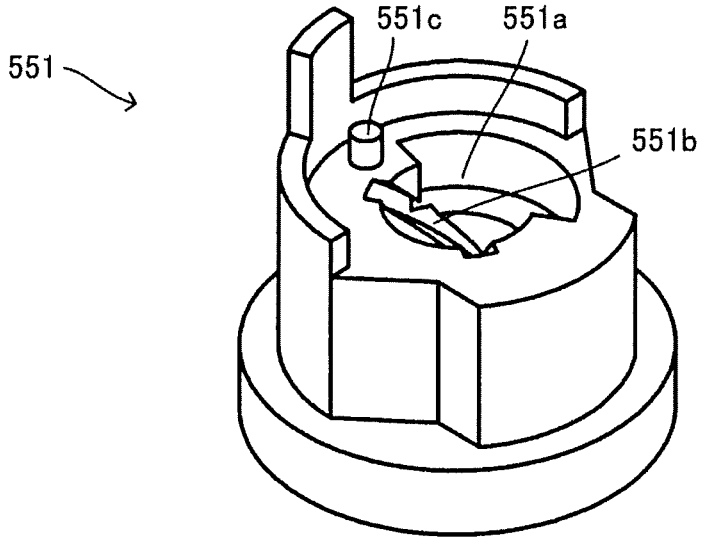
FIG. 42A is a perspective view of a guide member 551.
Figure 42B:
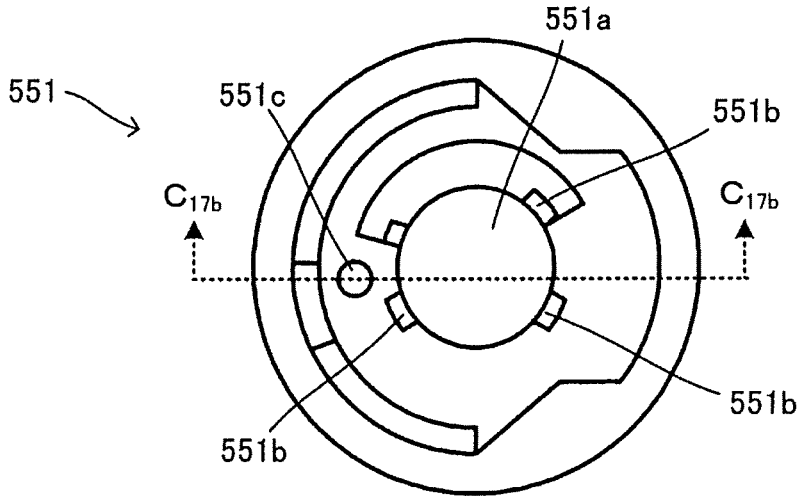
FIG. 42B is a plan view of the guide member 551.
Figure 42C:
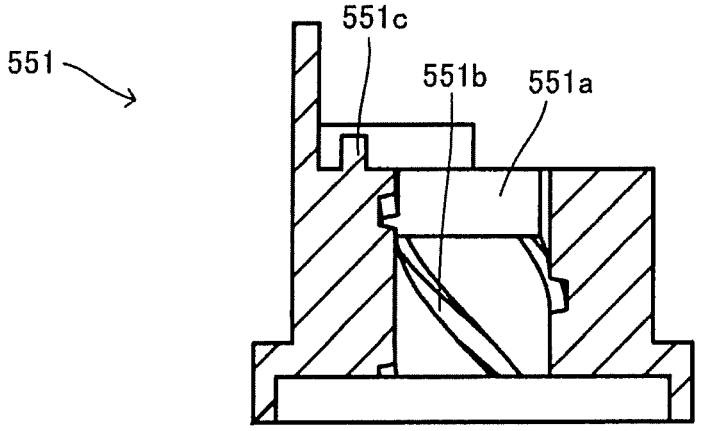
FIG. 42C is a sectional view of the guide member 551.

FIG. 42A illustrates a perspective view of the guide member 551, FIG. 42B illustrates a plan view of the guide member 55, and FIG. 42C illustrates a sectional view along the line indicated by C-C in FIG. 42B.

The guide member 551 is a tubular member which is coaxial to the shaft line of the tubular body 46, and the inner diameter of a tubular inner hole 551*a* is substantially the same as the outer diameter of a rotating shaft 572 of the shaft member 570.

On the inner wall surface of the hole 551*a* of the guide member 551, a helical spiral groove 551*b* which extends in the shaft line direction is formed. Here, a spiral projection 572*a* formed on the outer circumferential surface of the rotating shaft 572 of the shaft member 570 is screwed.

In addition, the guide member 551 is provided with a projection 551*c* for fixing the elastic member 552 to the end surface thereof. In the aspect, since a torsion spring is used as the elastic member 552, the projection 551*c* is inserted and fixed to the annular part of the torsion spring.

The elastic member 552 is a member that applies a predetermined biasing force to the shaft member 570 in the rotational direction around the shaft line of the shaft member 570. In the aspect, a torsion spring is used as the elastic member as described above. However, the present invention is not limited thereto, and a known elastic member can be employed.

The pin engaging member 553 is a member which receives the rotating force from a rotating force transmission pin 573 that also serves as a base end portion of the shaft member 570, and rotates the bearing member 541. As can be ascertained from FIG. 41, the pin engaging member 553 is annular and has a pin engaging projection 553*a* which is a projection to which the rotating force transmission pin 573 is hooked on the inside thereof.

The material which configures the bearing member 541 can be considered similar to the above-described bearing member 41.

Figure 43:
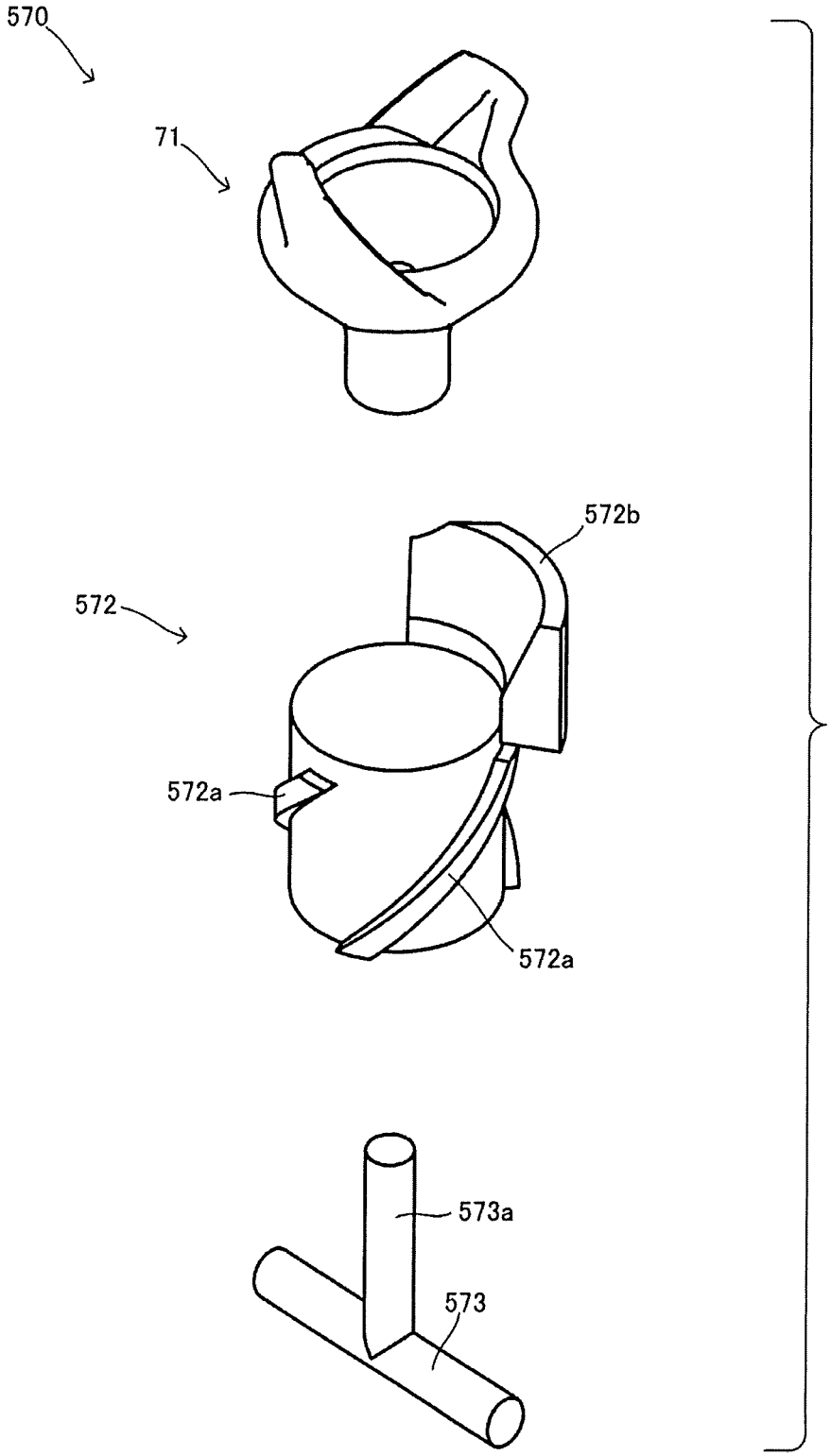
FIG. 43 is an exploded perspective view of a shaft member 570.

Next, the shaft member 570 of the end member 540 will be described. FIG. 43A is an exploded perspective view of the shaft member 570. As can be ascertained from the drawings, the shaft member 570 is provided with the coupling member 71, the rotating shaft 572, and the rotating force transmission pin 573 which also serves as the base end portion. In the aspect, the coupling member 71, the rotating shaft 572, and the rotating force transmission pin 573 are integrally formed, but not being limited thereto, a configuration in which the coupling member 71, the rotating shaft 572, and the rotating force transmission pin 573 are separate bodies and become the shaft member 570 by assembly, may be employed.

Since the coupling member 71 is the same as that which has been already described, the description thereof will be omitted here.

The rotating shaft 572 is a columnar shaft-like member that functions as a rotating force transmission portion which transmits the rotating force received by the coupling member 71. Therefore, the coupling member 71 is provided at one end of the rotating shaft 572.

In addition, the spiral projection 572*a* which is a helical projection that extends in the shaft line direction of the rotating shaft 572, is provided on the outer circumferential surface of the rotating shaft 572. As described above, the spiral projection 572*a* is screwed to the spiral groove 551*b* of the bearing member 541.

Furthermore, a pressing member 572*b* is provided in the end portion on the coupling member 71 on the outer circumferential surface of the rotating shaft 572. The pressing member 572*b* is a projection which protrudes from the rotating shaft 572 in the diameter direction and the shaft line direction of the rotating shaft 572. The pressing member 572*b* of the aspect is a coaxial arc member of the rotating shaft 572.

The rotating force transmission pin 573 also functions as a base end portion and is a rod-like member disposed on the side opposite to the coupling member 71 in the end portion of the rotating shaft 572. The rotating force transmission pin 573 is disposed such that the extending direction in a rod shape is orthogonal to the shaft line of the rotating shaft 572. In the aspect, the rotating force transmission pin 573 is linked to the rotating shaft 572 via a linking rod 573*a* that extends in the shaft line direction.

A material of the shaft member 570 is not particularly limited, but a resin, such as polyacetal, polycarbonate, or PPS can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

Figure 44A:
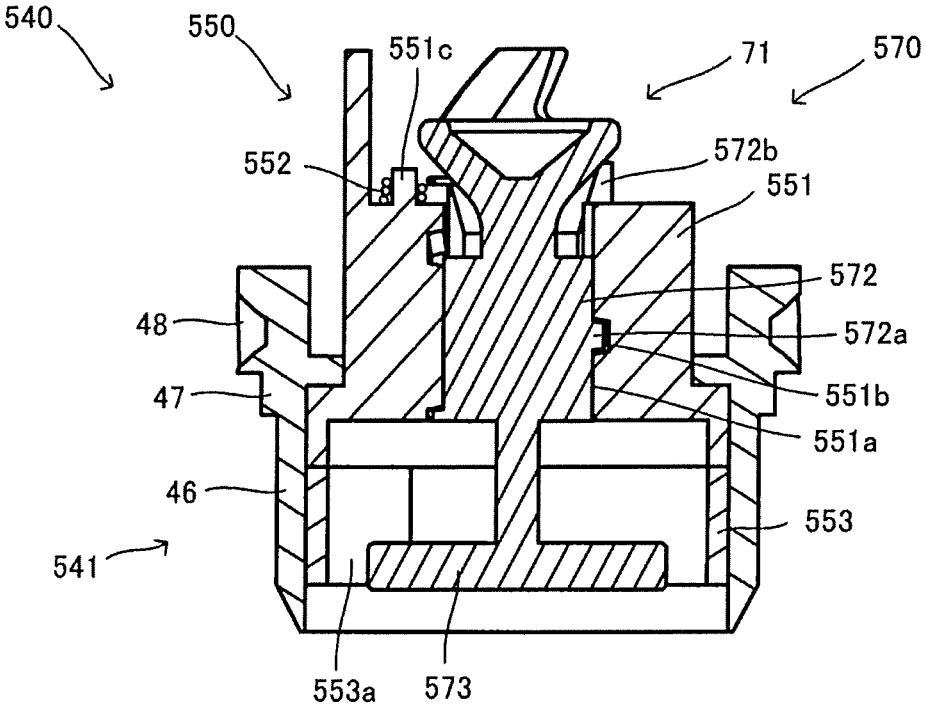
FIG. 44A is a sectional view in the shaft line direction of the end member 540.
Figure 44B:
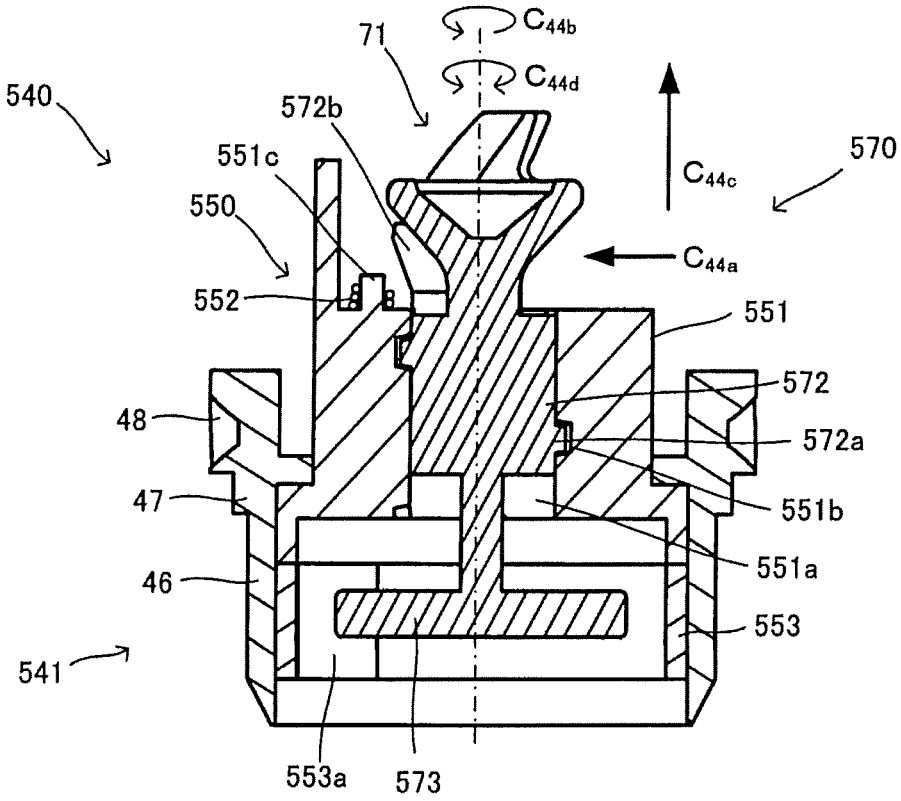
FIG. 44B is a sectional view in the shaft line direction of the end member 540 in another posture.

By combining the bearing member 541 and the shaft member 570 with each other as follows, the end member 540 is made. By describing the combination, the shape, the size, or the positional relationship of the bearing member 541 and the shaft member 570 are further understood. FIG. 44A illustrates a sectional view of the end member 540 along the shaft line direction. In addition, FIG. 44B illustrates one example of the posture in which the shaft member 570 moves in the viewpoint illustrated in FIG. 44A.

As can be ascertained from FIG. 44A, the pin engaging member 553 is disposed on the end portion side in a direction in which the coupling member 71 does not protrude such that the center thereof matches the shaft line of the tubular body 46, and is fixed by an adhesive or the like, on the inside of the tubular body 46. In addition, the guide member 551 is disposed on the surface on the side on which coupling member 71 protrudes, on the surface of the pin engaging member 553. The guide member 551 is rotatably disposed with respect to the tubular body 46.

Meanwhile, in the shaft member 570, the rotating force transmission pin 573 is disposed on the inside of the pin engaging member 553, and the rotating shaft 572 passes through the hole 551*a* of the guide member 551. In addition, the coupling member 71 is positioned so as to protrude from the guide member 551 and the bearing member 541. At this time, the spiral projection 572*a* of the rotating shaft 572 is screwed to the spiral groove 551*b* provided in the hole 551*a* of the guide member 551.

In addition, the elastic member 552 is disposed in the projection 551*c* of the guide member 551, one end of the elastic member 552 is brought into contact with the pressing member 572*b* of the rotating shaft 572, and a biasing force is applied in a direction of rotating with respect to the shaft member 570.

By disposing the shaft member 570 on the inside of the bearing member 541 in this manner, the shaft member 570 can be deformed to a posture illustrated in FIG. 44B from the posture illustrated in FIG. 44A.

When the shaft member 570 is in the posture illustrated in FIG. 44A, the shaft lines of the coupling member 71 of the shaft member 570 and the rotating shaft 72 match each other, and match the shaft line of the bearing member 541, the shaft member 570 is in a posture in which the coupling member 71 protrudes the most from the bearing member 541.

When the pressing member 572*b* of the rotating shaft 572 is pressed in the direction orthogonal to the shaft line from the posture illustrated in FIG. 44A as indicated by an arrow $C_{44a}$ in FIG. 44B, the shaft member 570 rotates around the shaft line against the biasing force of the elastic member 552, as indicated by an arrow $C_{44b}$. Then, from the relationship between the spiral projection 572*a* of the screwed rotating shaft 572 and the spiral groove 551*b* provided in the hole 551*a* of the guide member 551, the shaft member 570 moves in the direction in which the coupling member 71 protrudes from the bearing member 541 in the shaft line direction as indicated by an arrow $C_{44б}$ in FIG. 44B. In this manner, it is possible to move the coupling member 71 in the shaft line direction.

In addition, when receiving the driving force from the apparatus main body 10, the shaft member 570 receives the rotating force around the shaft line as indicated by an arrow $C_{44d}$ in FIG. 44B. At this time, the coupling member 71, the rotating shaft 572, the guide member 551, and the rotating force transmission pin 573 rotate, the rotating force transmission pin 573 is hooked to the pin engaging projection 553*a* of the pin engaging member 553, and the pin engaging member 553 rotates. Since the pin engaging member 553 adheres to the tubular body 46, the end member 540 rotates and the rotating force can be transmitted to the photoreceptor drum 35.

According to the end member 540, due to the movement, it is possible to smoothly attach and detach the process cartridge to and the apparatus main body 10 similar to the end member 40.

Figure 45:
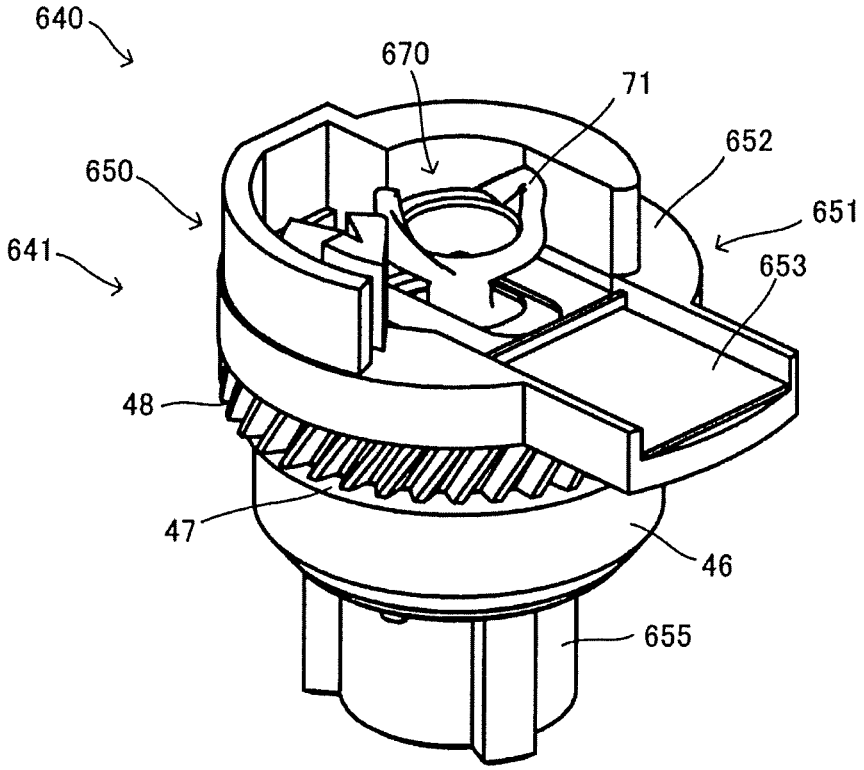
FIG. 45 is a perspective view of an end member 640.
Figure 46:
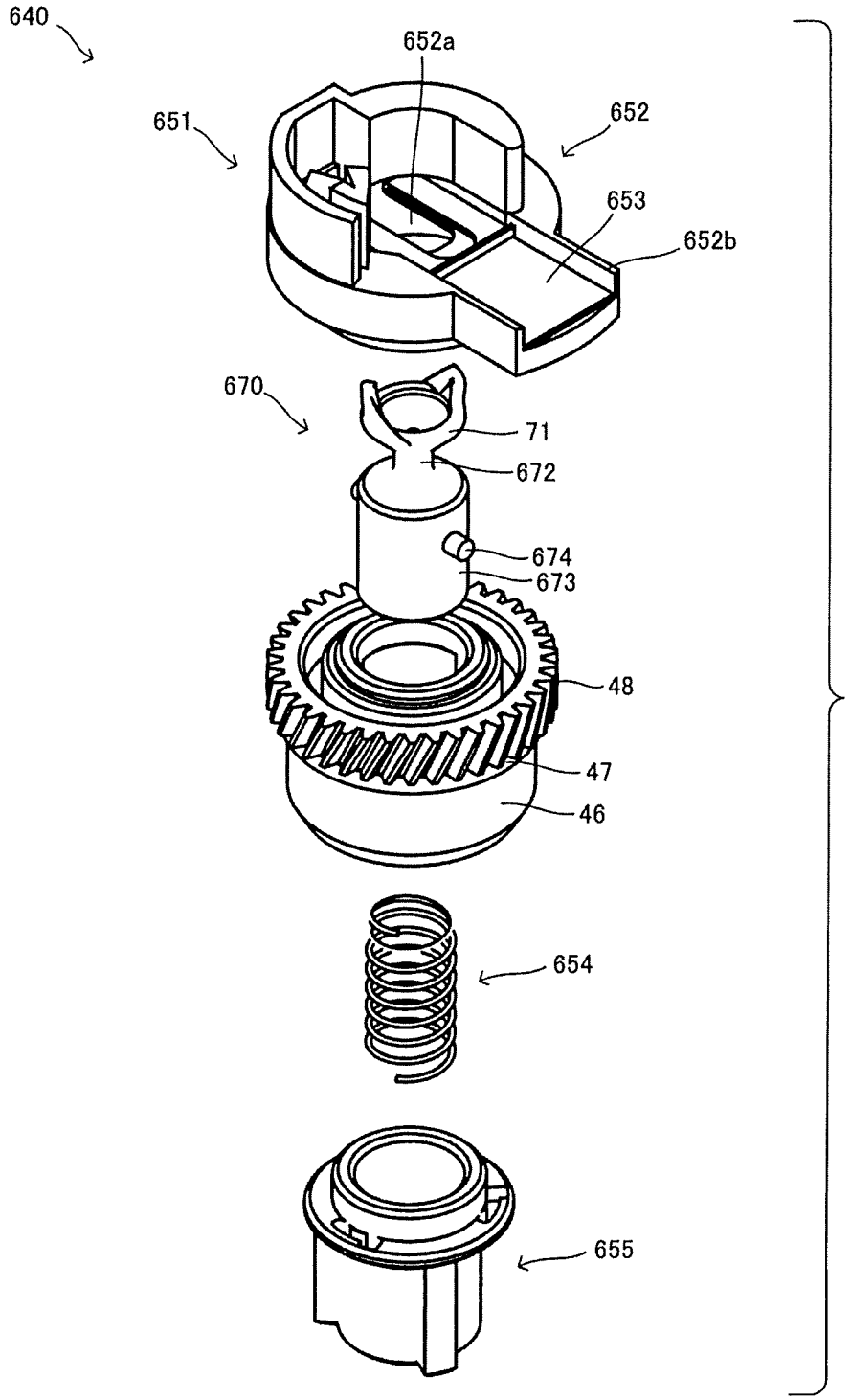
FIG. 46 is an exploded perspective view of the end member 640.
Figure 47:
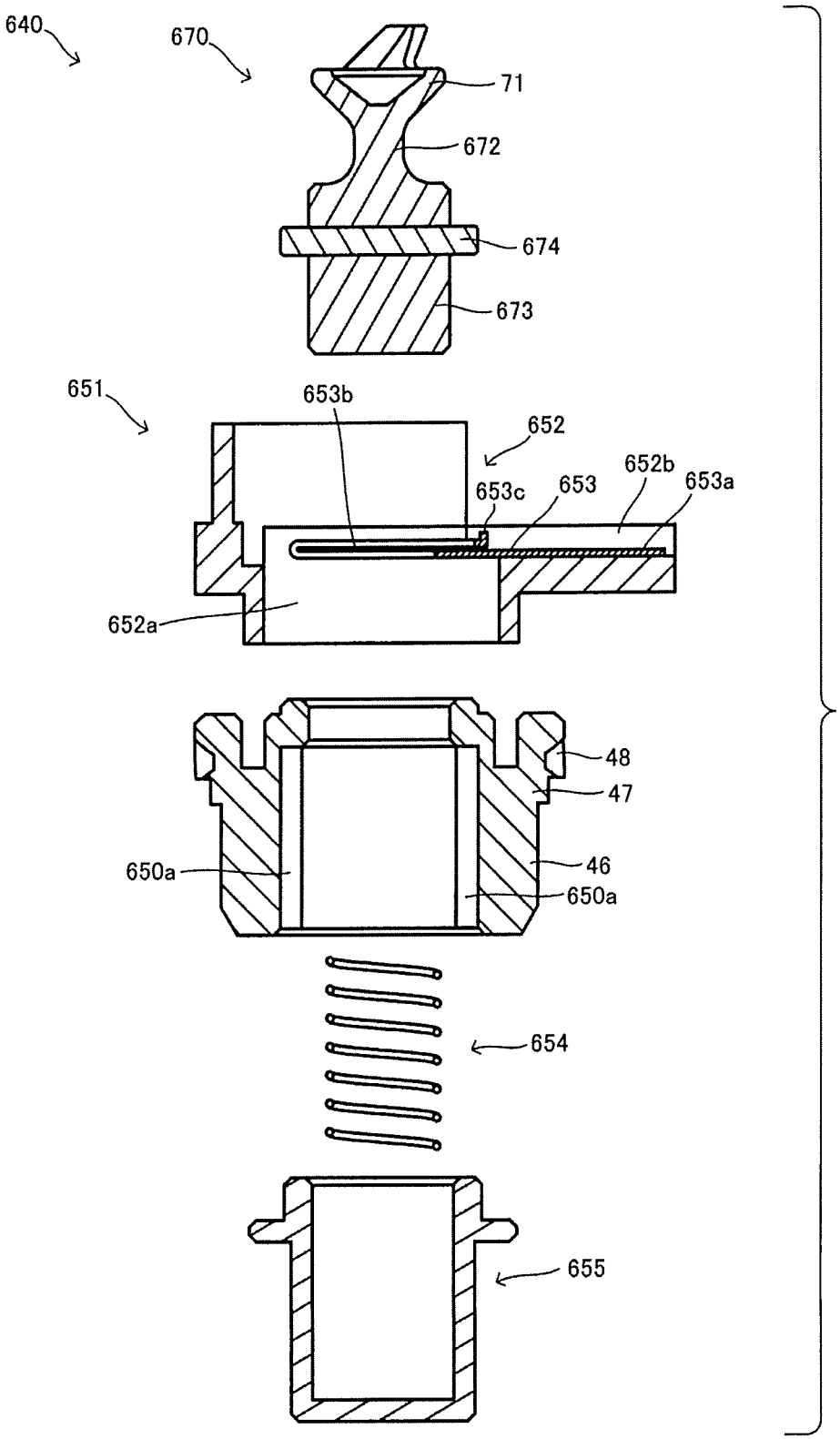
FIG. 47 is an exploded sectional view of the end member 640.

FIGS. 45 and 47 illustrate views for describing a seventh aspect. FIG. 45 is a perspective view of an end member 640, FIG. 46 is an exploded perspective view of the end member 640, and FIG. 47 is an exploded sectional view of the end member 640. The end member 640 is also a member which is attached to the end portion of the photoreceptor drum 35. The end member 640 is provided with a bearing member 641 and a shaft member 670.

The bearing member 641 is a member fixed to the end portion of the photoreceptor drum 35. In the aspect, the bearing member 641 also includes the tubular body 46, the contact wall 47, and the gear 48. Since these can be employed with the same configuration as that of the bearing member 41 which is already described, the description thereof will be omitted here.

A holding portion 650 is provided on the inside of the tubular body 46 which has a tubular shape. The holding portion 650 is a part which holds one end side (base end portion side) of the shaft member 670 which will be described later on the inside thereof. In addition, the holding portion 650 includes a groove 650*a*, a shaft member moving member 651, an elastic member 654, and an elastic member accommodation member 655.

The groove 650*a* is a groove formed on the inner wall surface of the tubular body 46 and is configured to extend parallel to the shaft line direction. An end portion of a rotating force transmission pin 674 is inserted into the groove 650*a* and is movable in the shaft line direction. Therefore, in the aspect, two grooves 650*a* are provided so as to oppose each other across the shaft line.

Figure 48:
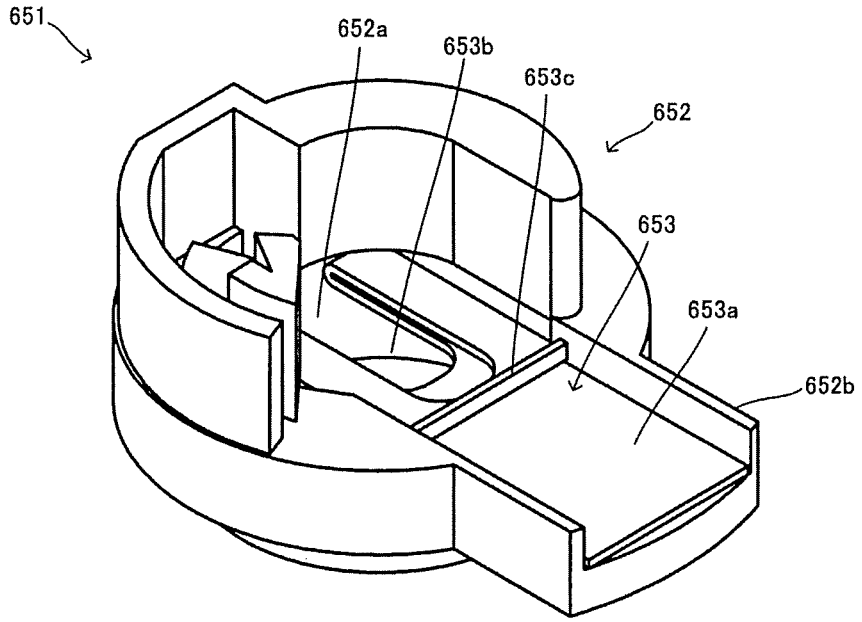
FIG. 48 is a perspective view of a shaft member moving member 651.

FIG. 48 illustrates a perspective view of the shaft member moving member 651. The shaft member moving member 651 is a member for controlling the movement of the shaft member 670 in the shaft line direction, and is configured to include a support member 652 and an elastic member 653.

The support member 652 is a tubular member that supports the elastic member 653 at a predetermined position.

Therefore, the support member 652 has a hole 652*a* on the inside thereof, and has a groove-like support portion 652*b* which extends in a radial direction of the tubular shape of the support member 652.

Figure 49A:
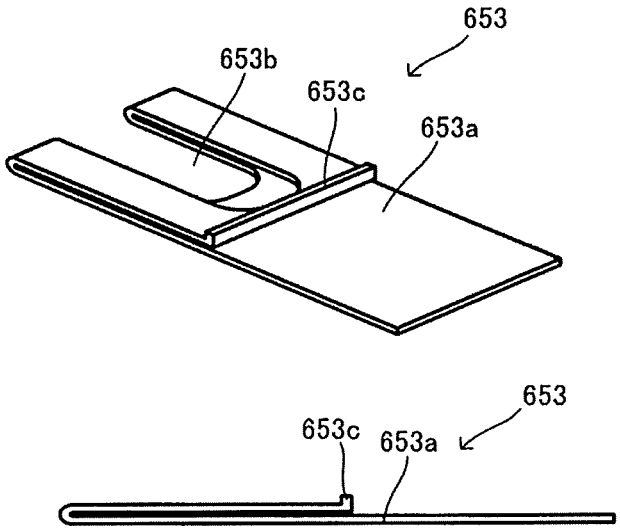
FIG. 49A is a perspective view and a side view of an elastic member 653.
Figure 49B:
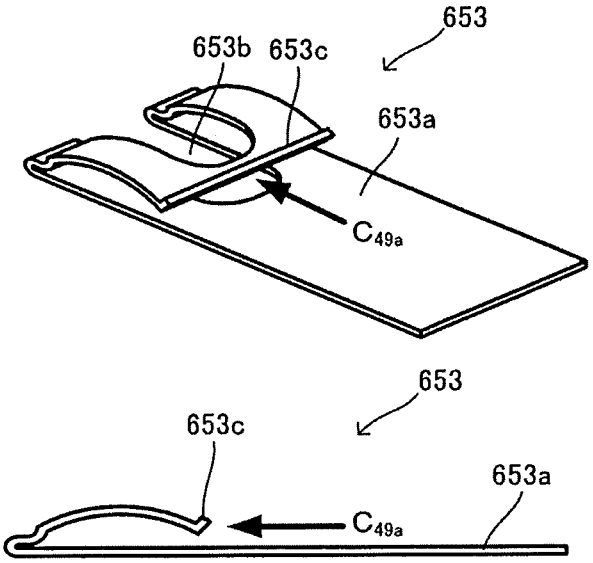
FIG. 49B is a perspective view and a side view of the elastic member 653 when being deformed.

The elastic member 653 is a member configured of a plate spring. FIG. 49A illustrates a perspective view and a side view of the elastic member 653. In addition, FIG. 49B illustrates a perspective view and a side view of the elastic member 653 in a posture deformed by an external force.

The elastic member 653 has a plate spring main body 653*a*. The plate spring main body 653*a* has a shape in which one plate-shaped member is folded back and overlapped. In addition, a slit 653*b* which extends in the folding direction is provided in the folded end portion of the plate spring main body 653*a*. The slit 653*b* is formed to have a width by which a rotating shaft 672 of the shaft member 670 can pass and the coupling member 71 and a base end portion 673 cannot pass therethrough.

In addition, at one end portion folded back, a pressing projection 653*c* which is a projection provided in a direction of protruding from the plate surface is provided. As can be ascertained from FIG. 49B, by applying the external force in a direction along the plate surface to the pressing projection 653*c* as indicated by an arrow $C_{49a}$, the folded part is elastically deformed to swell.

The elastic member 653 is disposed on the groove-like support portion 652*b* of the support member 652. At this time, the folded portion of the elastic member 653 is disposed so as to block a part of the hole 652*a* of the support member 652. In addition, the pressing projection 653*c* is disposed to face the side opposite to the hole 652*a*.

The elastic member 654 is a member for preventing the shaft member 670 from retracting to the bearing member 641 side more than necessary, and in the aspect, a coiled spring is employed. The spring may not be necessarily a coiled spring, but a sponge or rubber may be employed.

However, the elastic member 654 may not be necessarily provided, and an aspect in which a simple bottom surface is provided from the viewpoint of preventing the shaft member 670 from retracting to the bearing member 641 side more than necessary, may be employed.

The elastic member accommodating member 655 is a tubular member having a bottom on one side for accommodating the above-mentioned elastic member 654.

The material which configures the bearing member 541 can be considered similar to the above-described bearing member 41.

Next, the shaft member 670 of the end member 640 will be described. As can be ascertained from FIGS. 46 and 47, the shaft member 670 is provided with the coupling member 71, the rotating shaft 672, the base end portion 673, and the rotating force transmission pin 674.

Since the coupling member 71 is the same as that which has been already described, the description thereof will be omitted here.

The rotating shaft 672 is a columnar shaft-like member that functions as a rotating force transmission portion which transmits the rotating force received by the coupling member 71. Therefore, the coupling member 71 is provided at one end of the rotating shaft 672.

The base end portion 673 is disposed on the side opposite to the coupling member 71 in the end portion of the rotating shaft 672, and is a columnar member provided coaxially to the rotating shaft 672. In the aspect, the base end portion 673 is formed to be thicker than the rotating shaft 672.

The rotating force transmission pin 674 is a rod-like member disposed in the base end portion 673. The rotating force transmission pin 574 is disposed such that the direction of extending in a rod shape is orthogonal to the shaft line of the rotating shaft 672 and the base end portion 673, and both end portions thereof protrude from the base end portion 673.

A material of the shaft member 670 is not particularly limited, but a resin, such as polyacetal, polycarbonate, or PPS can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

Figure 50A:
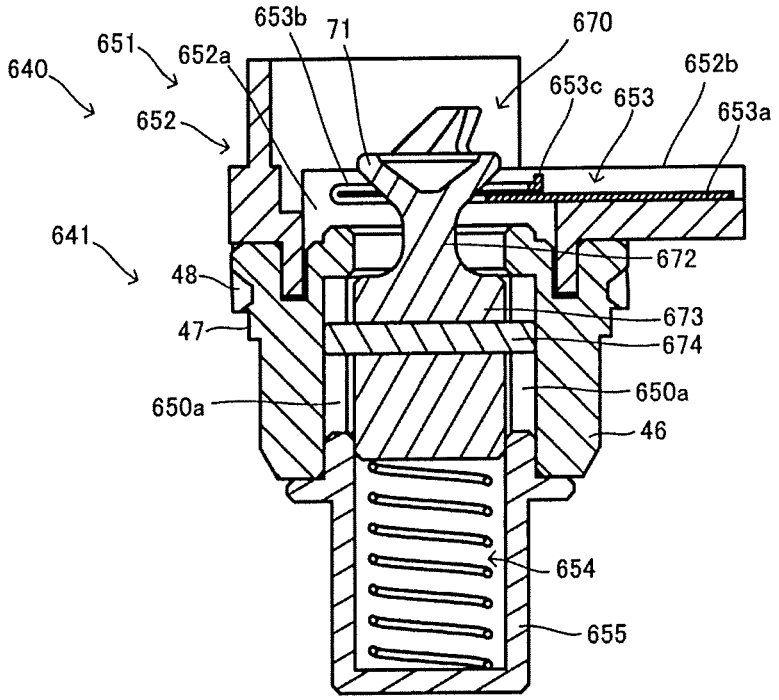
FIG. 50A is a sectional view in the shaft line direction of the end member 640.
Figure 50B:
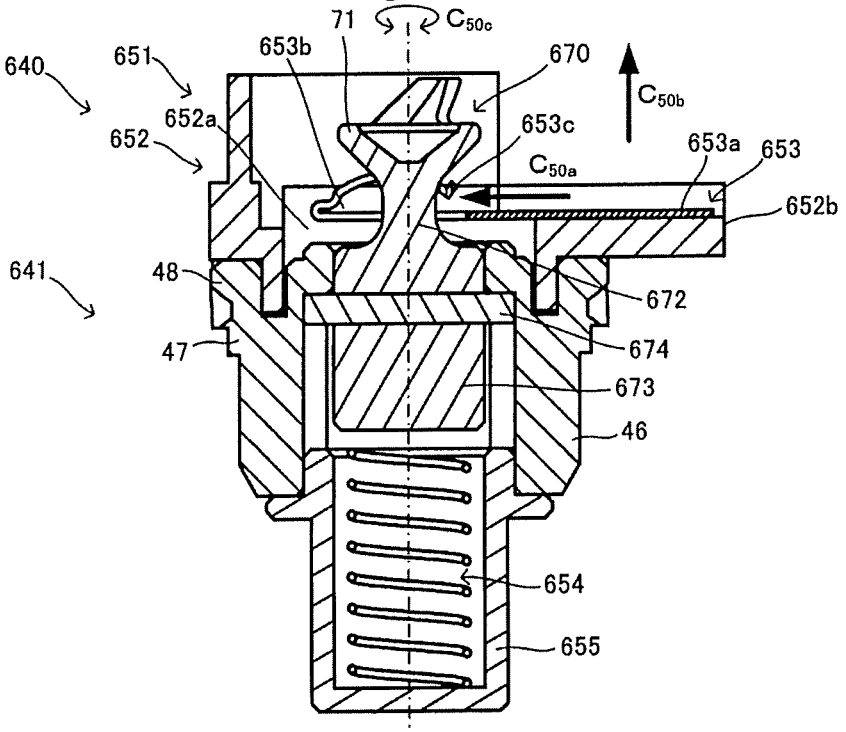
FIG. 50B is a sectional view in the shaft line direction of the end member 640 in another posture.

By combining the bearing member 641 and the shaft member 670 with each other as follows, the end member 640 is made. By describing the combination, the shape, the size, or the positional relationship of the bearing member 641 and the shaft member 670 are further understood. FIG. 50A illustrates a sectional view of the end member 640 along the shaft line direction. In addition, FIG. 50B illustrates one example of the posture in which the shaft member 670 moves in the viewpoint illustrated in FIG. 50A.

As can be ascertained from FIG. 50A, the elastic member accommodation member 655 is disposed in the end portion in the direction in which the coupling member 71 does not protrude, on the inside of the tubular body 46. At this time, the end portion on a side on which the elastic member accommodation member 655 is open, is oriented toward the inside of the tubular body 46.

The elastic member 654 is disposed on the inside of the elastic member accommodation member 655.

Meanwhile, the shaft member moving member 651 is disposed on a side opposite to a side on which the elastic member accommodation member 655 is disposed in tubular body 46. At this time, the inner hole of the tubular body 46 and the hole 652*a* of the support member 652 of the shaft member moving member 651 are disposed so as to overlap each other in the shaft line direction.

In the shaft member 670, the base end portion 673 and the rotating force transmission pin 674 are disposed on the inside of the tubular body 46. At this time, both ends of the rotating force transmission pin 674 are respectively disposed so as to be inserted into the groove 650*a* provided on the inner wall surface of the tubular body 46.

The rotating shaft 672 passes through the hole 652*a* formed in the support member 652 of the shaft member moving member 651 and the slit 653*b* formed in the elastic member 653. In addition, the coupling member 71 is positioned so as to protrude from the elastic member 653 and the bearing member 641.

By disposing the shaft member 670 on the inside of the bearing member 641 in this manner, the shaft member 670 can be deformed to a posture illustrated in FIG. 50B from the posture illustrated in FIG. 50A.

When the shaft member 670 is in the posture illustrated in FIG. 50A, the shaft lines of the coupling member 71 of the shaft member 670, the rotating shaft 672, and the base end portion 673 match each other, and match the shaft line of the bearing member 641, the shaft member 670 is in a posture in which the coupling member 71 protrudes the most from the bearing member 641.

When the pressing projection 653*c* of the elastic member 653 is pressed in a direction orthogonal to the shaft line direction as indicated by an arrow $C_{50a}$ in FIG. 50B from the posture illustrated in FIG. 50A, as illustrated in FIG. 50B, the folded part of the elastic member 653 is deformed to swell, and as indicated by an arrow $C_{50b}$ in FIG. 50B, the shaft member 670 moves in a direction in which the coupling member 71 protrudes from the bearing member 641 in the shaft line direction. In this manner, it is possible to move the coupling member 71 in the shaft line direction.

In addition, when receiving the driving force from the apparatus main body 10, the shaft member 670 receives the rotating force around the shaft line as indicated by an arrow $C_{50c}$ in FIG. 50B. At this time, the coupling member 71, the rotating shaft 672, the base end portion 673, and the rotating force transmission pin 674 rotate, the rotating force transmission pin 674 is hooked to the groove 650*a* provided in the tubular body 46, and the tubular body 46 rotates. Accordingly, the end member 640 rotates and the rotating force can be transmitted to the photoreceptor drum 35.

According to the end member 640, due to the movement, it is possible to smoothly attach and detach the process cartridge to and the apparatus main body 10 similar to the end member 40.

Figure 51:
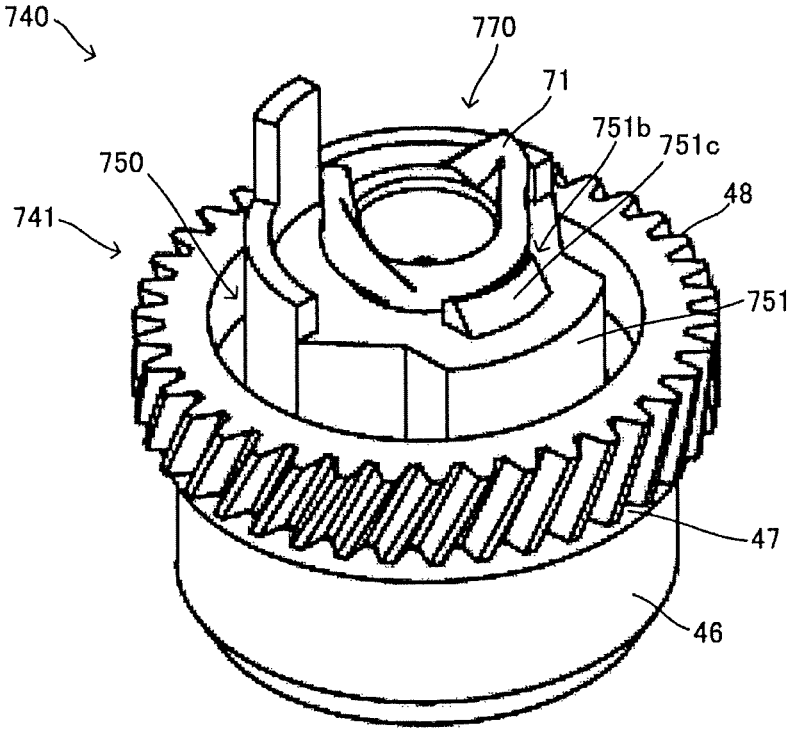
FIG. 51 is a perspective view of an end member 740.
Figure 52:
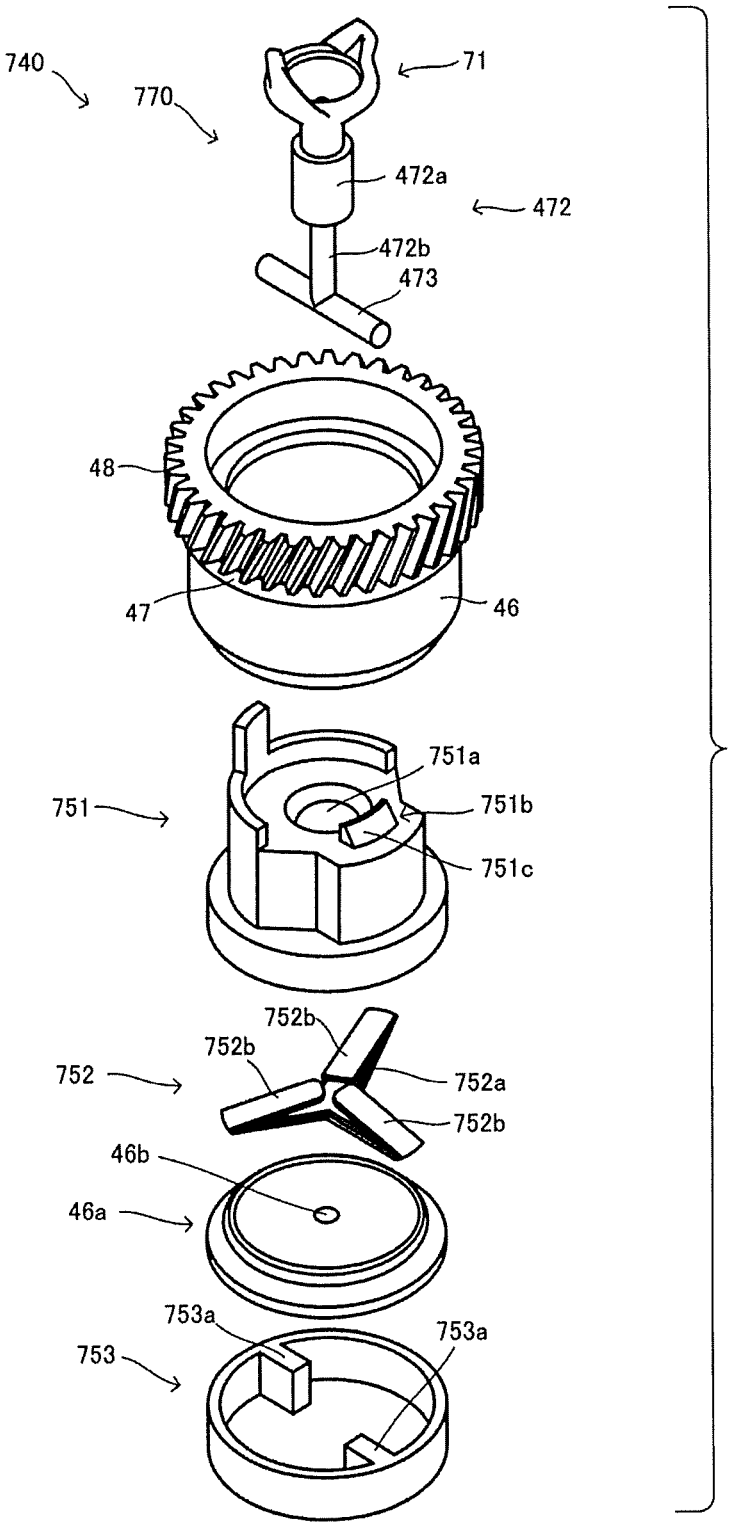
FIG. 52 is an exploded perspective view of the end member 740.

FIGS. 51 and 52 illustrate views for describing an eighth aspect. FIG. 51 is a perspective view of an end member 740, and FIG. 52 is an exploded perspective view of the end member 740. The end member 740 is also a member which is attached to the end portion of the photoreceptor drum 35. The end member 740 is provided with a bearing member 741 and a shaft member 770.

The bearing member 741 is a member fixed to the end portion of the photoreceptor drum 35. In the aspect, the bearing member 741 also includes the tubular body 46, the contact wall 47, and the gear 48. Since these can be employed with the same configuration as that of the bearing member 41 which is already described, the description thereof will be omitted here. In addition, in the aspect, in the tubular body 46, the bottom portion 46*a* is also provided on the side opposite to the side on which the coupling member 71 of the shaft member 770 is disposed to protrude, and at least a part thereof is blocked. In addition, in the aspect, a hole 46*b* through which the second rotating shaft 472*b* of the shaft member 770 passes is provided at a position that becomes the center in the bottom portion 46*a*.

A holding portion 750 is provided on the inside of the tubular body 46 which has a tubular shape. The holding portion 750 is a part which holds one end side (base end portion side) of the shaft member 770 which will be described later on the inside thereof. In addition, the holding portion 750 includes a pressing member 751, an elastic member 752, and a pin engaging member 753.

Figure 53A:
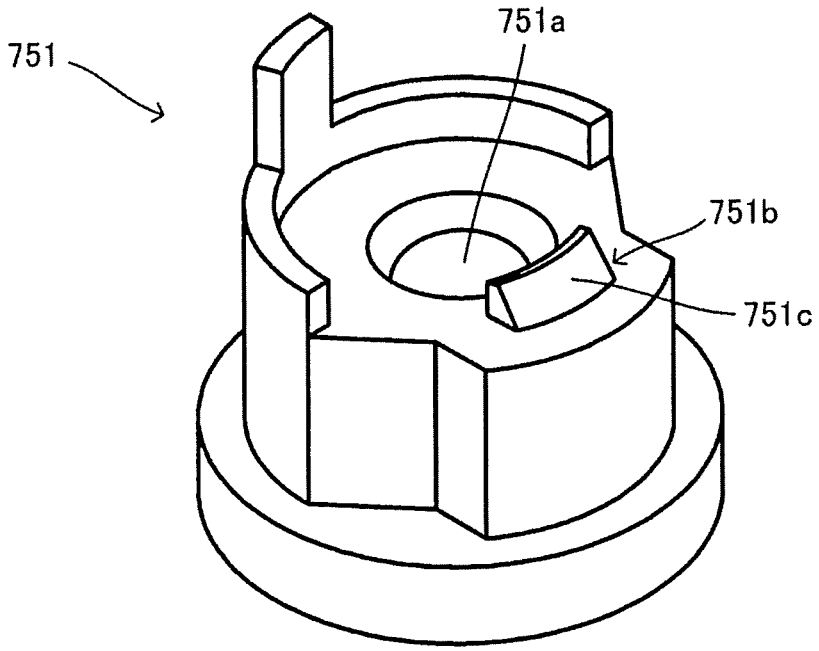
FIG. 53A is a perspective view of a pressing member 751.
Figure 53B:
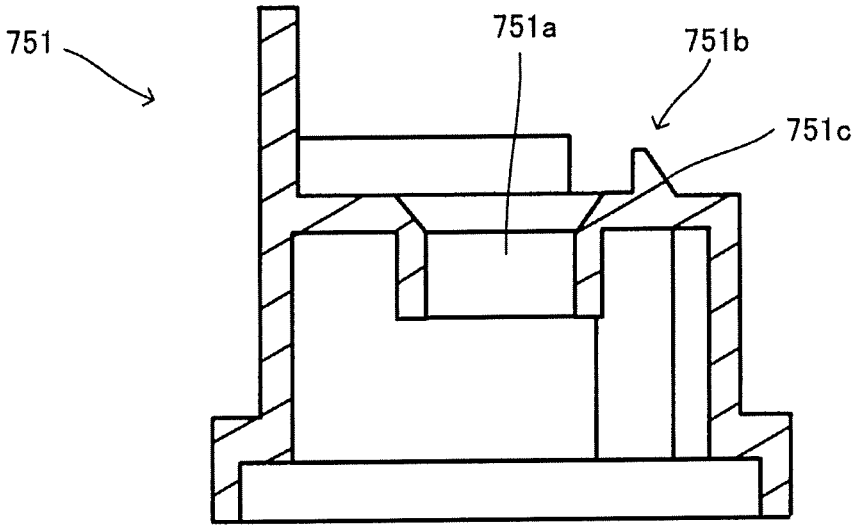
FIG. 53B is a sectional view of the pressing member 751.

FIG. 53A illustrates a perspective view of the pressing member 751, and FIG. 53B illustrates a sectional view of the pressing member 751 along the shaft line direction.

The pressing member 751 is a tubular member that is coaxial to the shaft line of the tubular body 46. One end side of the tubular shape is narrowed in inner diameter and is formed as a hole 751*a*. The inner diameter of the hole 751*a* has a size by which the first rotating shaft 472*a* formed to be thick in the rotating shaft 472 of the shaft member 770 can pass therethrough. In addition, an end portion on the side opposite to the side on which the hole 751*a* is formed is open, in the pressing member 751.

Furthermore, on the end surface on the side on which the hole 751*a* is formed, a projection 751*b* is provided so as to protrude in the shaft line direction, and an inclined surface 751*c* is formed on the side surface (the surface opposite to the surface that opposes the shaft line). The inclined surface 751*c* moves the pressing member 751 in the shaft line direction as will be described later.

The elastic member 752 is an elastic member which receives the pressing force from the pressing member 751 and moves the shaft member 770 in the shaft line direction.

Figure 54:
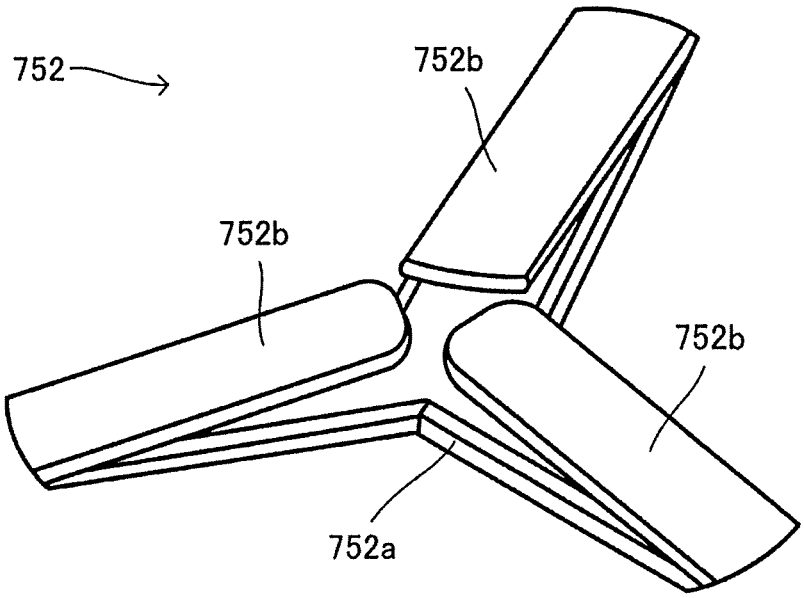
FIG. 54 is a perspective view of an elastic member 752.

FIG. 54 illustrates a perspective view of the elastic member 752 of the aspect. The elastic member 752 has a frame body 752*a* having an aspect in which three rectangular frames disposed at intervals of 120 degrees around the center are linked to each other by one end. Since the frame body 752*a* has a frame shape, the inside thereof is hollow.

In each of the three rectangular frame bodies 752*a*, a plate spring 752*b* having one end fixed to the frame which is separated the most from the center thereof is disposed. The plate spring 752*b* is configured such that the other end extends from one end fixed to the frame body 752*a* to the center of the elastic member 752. At this time, the plate spring 752*b* is inclined so as to be separated from the frame body 752*a* toward the center.

The pin engaging member 753 is a member which receives the rotating force from the rotating force transmission pin 473 that also serves as a base end portion of the shaft member 770, and rotates the bearing member 741. As can be ascertained from FIG. 52, the pin engaging member 753 is annular and has a pin engaging projection 753*a* which is a projection to which the tip end of the rotating force transmission pin 473 is hooked on the inside thereof.

The material which configures the bearing member 741 can be considered similar to the above-described bearing member 41.

Next, the shaft member 770 of the end member 740 will be described. The shaft member 770 is similar to the above-described shaft member 470 (refer to FIGS. 38A and 38B), and each of the configuration elements is given the same reference numerals as those of the shaft member 470, and the description thereof will be omitted.

Figure 55A:
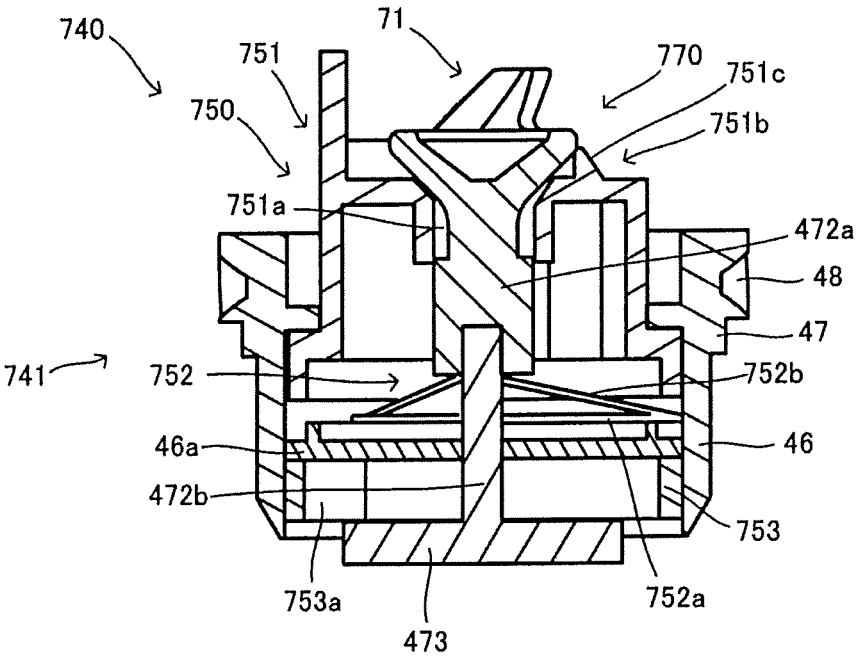
FIG. 55A is a sectional view in the shaft line direction of the end member 740.
Figure 55B:
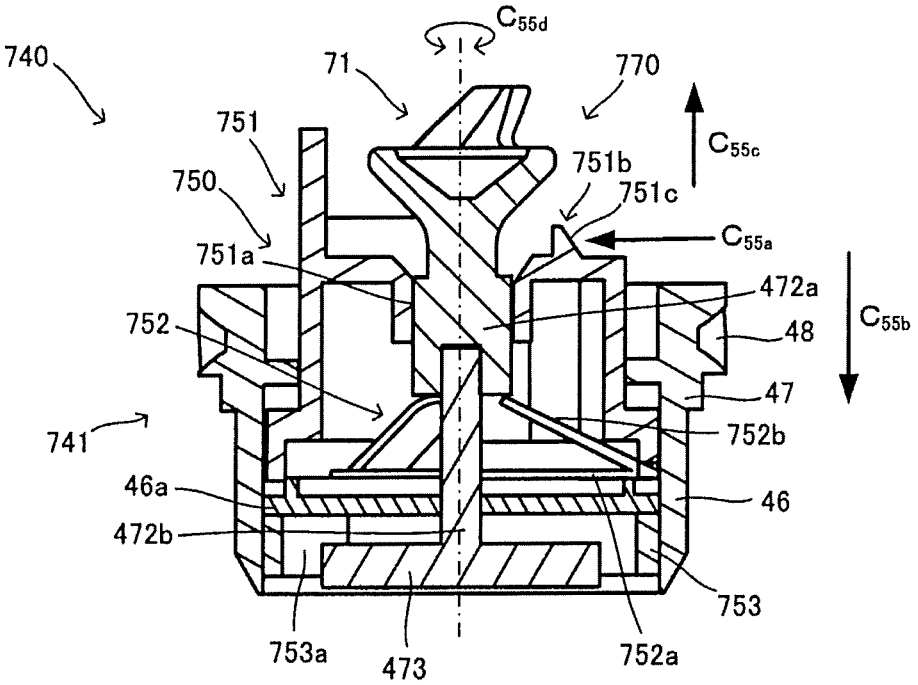
FIG. 55B is a sectional view in the shaft line direction of the end member 740 in another posture.

By combining the bearing member 741 and the shaft member 770 with each other as follows, the end member 740 is made. By describing the combination, the shape, the size, or the positional relationship of the bearing member 741 and the shaft member 770 are further understood. FIG. 55A illustrates a sectional view of the end member 740 along the shaft line direction. In addition, FIG. 55B illustrates one example of the posture in which the shaft member 770 moves in the viewpoint illustrated in FIG. 55A.

As can be ascertained from FIG. 55A, the elastic member 752 is disposed on a side that becomes the inside of the tubular body 46 on the surface of the bottom portion 46*a*. The elastic member 752 places the frame body 752*a* on the surface of the bottom portion 46*a* and the plate spring 752*b* is positioned so as to be separated from the bottom portion 46*a* as advancing the center. In addition, the pressing member 751 is mounted on the side opposite to the bottom portion 46*a* side in the elastic member 752. At this time, a part of the plate spring 752*b* of the elastic member 752 is configured to enter the inside of the pressing member 751. In addition, the projection 751*b* of the pressing member 751 is disposed so as to protrude from the bearing member 741.

Furthermore, the pin engaging member 453 is disposed on the side opposite to the side on which the elastic member 752 is disposed on the surface of the bottom portion 46*a*.

Meanwhile, in the shaft member 770, the rotating force transmission pin 473 is disposed on the inside of the pin engaging member 753, the second rotating shaft 472*b* passes through the hole 46*b* provided in the bottom portion 46*a*, the inside of the frame body 752*a* of the elastic member 752, and between the plate springs 752*b*, and the first rotating shaft 472*a* passes through the hole 751*a* of the pressing member 751. In addition, the coupling member 71 is positioned so as to protrude from the pressing member 751 and the bearing member 741.

By disposing the shaft member 770 on the inside of the bearing member 741 in this manner, the shaft member 770 can be deformed to a posture illustrated in FIG. 55B from the posture illustrated in FIG. 55A.

When the shaft member 770 is in the posture illustrated in FIG. 55A, the shaft lines of the coupling member 71 of the shaft member 770 and the rotating shaft 472 match each other, and match the shaft line of the bearing member 741, the coupling member 71 is in a posture of being the closest the bearing member 741.

When the inclined surface 751*c* of the pressing member 751 is pressed in a direction orthogonal to the shaft line from the posture illustrated in FIG. 55A as indicated by an arrow $C_{55a}$ in FIG. 55B, the pressing member 751 moves in a direction in which the pressing member 751 enters the inside of the bearing member 741 in the shaft line direction as indicated by an arrow $C_{55b}$ due to component force. Accordingly, the end surface of the pressing member 751 presses the side linked to the frame body 752*a*, in the plate spring 752*b* of the elastic member 752. In the elastic member 752 pressed in this manner, the end portion on a side linked to the frame body 752*a* of the plate spring 752*b* presses the end surface of the first rotating shaft 472*a*, and the shaft member 770 moves in the direction in which the coupling member 71 protrudes from the bearing member 741 in the shaft line direction as indicated by an arrow $C_{55c}$. In this manner, it is possible to move the coupling member 71 in the shaft line direction.

In addition, when receiving the driving force from the apparatus main body 10, the shaft member 770 receives the rotating force around the shaft line as indicated by an arrow $C_{55d}$ in FIG. 55B. At this time, the coupling member 71, the rotating shaft 472, and a rotating force transmission pin 473 rotate, the rotating force transmission pin 473 is hooked to the pin engaging projection 753*a* of the pin engaging member 753, and the pin engaging member 753 rotates. Since the pin engaging member 753 adheres to the tubular body 46, the end member 740 rotates and the rotating force can be transmitted to the photoreceptor drum 35.

According to the end member 740, due to the movement, it is possible to smoothly attach and detach the process cartridge to and the apparatus main body 10 similar to the end member 40.

Figure 56:
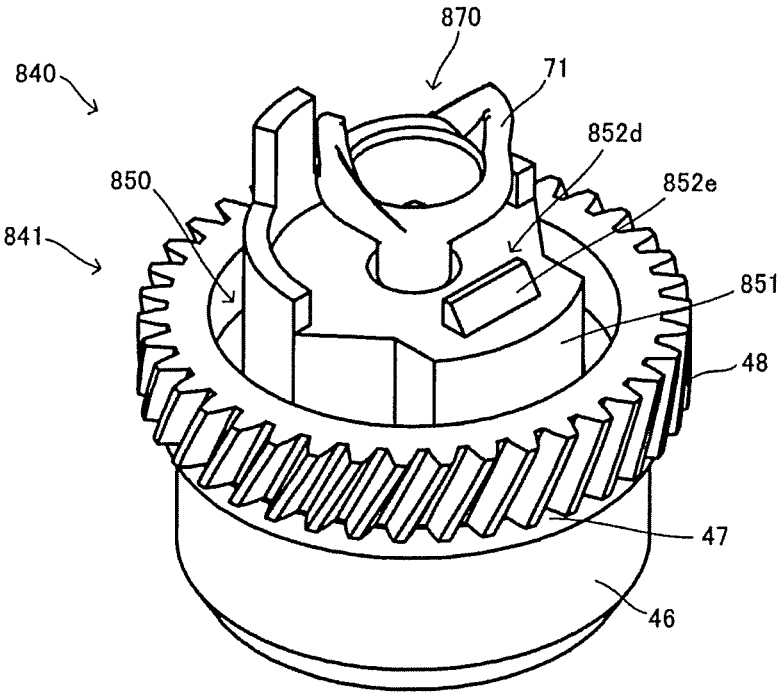
FIG. 56 is a perspective view of an end member 840.
Figure 57:
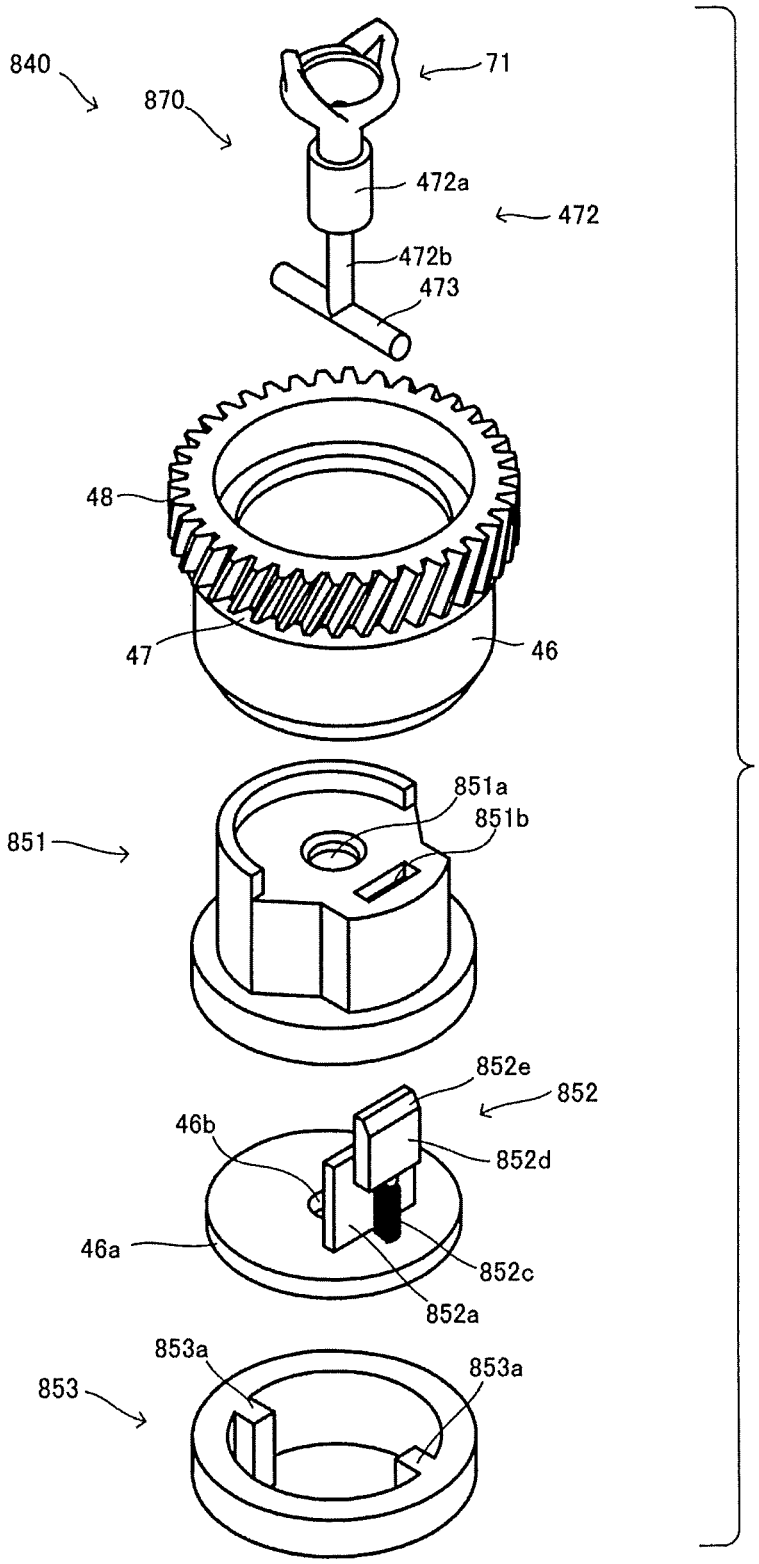
FIG. 57 is an exploded perspective view of the end member 840.

FIGS. 56 and 57 illustrate views for describing a ninth aspect. FIG. 56 is a perspective view of an end member 840, and FIG. 57 is an exploded perspective view of the end member 840. The end member 840 is also a member which is attached to the end portion of the photoreceptor drum 35. The end member 840 is provided with a bearing member 841 and a shaft member 870.

The bearing member 841 is a member fixed to the end portion of the photoreceptor drum 35. In the aspect, the bearing member 841 also includes the tubular body 46, the contact wall 47, and the gear 48. Since these can be employed with the same configuration as that of the bearing member 41 which is already described, the description thereof will be omitted here. In addition, in the aspect, in the tubular body 46, the bottom portion 46*a* is also provided on the side opposite to the side on which the coupling member 71 of the shaft member 870 is provided to protrude, and at least a part thereof is blocked. In addition, in the aspect, a hole 46*b* through which the second rotating shaft 472*b* of the shaft member 870 passes is provided at a position that becomes the center in the bottom portion 46*a*.

A holding portion 850 is provided on the inside of the tubular body 46 which has a tubular shape. The holding portion 850 is a part which holds one end side (base end portion side) of the shaft member 870 which will be described later on the inside thereof. In addition, the holding portion 850 includes a shaft support member 851, a shaft member moving member 852, and a pin engaging member 853.

Figure 58A:
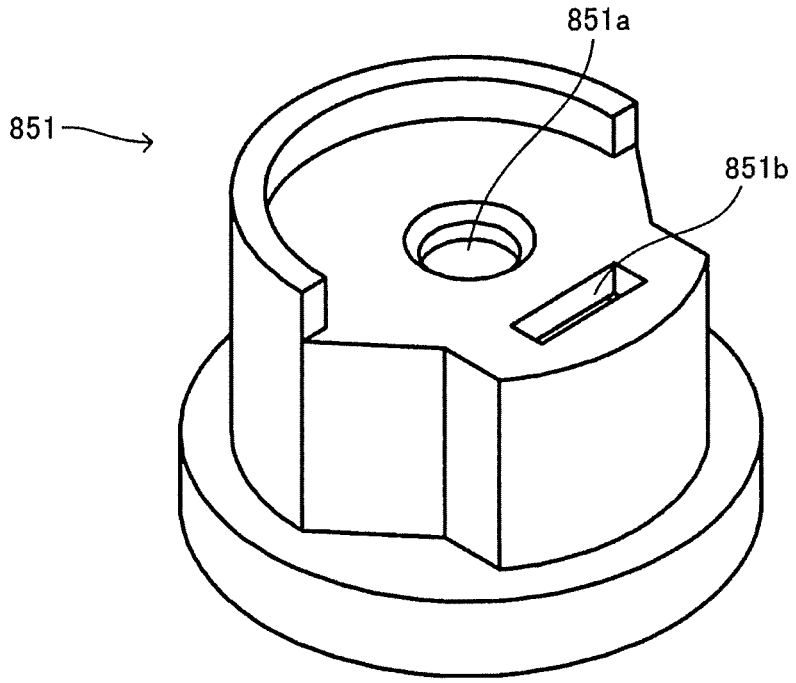
FIG. 58A is a perspective view of a shaft support member 851.
Figure 58B:
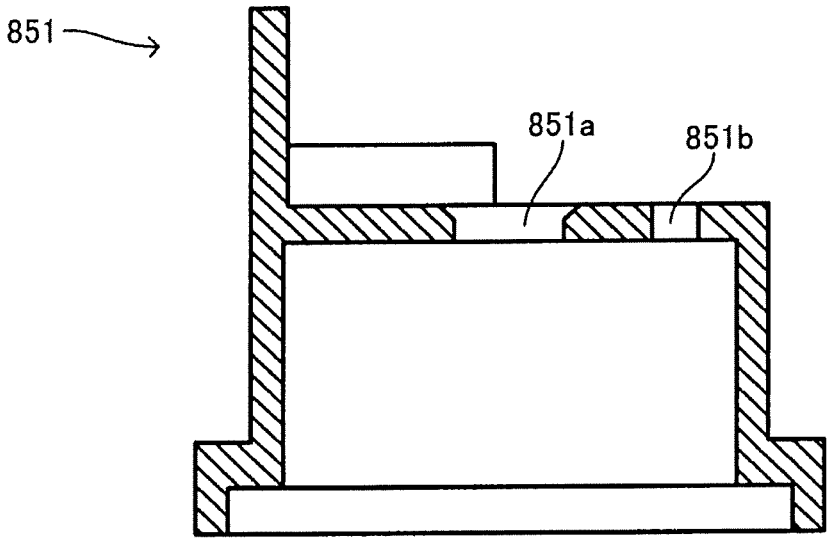
FIG. 58B is a sectional view of the shaft support member 851.

FIG. 58A illustrates a perspective view of the shaft support member 851, and FIG. 58B illustrates a sectional view of the shaft support member 851 along the shaft line direction.

The shaft support member 851 is a tubular member that is coaxial to the shaft line of the tubular body 46. One end side of the tubular shape is narrowed in inner diameter and is formed as a rotation shaft hole 851*a*. The inner diameter of the rotation shaft hole 851*a* has a size by which the first rotating shaft 472*a* formed to be thick in the rotating shaft 472 of the shaft member 870 can pass therethrough. Furthermore, in the end portion, a pressing member hole 851*b* which is a hole that passes through in a direction parallel to the shaft line direction is formed. In the pressing member hole 851*b*, a pressing member 852*d* which will be described later is disposed to passes therethrough.

In addition, in the shaft support member 851, an end portion opposite to a side on which the rotation shaft hole 851*a* and the pressing member hole 851*b* are formed is open. As will be described later, the shaft member moving member 852 is disposed on the inside of the shaft support member 851.

Figure 59A:
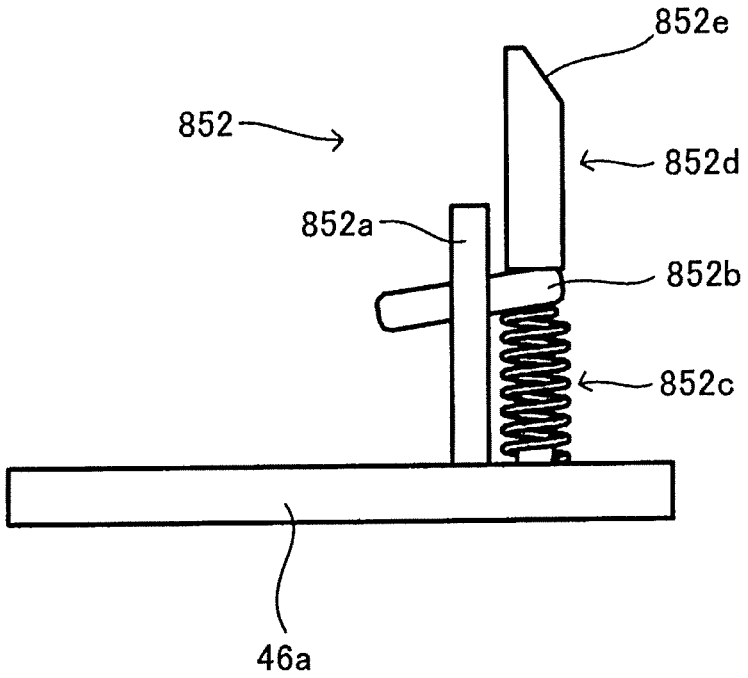
FIG. 59A is a front view of a shaft member moving member 852.
Figure 59B:
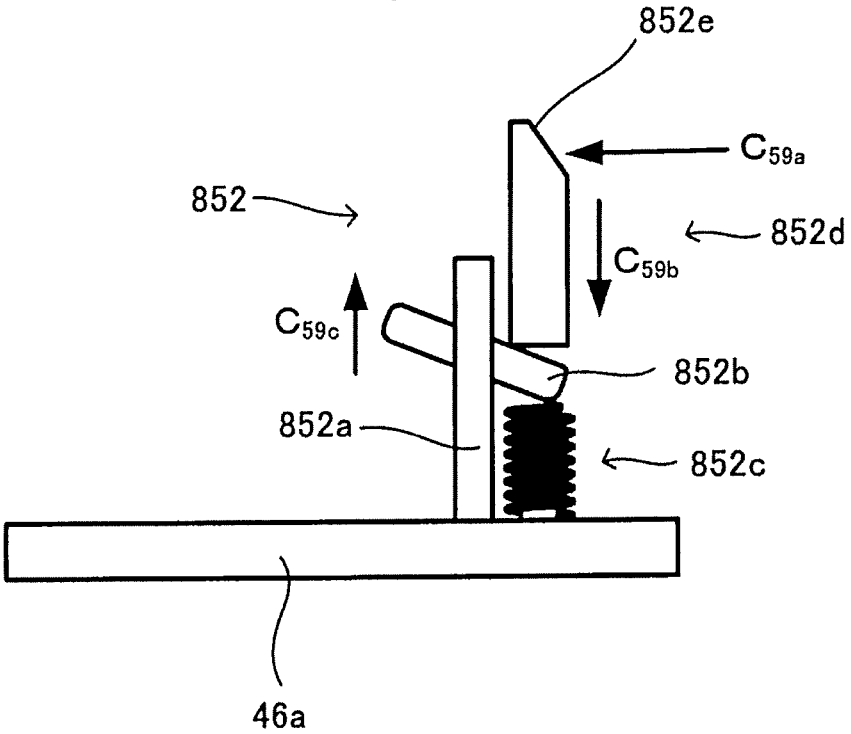
FIG. 59B is a front view of the shaft member moving member 852 in another posture.

The shaft member moving member 852 is a member which receives the pressing force from the outside, and includes a mechanism for moving the shaft member 870 in the shaft line direction. FIG. 59A illustrates a front view of the shaft member moving member 852 of the aspect. In addition, FIG. 59B illustrates the shaft member moving member 852 in a posture deformed by receiving the pressing force from the outside. As can be ascertained from the drawings, the shaft member moving member 852 includes a support projection 852*a*, a lever member 852*b*, an elastic member 852*c*, and a pressing member 852*d*.

The support projection 852*a* is a member that serves as a fulcrum of the leverage of the lever member 852*b* and is a plate-like member which stands upright from the bottom portion 46*a*.

The lever member 852*b* is a rod-like member, and is supported by the support projection 852*a* so as to be rotatable around the support projection 852*a* that serves as a fulcrum. The lever member 852*b* is supported such that one end side and the other end respectively protrude to opposite sides across the support projection 852*a* in a viewpoint illustrated in FIGS. 59A and 59B.

The elastic member 852*c* is an elastic member disposed between the bottom portion 46*a* and one end side of the lever member 852*b*. The elastic member 852*c* is disposed so as to bias the one end side of the lever member 852*b* in a direction of separating from the bottom portion 46*a* (a direction toward the coupling member 71 side).

The pressing member 852*d* is a plate-like member disposed on the side opposite to the elastic member 852*c* across the lever member 852*b*, and is a member that presses one end side of the lever member 852*b* against the biasing force of the elastic member 852*c*. Therefore, one end of the pressing member 852*d* is disposed so as to come into contact with one end of the lever member 852*b*. In addition, an inclined surface 852*e* is provided in the end portion opposite to the side that comes into contact with the lever member 852*b*.

According to the shaft member moving member 852, as illustrated in FIG. 59B, when the pressing force is applied to the inclined surface 852*e* in the direction indicated by an arrow $C_{59a}$, due to the component force, the pressing member 852*d* moves in a direction indicated by an arrow $C_{59b}$, and one end of the lever member 852*b* is moved against the biasing force of the elastic member 852*c*. Accordingly, the other end of the lever member 852*b* moves as indicated by an arrow $C_{59c}$ due to the action.

The pin engaging member 853 is a member which receives the rotating force from the rotating force transmission pin 473 that also serves as a base end portion of the shaft member 870, and rotates the bearing member 841. As can be ascertained from FIG. 57, the pin engaging member 853 is annular and has a pin engaging projection 853*a* which is a projection to which the tip end of the rotating force transmission pin 473 is hooked on the inside thereof.

The material which configures the bearing member 841 can be considered similar to the above-described bearing member 41.

Next, the shaft member 870 of the end member 840 will be described. The shaft member 870 is similar to the above-described shaft member 470 (refer to FIGS. 38A and 38B), and each of the configuration elements is given the same reference numerals as those of the shaft member 470, and the description thereof will be omitted.

Figure 60A:
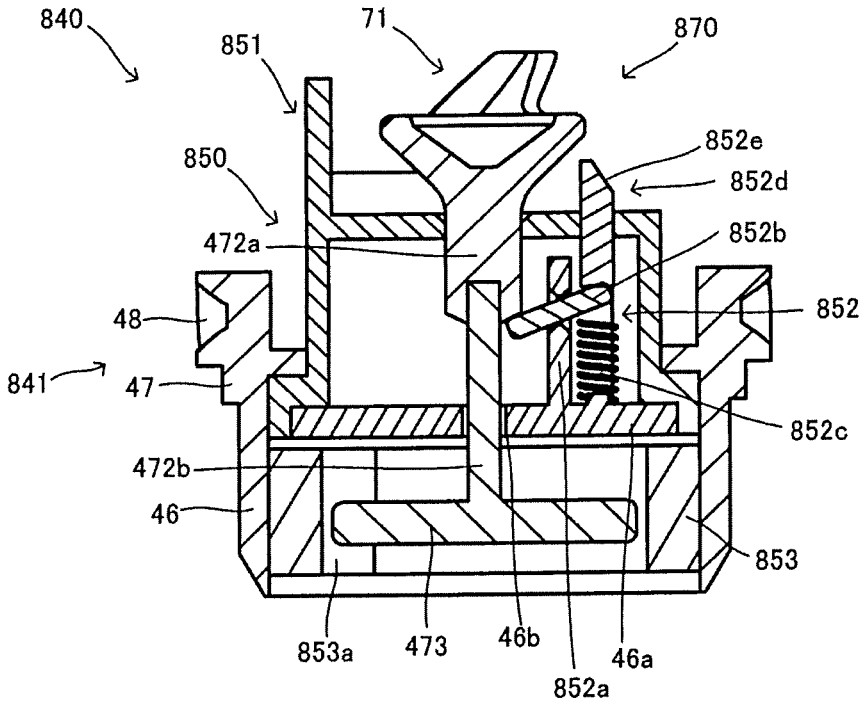
FIG. 60A is a sectional view in the shaft line direction of the end member 840.

By combining the bearing member 841 and the shaft member 870 with each other as follows, the end member 840 is made. By describing the combination, the shape, the size, or the positional relationship of the bearing member 841 and the shaft member 870 are further understood. FIG. 60A illustrates a sectional view of the end member 840 along the shaft line direction. In addition, FIG. 60B illustrates one example of the posture in which the shaft member 870 moves in the viewpoint illustrated in FIG. 60A.

As can be ascertained from FIG. 60A, the shaft member moving member 852 is disposed on a side that becomes the inside of the tubular body 46 on the surface of the bottom portion 46*a*. In addition, the shaft support member 851 is mounted on the bottom portion 46*a* so as to include the shaft member moving member 852 therein. At this time, the end portion provided with the inclined surface 852*e* in the pressing member 852*d* of the shaft member moving member 852, passes through the pressing member hole 851*b* provided in the shaft support member 851, and is provided to protrude from the shaft member moving member 852.

Meanwhile, in the shaft member 870, the rotating force transmission pin 473 is disposed on the inside of the pin engaging member 853, the second rotating shaft 472*b* passes through the hole 46*b* provided in the bottom portion 46*a*, and the first rotating shaft 472*a* passes through the rotation shaft hole 851*a* of the shaft support member 851. In addition, the coupling member 71 is positioned so as to protrude from the shaft support member 851 and the bearing member 841.

Figure 60B:
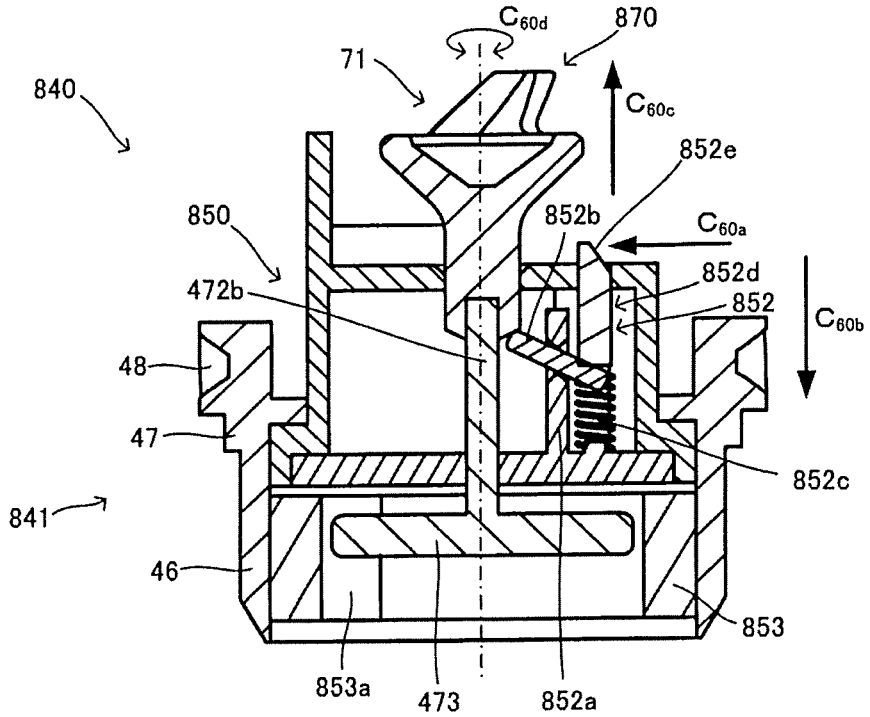
FIG. 60B is a sectional view in the shaft line direction of the end member 840 in another posture.

By disposing the shaft member 870 on the inside of the bearing member 841 in this manner, the shaft member 870 can be deformed to a posture illustrated in FIG. 60B from the posture illustrated in FIG. 60A.

When the shaft member 870 is in the posture illustrated in FIG. 60A, the shaft lines of the coupling member 71 of the shaft member 870 and the rotating shaft 472 match each other, and match the shaft line of the bearing member 741, the coupling member 71 is in a posture of being the closest the bearing member 741.

When the inclined surface 852*e* provided in the pressing member 852*d* of the shaft member moving member 852 is pressed in a direction orthogonal to the shaft line from the posture illustrated in FIG. 60A as indicated by an arrow $C_{60a}$ in FIG. 60B, the pressing member 852*d* moves in a direction in which the pressing member 852*d* enters the inside of the bearing member 841 in the shaft line direction as indicated by an arrow $C_{60b}$ due to component force. Accordingly, the end surface of the pressing member 852*d* presses one end of the lever member 852*b* against the biasing force of the elastic member 852*c*. Then, the lever member 852*b* rotates around the support projection 852*a*, and the other end moves toward the coupling member 71 side. In addition, the other end of the lever member 852*b* presses the end surface of the first rotating shaft 472*a*, and the shaft member 870 moves in the direction in which the coupling member 71 protrudes from the bearing member 841 in the shaft line direction as indicated by an arrow $C_{60c}$. In this manner, it is possible to move the coupling member 71 in the shaft line direction.

In addition, when receiving the driving force from the apparatus main body 10, the shaft member 870 receives the rotating force around the shaft line as indicated by an arrow $C_{60d}$ in FIG. 60B. At this time, the coupling member 71, the rotating shaft 472, and a rotating force transmission pin 473 rotate, the rotating force transmission pin 473 is hooked to the pin engaging projection 853*a* of the pin engaging member 853, and the pin engaging member 853 rotates. Since the pin engaging member 853 adheres to the tubular body 46, the end member 840 rotates and the rotating force can be transmitted to the photoreceptor drum 35.

According to the end member 840, due to the movement, it is possible to smoothly attach and detach the process cartridge to and the apparatus main body 10 similar to the end member 40.

Figure 61:
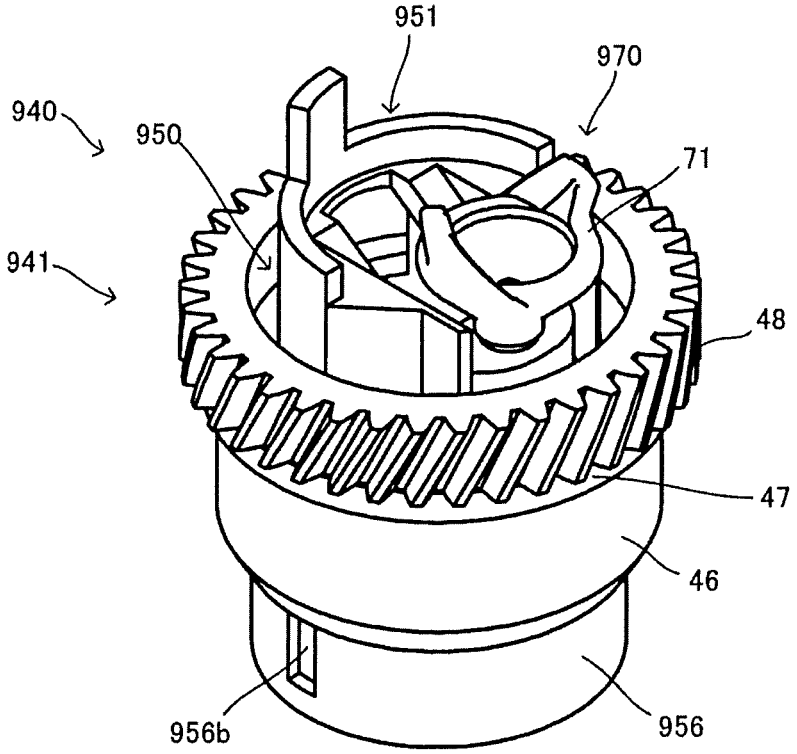
FIG. 61 is a perspective view of an end member 940.
Figure 62:
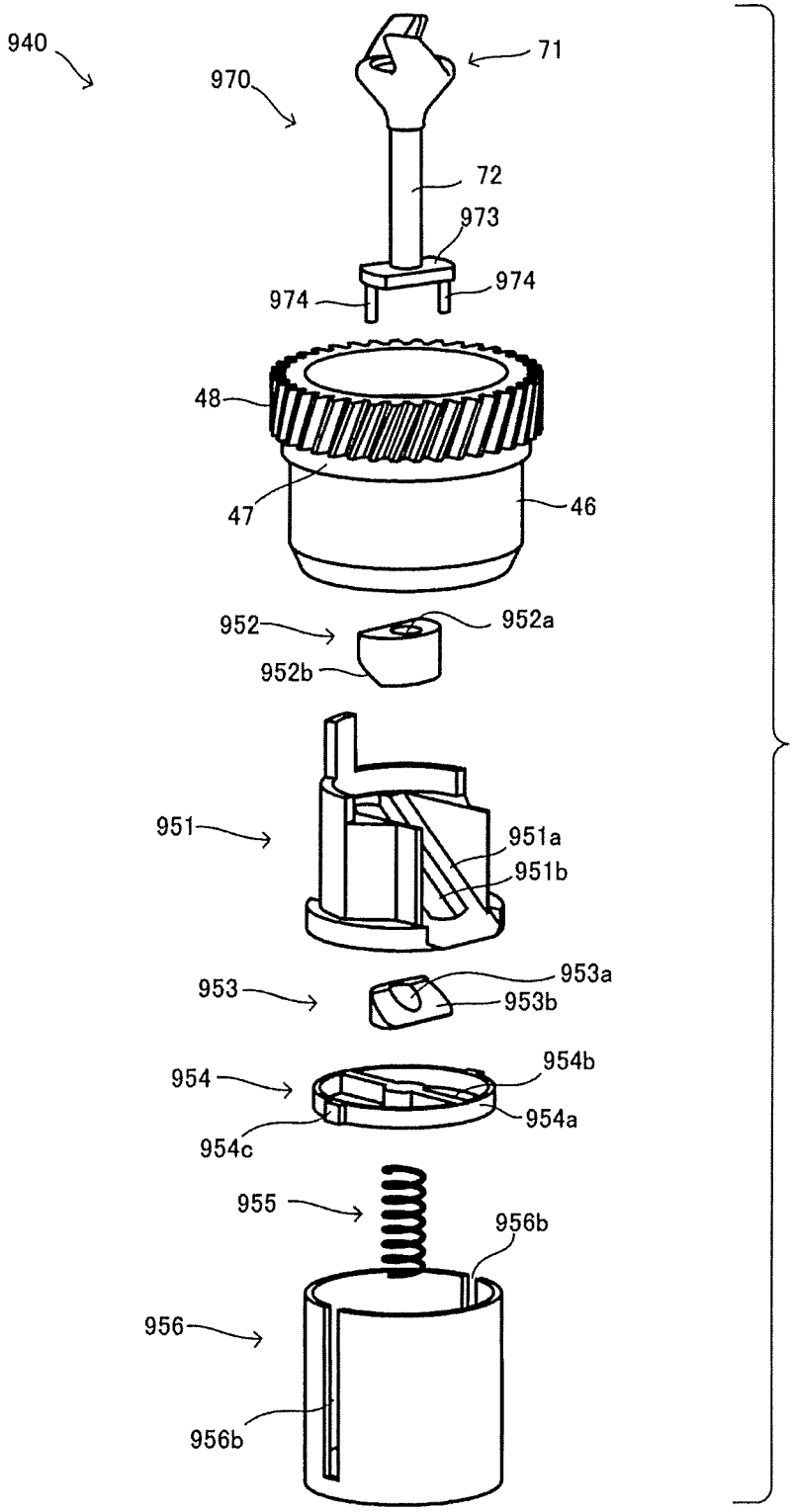
FIG. 62 is an exploded perspective view of the end member 940.

FIGS. 61 and 62 illustrate views for describing a tenth aspect. FIG. 61 is a perspective view of an end member 940, and FIG. 62 is an exploded perspective view of the end member 940. The end member 940 is also a member which is attached to the end portion of the photoreceptor drum 35. The end member 940 is provided with a bearing member 941 and a shaft member 970.

The bearing member 941 is a member fixed to the end portion of the photoreceptor drum 35. In the aspect, the bearing member 941 also includes the tubular body 46, the contact wall 47, and the gear 48. Since these can be employed with the same configuration as that of the bearing member 41 which is already described, the description thereof will be omitted here.

A holding portion 950 is provided on the inside of the tubular body 46 which has a tubular shape. The holding portion 950 is a part which holds one end side (base end portion side) of the shaft member 970 on the inside thereof. In addition, the holding portion 950 includes a shaft holding member 951, a first sliding member 952, a second sliding member 953, a pin engaging member 954, an elastic member 955, and a guide member 956.

Figure 63A:
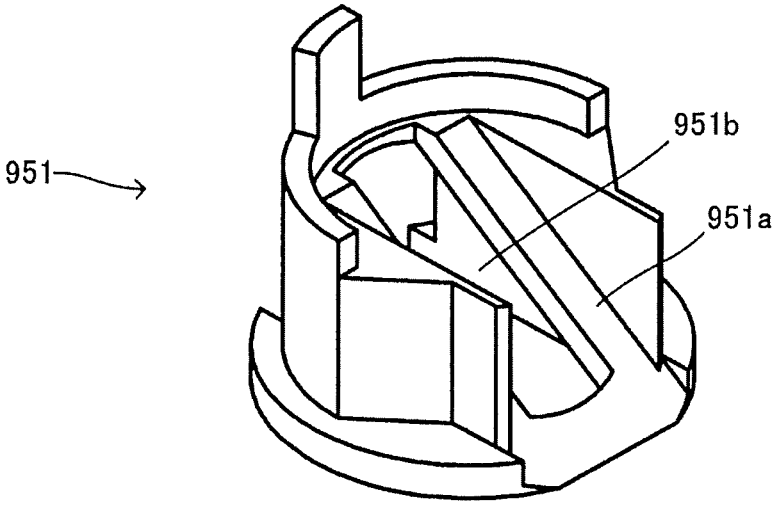
FIG. 63A is a perspective view of a shaft holding member 951.
Figure 63B:
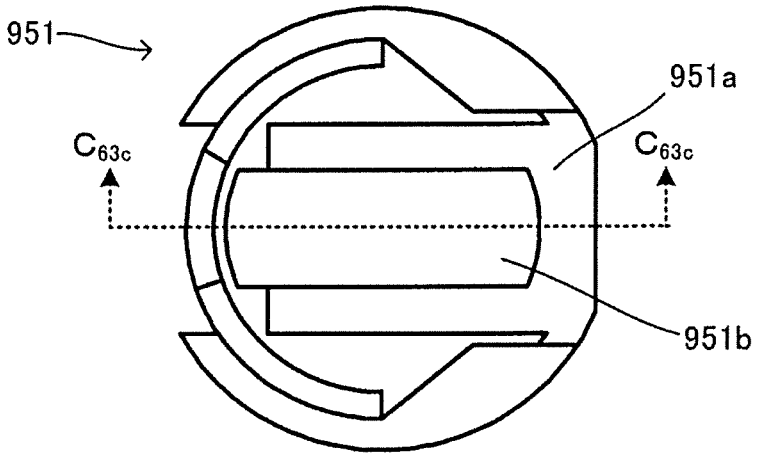
FIG. 63B is a plan view of the shaft holding member 951.
Figure 63C:
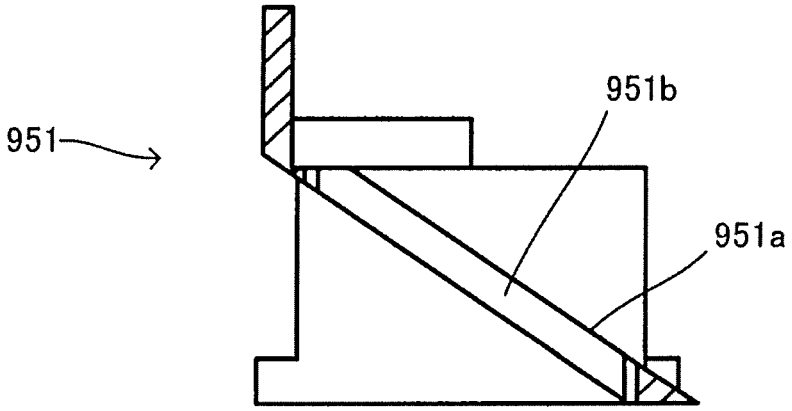
FIG. 63C is a sectional view of the shaft holding member.

The shaft holding member 951 is a member which holds the shaft member 970 and controls movement of the shaft member 970 in the direction parallel to the shaft line direction. FIG. 63A illustrates a perspective view of the shaft holding member 951, FIG. 63B illustrates a plan view of the shaft holding member 951, and FIG. 63C illustrates a sectional view of the shaft holding member 951 along the line indicated by $C_{63c}$-$C_{63c}$ in FIG. 63B.

The shaft holding member 951 is a tubular member which is coaxial to the shaft line of the tubular body 46 and has an aspect in which a part of the side wall is cut out and the inside thereof is exposed. In addition, an inclined member 951*a* and a slit 951*b* are provided on the exposed inside.

The inclined member 951*a* is a plate-like member which extends transversely to the tubular inside of the shaft holding member 951 and disposed so as to have a predetermined inclination with respect to the shaft line. Therefore, the inclined member 951*a* extends across the inside from the tubular one side end portion to the other side end portion of the shaft holding member 951.

The slit 951*b* is a slit formed in the inclined member 951*a* and extends along a direction in which the inclined member 951*a* extends. The width of the slit 951*b* has a size by which the rotating shaft 72 of the shaft member 970 can pass therethrough.

Figure 64A:
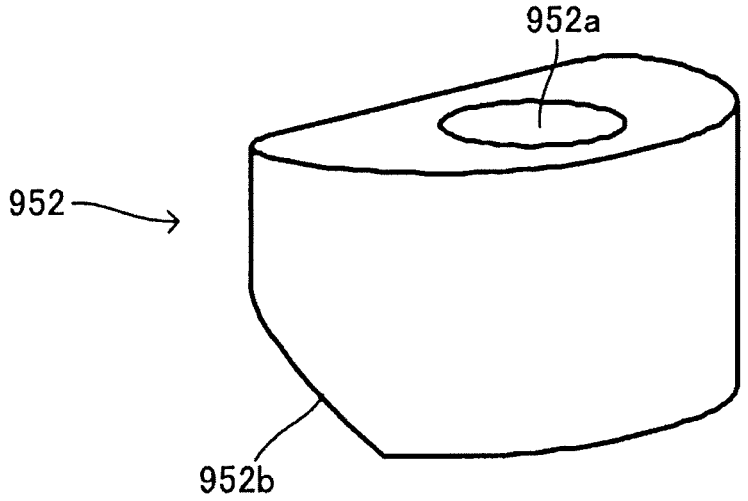
FIG. 64A is a perspective view of a first sliding member 952.
Figure 64B:
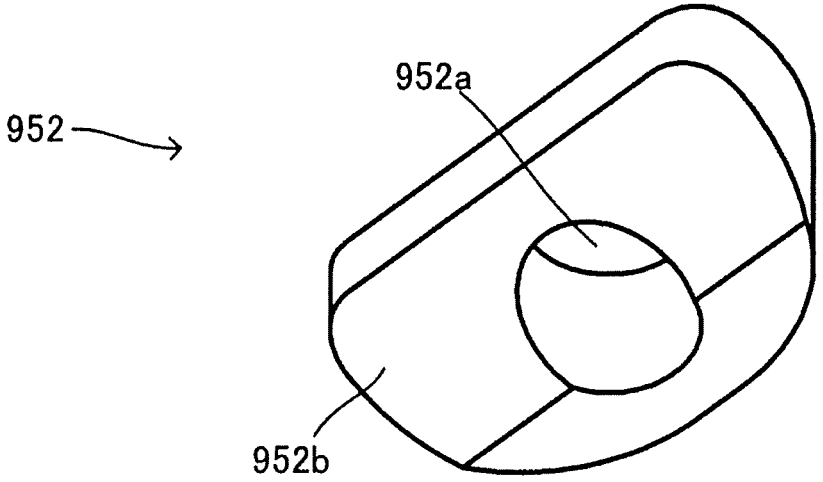
FIG. 64B is another perspective view of the first sliding member 952.
Figure 64C:
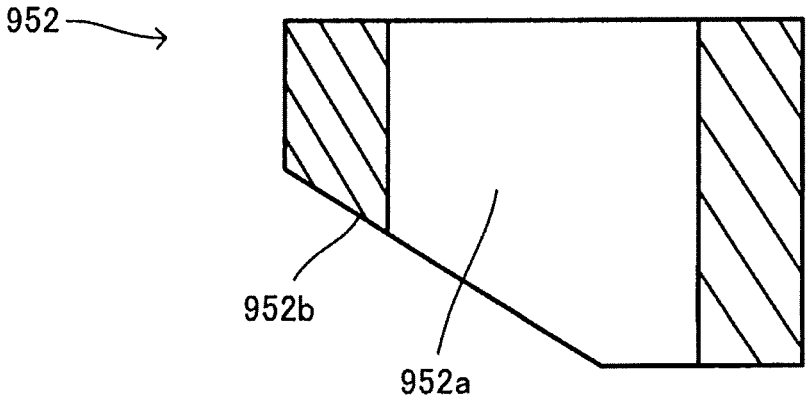
FIG. 64C is a sectional view of the first sliding member 952.
Figure 65A:
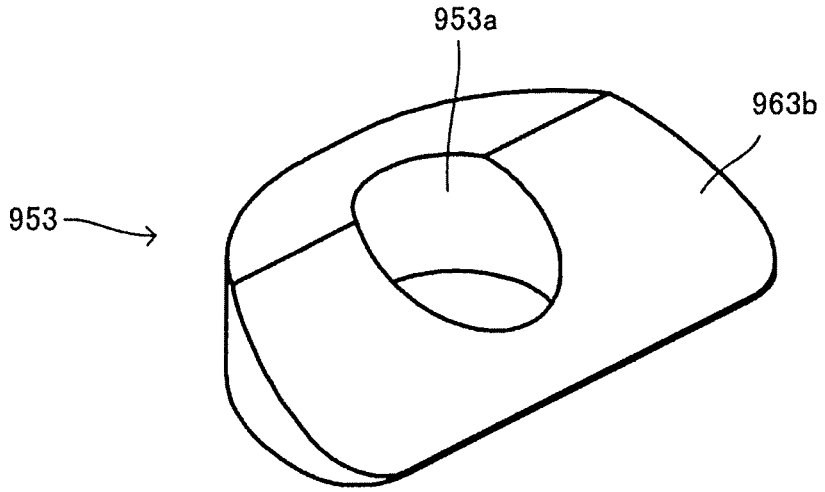
FIG. 65A is a perspective view of a second sliding member 953.
Figure 65B:
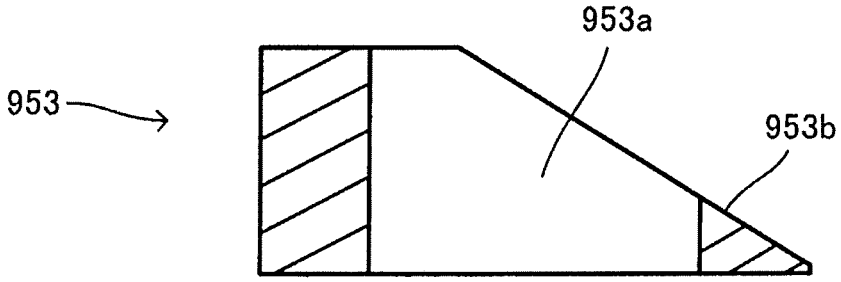
FIG. 65B is a sectional view of the second sliding member 953.

The first sliding member 952 and the second sliding member 953 are members which are disposed in the rotating shaft 72 of the shaft member 970 and guide the shaft member 970 to move along the inclination of the slit 951*b*. FIG. 64A illustrates a perspective view of the first sliding member 952, FIG. 64B illustrates a perspective view when viewed from the other direction of the first sliding member 952, and FIG. 64C illustrates a sectional view of the first sliding member 952. In addition, FIG. 65A illustrates a perspective view of a second sliding member 953, and FIG. 65B illustrates a sectional view of the second sliding member 953.

As can be ascertained from the drawings, the first sliding member 952 and the second sliding member 953 are block-shaped members and have a hole 952*a* through which the rotating shaft 72 of the shaft member 970 passes and a hole 953*a*. Furthermore, the first sliding member 952 and the second sliding member 953 are provided with an inclined surface 952*b* and an inclined surface 953*b* which are inclined at the same angle as that of the inclination of the inclined member 951*a*.

Figure 66:
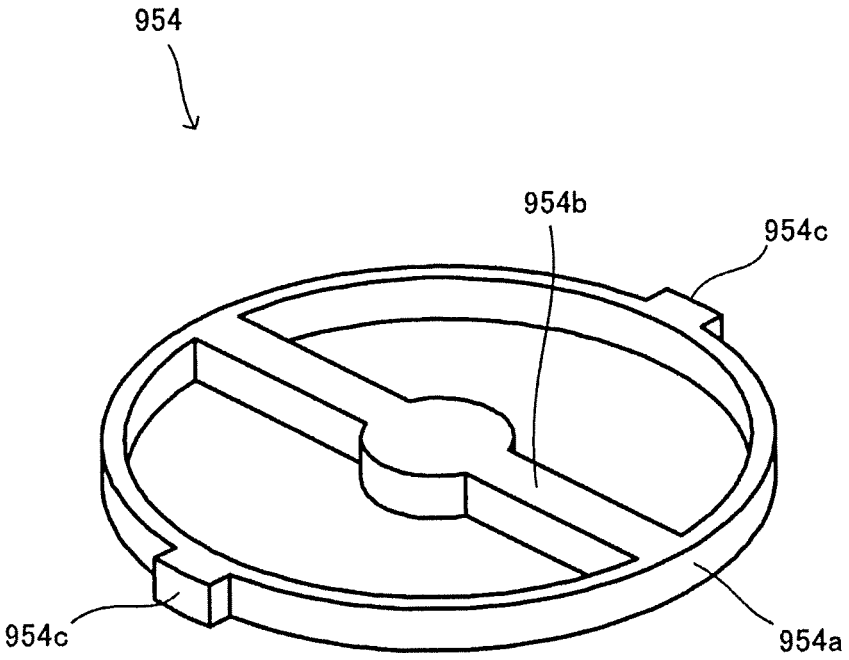
FIG. 66 is a perspective view of a pin engaging member 954.

The pin engaging member 954 has a function of receiving a rotating force from the shaft member 970 and transmitting the rotating force to the tubular body 46. FIG. 66 illustrates a perspective view of the pin engaging member 954. In the aspect, a pin engaging member 954, an annular portion 954*a*, a partition portion 954*b*, and a projection 954*c* are provided.

The annular portion 954*a* is an annular part having a size that can be contained on the inside of the tubular body 46 when the center thereof matches the shaft line of the tubular body 46.

The partition portion 954*b* is a part provided so as to partition the inside of the annular portion 954*a*, and in the aspect, the partition portions 954*b* partition the inside with one rod-like member along one diameter of the annular portion 954*a*. In the aspect, as will be described later, a rotating force transmission pin 974 of the shaft member 970 is disposed in each space partitioned by the partition portion 954*b*.

The projection 954*c* is a projection provided so as to protrude from the outer circumferential surface of the annular portion 954*a*. The projection 954*c* is a projection inserted into a slit 956*b* provided in the guide member 956. In the aspect, two projections 954*c* are disposed at an interval of 180 degrees around the center of the annular portion 954*a*.

The elastic member 955 is disposed between the bottom portion 956*a* of the guide member 956 and the pin engaging member 954, and the shaft line direction is the biasing direction. In the aspect, a spring is used as the elastic member. However, it is not necessarily to provide a spring, and a sponge, rubber, or the like can also be used.

Figure 67:
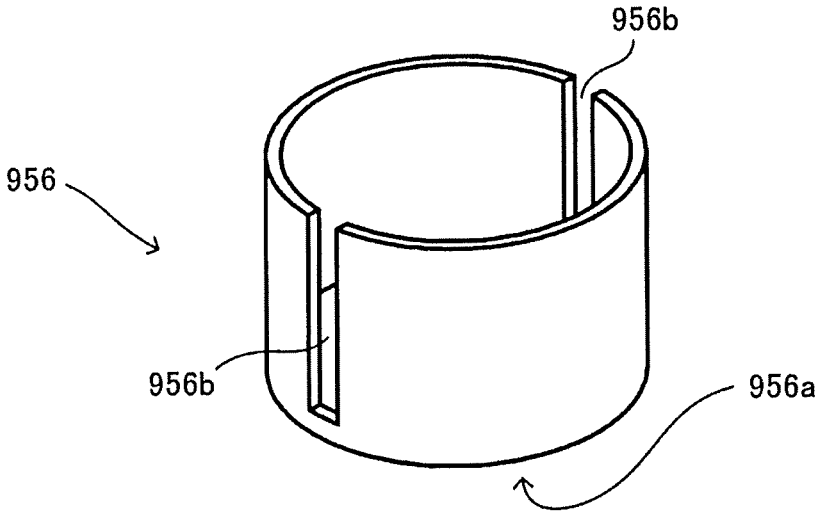
FIG. 67 is a perspective view of a guide member 956.

The guide member 956 provides a guide for moving the pin engaging member 954 in the shaft line direction and transmits the rotating force of the pin engaging member 954 to the tubular body 46. FIG. 67 illustrates a perspective view of the guide member 956. The guide member 956 is a bottomed tubular member having a bottom portion 956*a* on one side and has two slits 956*b* which extend parallel to a tubular shaft line on the wall surface thereof. The two slits 956*b* are disposed to oppose each other across the shaft line, and the projection 654*c* of the above-described pin engaging member 954 is inserted thereinto.

The material which configures the bearing member 941 can be considered similar to the above-described bearing member 41.

Figure 68:
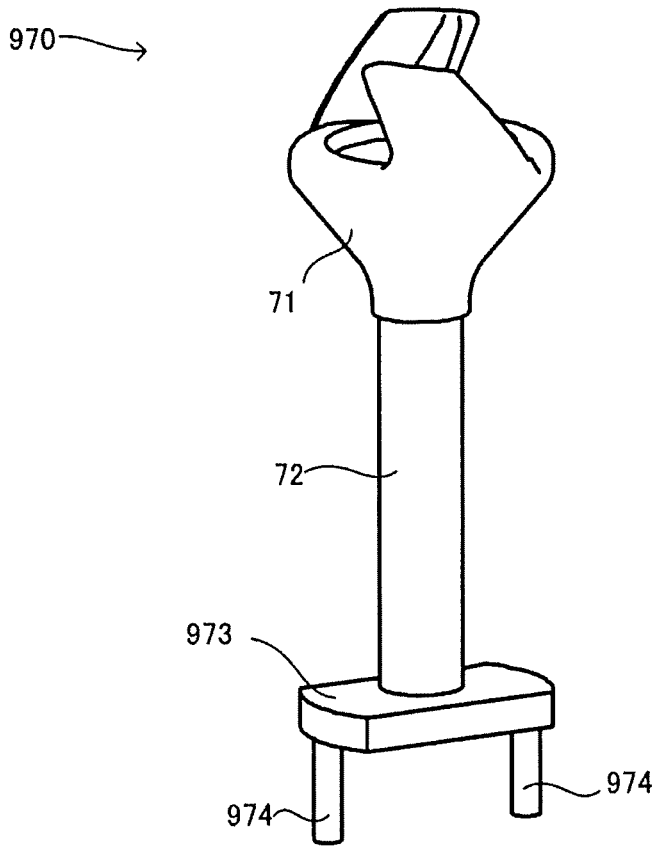
FIG. 68 is a perspective view of a shaft member 970.

Next, the shaft member 970 of the end member 940 will be described. FIG. 68 is a perspective view of the shaft member 970. As can be ascertained from the drawing, the shaft member 970 is provided with the coupling member 71, the rotating shaft 72, the base end portion 973, and the rotating force transmission pin 974.

Since the coupling member 71 and the rotating shaft 72 are the same as those which have been already described, the description thereof will be omitted here.

The base end portion 973 is a part provided on the side opposite to the coupling member 71 in the end portion of the rotating shaft 72, and in the aspect, the base end portion 973 is a plate-shaped part disposed so as to extend from the rotating shaft 72.

The rotating force transmission pin 974 is a pin-shaped projection provided on a surface opposite to the side on which the rotating shaft 72 is disposed, on the surface of the base end portion 973. In the aspect, two rotating force transmission pins 974 are arranged.

A material of the shaft member 970 is not particularly limited, but resins such as polyacetal, polycarbonate, PPS and the like can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

Figure 69A:
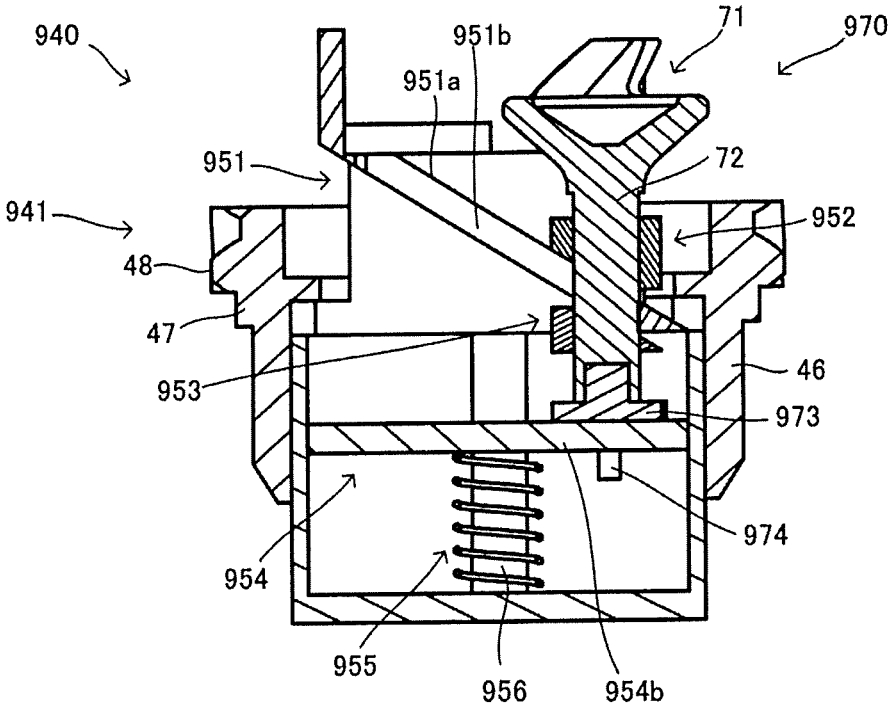
FIG. 69A is a sectional view in the shaft line direction of the end member 940.
Figure 69B:
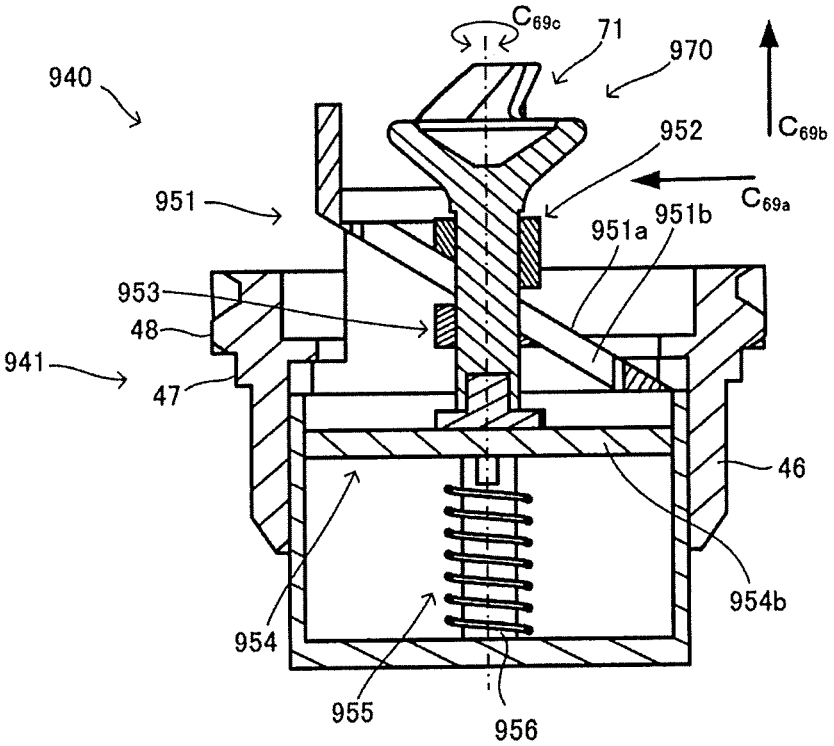
FIG. 69B is a sectional view in the shaft line direction of the end member 940 in another posture.

By combining the bearing member 941 and the shaft member 970 with each other as follows, the end member 940 is made. By describing the combination, the shape, the size, or the positional relationship of the bearing member 941 and the shaft member 970 are further understood. FIG. 69A illustrates a sectional view of the end member 940 along the shaft line direction. In addition, FIG. 69B illustrates one example of the posture in which the shaft member 970 moves in the viewpoint illustrated in FIG. 69A.

As can be ascertained from FIG. 69A, the guide member 956 is disposed in the end portion in the direction in which the coupling member 71 does not protrude, on the inside of the tubular body 46. At this time, the opening side of the guide member 956 faces the inside of the tubular body 46. In addition, the elastic member 955 is disposed on a side that becomes the inside of the tubular body 46 on the surface of the bottom portion 956*a* of the guide member 956. The biasing force is parallel to the shaft line of the tubular body 46. In addition, the pin engaging member 954 is mounted on a side opposite to the bottom portion 956*a* side in the end portion of the elastic member 955. At this time, the projection 954*c* provided at the outer circumference of the pin engaging member 954 is inserted into the slit 956*b* provided in the guide member 956.

In addition, the shaft holding member 951 is disposed in an end portion opposite to the side on which the guide member 956 is disposed in the end portion of the tubular body 46.

Meanwhile, with respect to the shaft member 970, the base end portion 973 of the shaft member 970 is placed on the side opposite to the side on which the elastic member 955 is disposed on the surface of the pin engaging member 954. At this time, the rotating force transmission pin 974 which protrudes from the base end portion 973 is inserted into the space formed by the partition portions 954*b* of the pin engaging member 954.

In addition, the rotating shaft 72 of the shaft member 970 passes through the slit 951*b* formed in the inclined member 951*a* of the shaft holding member 951, and the coupling member 71 is disposed so as to protrude from the bearing member 941.

At this time, the rotating shaft 72 passes through the hole 952*a* of the first sliding member 952 and the hole 953*a* of the second sliding member 953, and the first sliding member 952 and the second sliding member 953 are attached to the rotating shaft 72. At this time, the first sliding member 952 is disposed to be closer to the coupling member 71 than the inclined member 951*a*, and is disposed such that the slit 951*b* of the inclined member 951*a* and the inclined surface 952*b* of the first sliding member 952 can overlap each other and slide. In addition, the second sliding member 953 is disposed to be closer to the rotating force transmission pin 974 than the inclined member 951*a*, and is disposed such that the slit 951*b* of the inclined member 951*a* and the inclined surface 953*b* of the second sliding member 953 can overlap each other and slide.

By disposing the shaft member 970 on the inside of the bearing member 941 in this manner, the shaft member 970 can be deformed to a posture illustrated in FIG. 69B from the posture illustrated in FIG. 69A.

When the shaft lines of the coupling member 71, the rotating shaft 72, and the base end portion 973 of the shaft member 970 are deviated from the shaft line of the tubular body 46 similar to the posture illustrated in FIG. 69A, the shaft member 970 is in a posture in which the coupling member 71 is close to the bearing member 941.

When the coupling member 71 is moved in the direction orthogonal to the shaft line and the shaft lines of the coupling member 71 of the shaft member 970, the rotating shaft 72, and the base end portion 973 match the shaft line of the tubular body 46 as indicated by an arrow $C_{69a}$ in FIG. 69B from the posture illustrated in FIG. 69A, the shaft member 970 is also moved in the shaft line direction as indicated by an arrow $C_{69b}$ in FIG. 69B by the action of the inclined member 951*a*, and the coupling member 71 is in a posture protruding from the bearing member 941.

In addition, when receiving the driving force from the apparatus main body 10, the shaft member 970 receives the rotating force around the shaft line as indicated by an arrow $C_{69c}$ in FIG. 69B. At this time, the coupling member 71, the rotating shaft 72, the base end portion 973, and the rotating force transmission pin 974 rotate, the rotating force transmission pin 974 is hooked to the partition portion 954*b* of the pin engaging member 954, and the pin engaging member 954 rotates. Furthermore, the projection 954*c* of the pin engaging member 954 is hooked to the side wall of the slit 956*b* of the guide member 956, and the guide member 956 rotates and is transmitted to the tubular body 46, and accordingly, the bearing member 941 rotates and the rotating force can be transmitted to the photoreceptor drum 35.

According to the end member 940, due to the movement, it is possible to smoothly attach and detach the process cartridge to and the apparatus main body 10 similar to the end member 40.

Figure 70A:
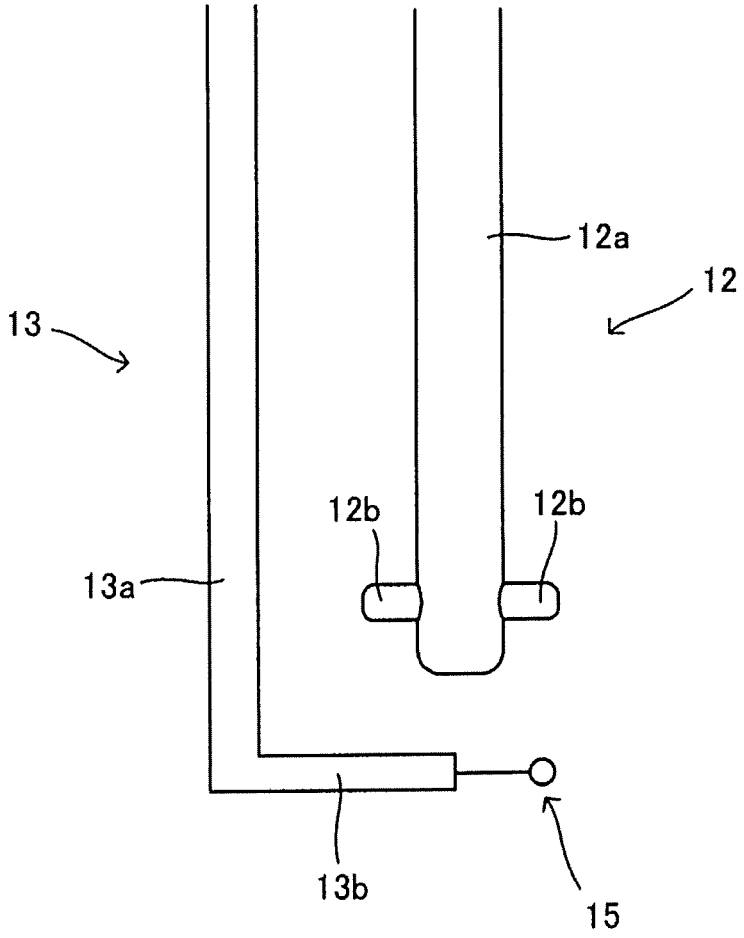
FIG. 70A is a view for describing a rotating force generating member 15 of the apparatus main body 10.
Figure 70B:
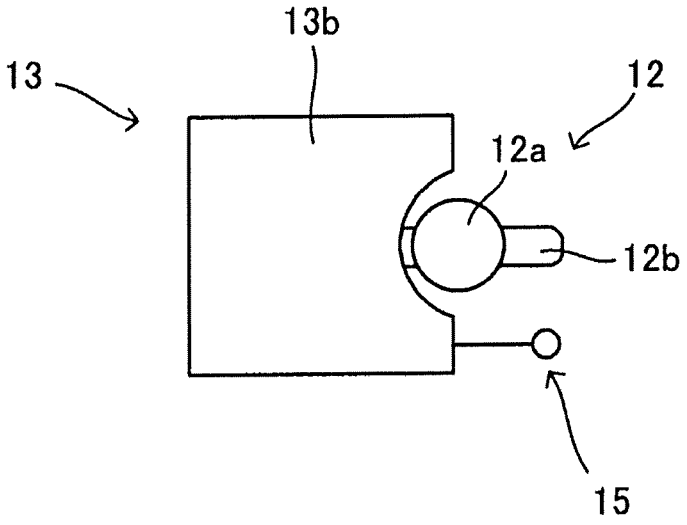
FIG. 70B is a view when viewed from a viewpoint different from that of FIG. 70A.
Figure 71:
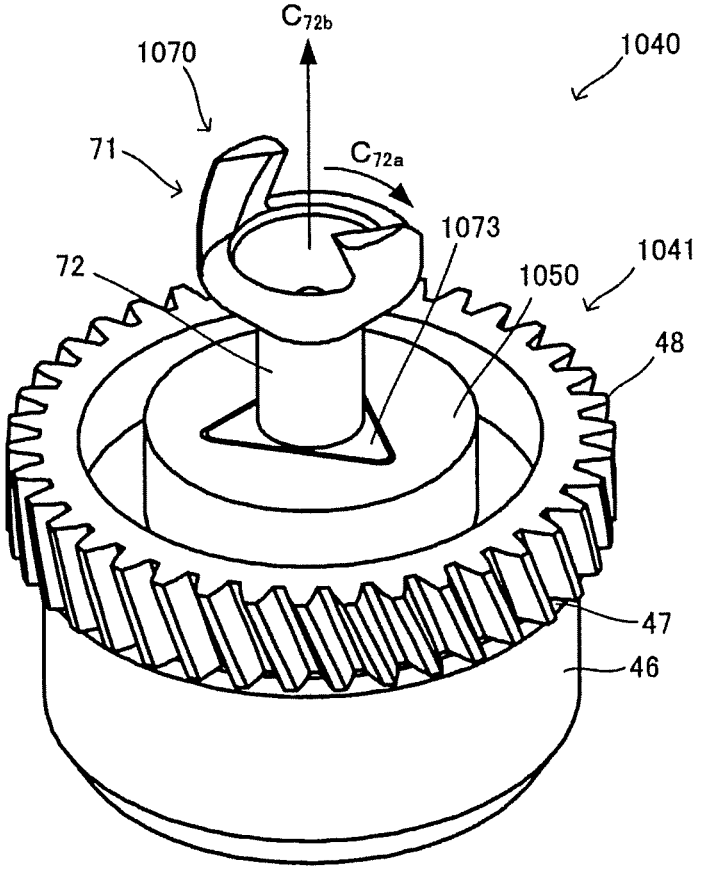
FIG. 71 is a perspective view of an end member 1040.
Figure 72A:
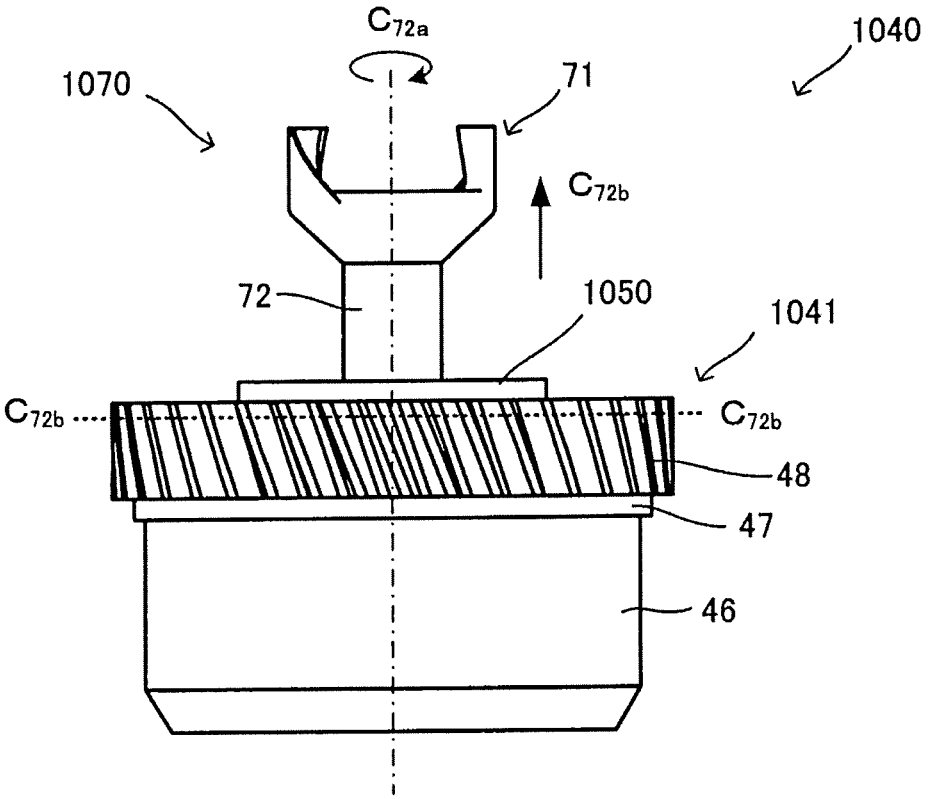
FIG. 72A is a plan view of the end member 1040.
Figure 72B:
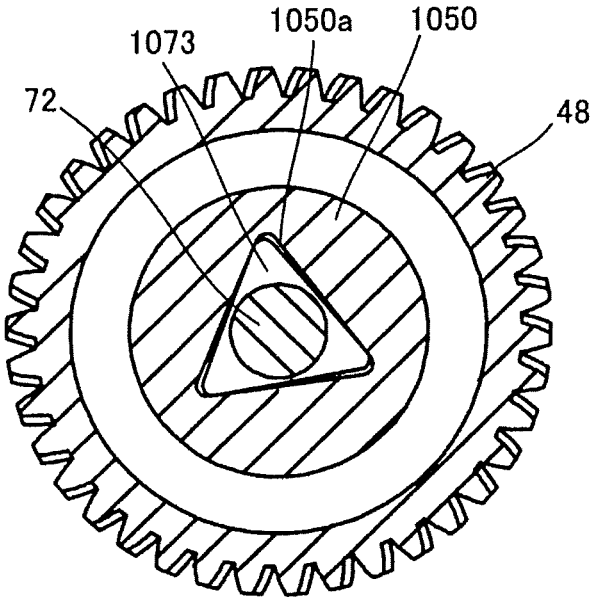
FIG. 72B is a sectional view of the end member 1040.
Figure 73A:
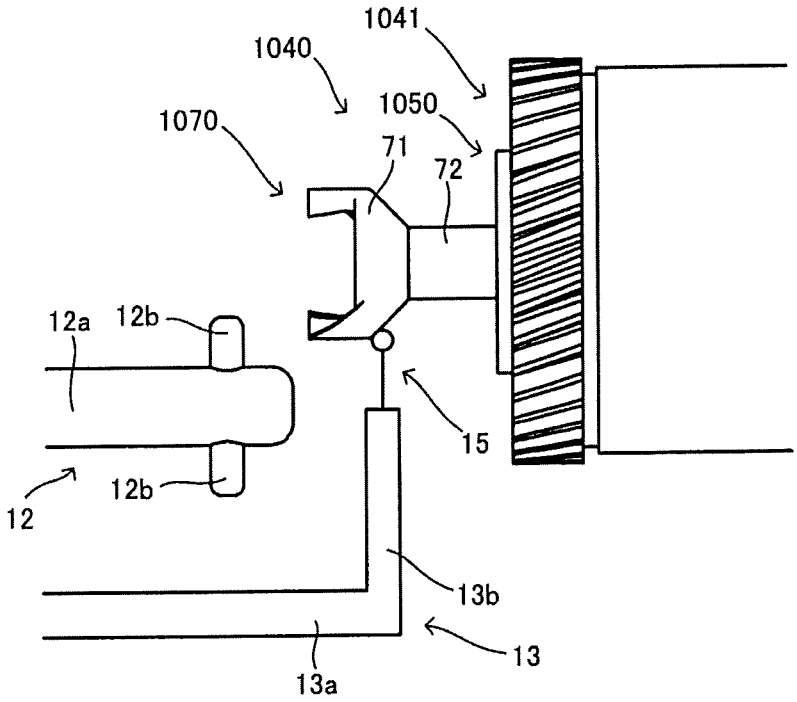
FIG. 73A is a view for describing one situation in which the process cartridge is mounted on the apparatus main body.
Figure 73B:
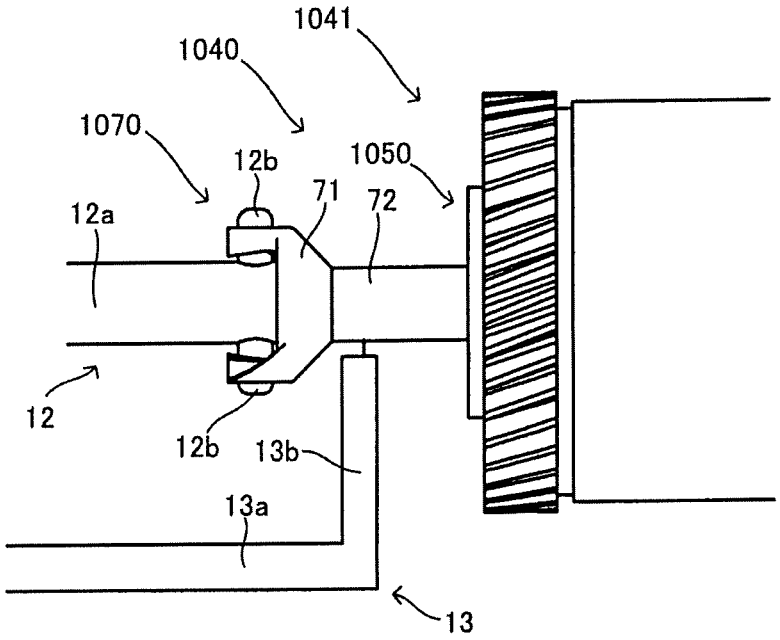
FIG. 73B is a view for describing another situation in which the process cartridge is mounted on the apparatus main body.

FIGS. 70 and 73 illustrate views for describing an eleventh aspect. FIGS. 70A and 70B are views that correspond to FIGS. 3A and 3B. FIG. 71 is a perspective view of an end member 1040, FIG. 72A is a front view of the end member 1040, and FIG. 72B is a sectional view illustrated by $C_{72b}$-$C_{72b}$ in FIG. 72A. In addition, FIGS. 73A and 73B are views that correspond to FIGS. 14A and 14B, and are views for describing situations in which the end member 1040 is engaged with the driving shaft 12.

As can be ascertained from FIGS. 70A and 70B, in addition to the above-described auxiliary member 13, in the aspect, a rotating force generating member 15 is disposed so as to further extend from the tip end of the auxiliary member 13. The rotating force generating member 15 is a member for rotating a shaft member 1070 of the end member 1040 as will be described later. When the rotating force generating member functions in this manner, a specific aspect thereof is not particularly limited, but for example, a spherical member having a large friction due to a linear elastic member and rubber or the like provided at the tip end thereof can be employed.

As can be ascertained from FIGS. 71 and 72, the end member 1040 is provided with a bearing member 1041 and a shaft member 1070.

The bearing member 1041 is a member fixed to the end portion of the photoreceptor drum 35. In the aspect, the bearing member 1041 also includes the tubular body 46, the contact wall 47, and the gear 48. Since these can be employed with the same configuration as that of the bearing member 41 which is already described, the description thereof will be omitted here.

A holding portion 1050 is provided on the inside of the tubular body 46 which has a tubular shape. The holding portion 1050 is a part which holds the shaft member 1070 which will be described later on the inside thereof. In the holding portion 1050, a hole 1050*a* having a substantially triangular section in a direction orthogonal to the shaft line of the tubular body 46 is provided.

The hole 1050*a* also functions as a mechanism for moving the rotating force receiving portion in the shaft line direction without being inclined by rotation of the rotating force receiving portion around the shaft line, and has a twisted sectional shape such that the direction of the triangular section sequentially differs in the shaft line direction.

The material which configures the bearing member 1041 can be considered similar to the above-described bearing member 41.

The shaft member 1070 includes the coupling member 71, the rotating shaft 72, and an engaging portion 1073.

Since the coupling member 71 is the same as that which has been already described, the description thereof will be omitted here.

The rotating shaft 72 is a columnar shaft-like member that functions as a rotating force transmission portion which transmits the rotating force received by the coupling member 71. Therefore, the coupling member 71 is provided at one end of the rotating shaft 72. In the aspect, in the end portion of the rotating shaft 72, the engaging portion 1073 is provided in the end portion opposite to the side on which the coupling member 71 is disposed.

The engaging portion 1073 also functions as a mechanism for moving the rotating force receiving portion in the shaft line direction without being inclined by rotation around the shaft line of the rotating force receiving portion, is fitted in the hole 1050*a* of the bearing member 1041, and is configured by a twisted triangular pillar shape that corresponds to the hole 1050*a*.

A material of the shaft member 1070 is not particularly limited, but resins such as polyacetal, polycarbonate, PPS and the like can be used. However, in order to improve the rigidity of the member, the glass fiber or the carbon fiber may be mixed into the resin in accordance with the load torque. In addition, metal may be inserted into the resin to further improve the rigidity, or the entirety or a part thereof may be made of metal.

The bearing member 1041 and the shaft member 1070 are assembled by fitting the engaging portion 1073 of the shaft member 1070 to the inside the hole 1050*a*. In addition, the coupling member 71 of the shaft member 1070 is disposed so as to protrude from the bearing member 1041.

In this manner, by disposing the shaft member 1070 on the bearing member 1041, the shaft member 1070 is rotated around the shaft line as indicated by $C_{72a}$ in FIGS. 71 and 72A, and accordingly, the shaft member 1070 can move in the shaft line direction such that the coupling member 71 protrudes as indicated by $C_{72b}$ in FIGS. 71 and 72A due to an action of a twisted triangle of an engaging portion 1073 and the hole 1050*a*.

In addition, when the rotating force around the shaft line is further applied in a state where the coupling member 71 of the shaft member 1070 is engaged with the driving shaft, the movement of the shaft member 1070 in the shaft line direction is regulated by the driving shaft, the engaging portion 1073 is hooked to the inner wall of the hole 1050*a*, and the rotation is transmitted to the bearing member 1041.

According to the end member 1040, due to the movement, it is possible to smoothly attach and detach the process cartridge to and from the apparatus main body 10. In other words, in order to mount the process cartridge to the apparatus main body, as illustrated in FIG. 73A, when moving the process cartridge downward on the paper surface, the rotating force generating member 15 presses the coupling member 71 of the shaft member 1070. Accordingly, the shaft member 70 rotates, the coupling member 71 further protrudes, and the shaft member 1070 can be engaged with the driving shaft 12, the shaft line of the shaft member 1070 matches the shaft line of the driving shaft 12, and a posture in which the shaft lines of the driving shaft 12, the shaft member 1070, the bearing member 1041, and the photoreceptor drum 35 match each other is achieved. Accordingly, the rotating force is appropriately applied from the driving shaft 12 to the shaft member 1070, the bearing member 1041, and the photoreceptor drum 35, and finally the rotating force is applied to the process cartridge 20.

Even with the end member 1040, the coupling member 71 does not swing and is engaged with the driving shaft by parallel movement, and thus, it is possible to smoothly swing the shaft member 1070.

Figure 74:
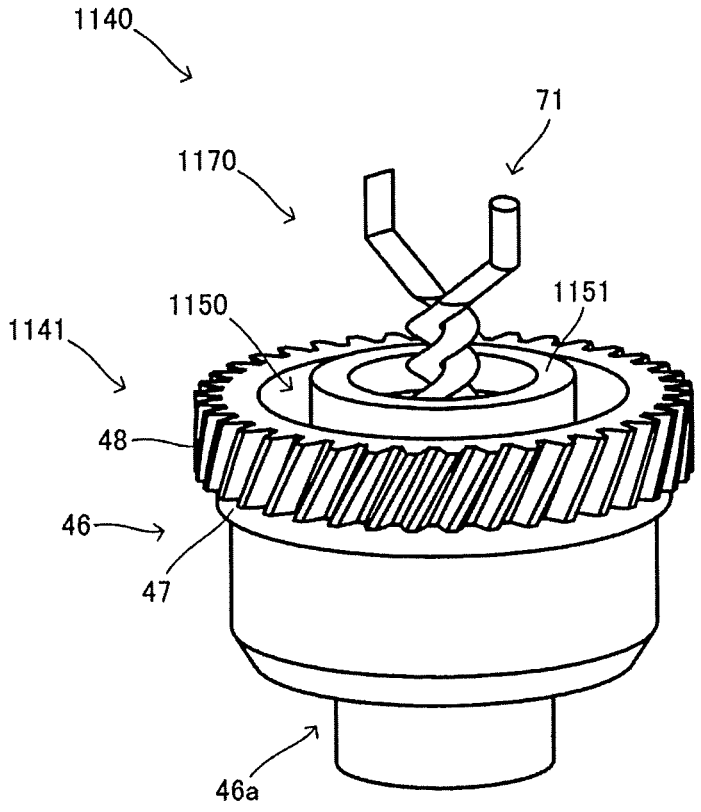
FIG. 74 is a perspective view of an end member 1140.
Figure 75:
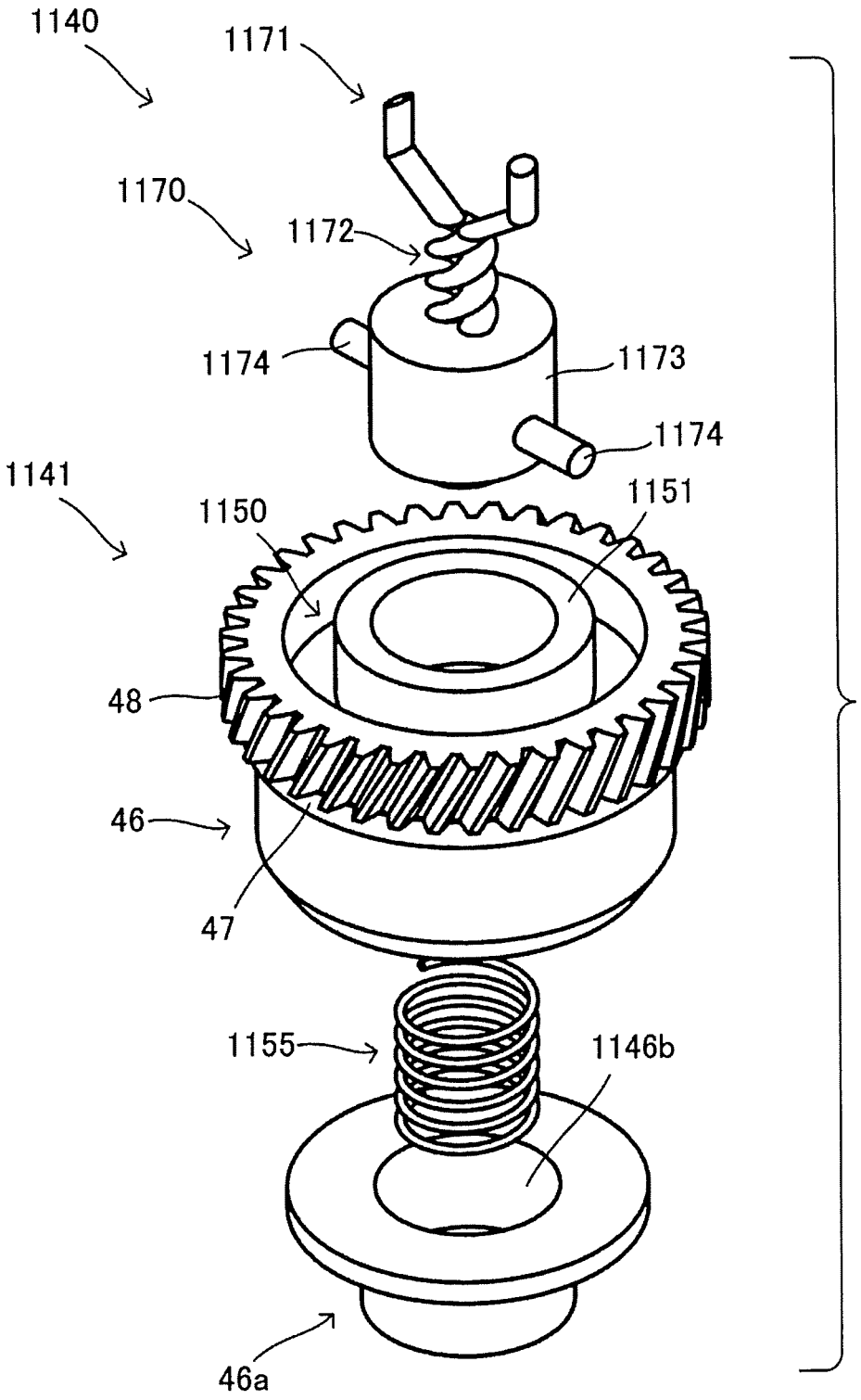
FIG. 75 is an exploded perspective view of the end member 1140.

FIGS. 74 and 75 illustrate views for describing a twelfth aspect. FIG. 74 is a perspective view of an end member 1140, and FIG. 75 is an exploded perspective view of the end member 1140. The end member 1140 is also a member which is attached to the end portion of the photoreceptor drum 35. The end member 1140 is provided with a bearing member 1141 and a shaft member 1170.

The bearing member 1141 is a member fixed to the end portion of the photoreceptor drum 35. In the aspect, the bearing member 1141 also includes the tubular body 46, the contact wall 47, and the gear 48. Since these can be employed with the same configuration as that of the bearing member 41 which is already described, the description thereof will be omitted here. In addition, in the aspect, in the tubular body 46, the bottom portion 46*a* is also provided on the side opposite to the side on which the coupling member 71 of the shaft member 1170 is provided to protrude, and at least a part thereof is blocked. Further, in the aspect, a recess portion 1146*b* into which an elastic member 1155 is inserted is formed at the center position of the bottom portion 46*a*.

Figure 76:
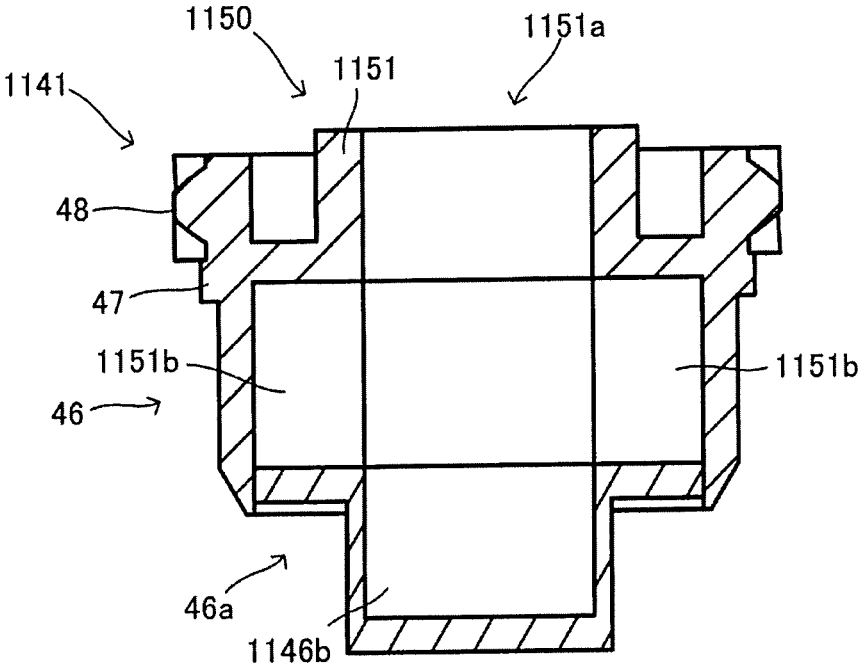
FIG. 76 is a sectional view of a part of a bearing member 1141.

A holding portion 1150 is provided on the inside of the tubular body 46 which has a tubular shape. The holding portion 1150 is a part which holds one end side (base end portion side) of the shaft member 1170 which will be described later on the inside thereof. In addition, the holding portion 1150 includes a base end holding portion 1151 and an elastic member 1155. FIG. 76 illustrates a sectional view along the shaft line of the bearing member 1141. Here, the elastic member 1155 is not limited thereto as long as the elastic member 1155 is a coiled spring and can generate the biasing force in the aspect.

The base end holding portion 1152 is a tubular member which is coaxial to the shaft line of the tubular body 46, and the inner diameter of a tubular inner hole 1151*a* has a size by which the base end portion 1173 of the shaft member 1170 can pass therethrough.

In addition, the base end holding portion 1152 has a groove 1151*b* which extends in parallel to the shaft line of the tubular body 46 on the inner wall of the tubular body 46. The groove 1151*b* is configured to be movable in a direction in which the tip end of a rotating force transmission pin 1174 which will be described later is inserted and the groove 1151*b* extends. In the aspect, two grooves 1151*b* are provided so as to oppose each other across the shaft line on the inner wall surface of the tubular body 46.

The material which configures the bearing member 1141 can be considered similar to the above-described bearing member 41.

Figure 77:
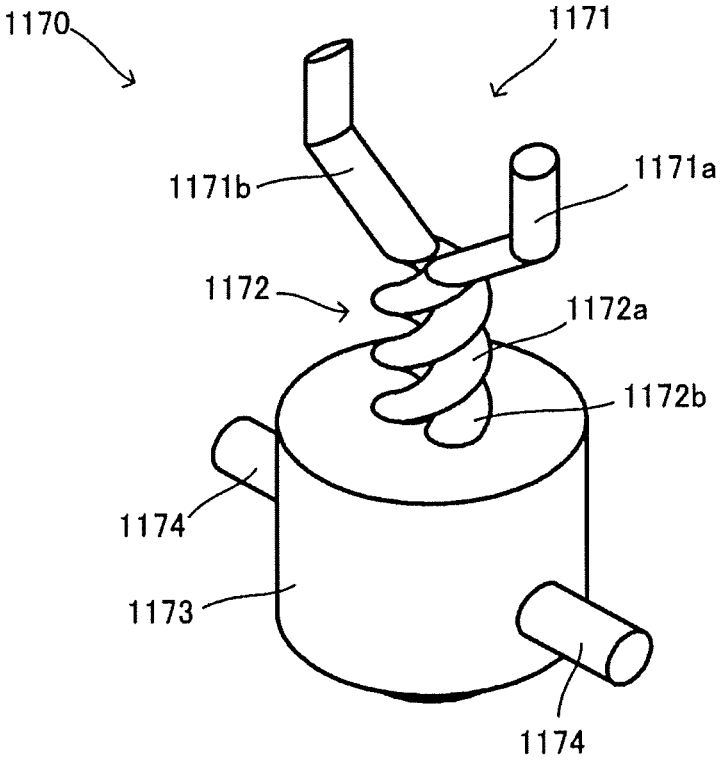
FIG. 77 is a perspective view of a shaft member 1170.

Next, the shaft member 1170 of the end member 1140 will be described. FIG. 77 is a perspective view of the shaft member 1170. The shaft member 1170 includes a coupling member 1171, a rotating shaft 1172, the base end portion 1173, and the rotating force transmission pin 1174.

The rotating shaft 1172 is a shaft-like member that functions as a rotating force transmission portion which transmits the rotating force received by the coupling member 1171. In the aspect, the rotating shaft 1172 is formed as one rotating shaft by twisting the wire rod 1172*a* and the wire rod 1172*b* which are two elastically deformable wire-like members. Therefore, the wire rod 1172*a* and the wire rod 1172*b* are intertwined so as to be twisted while being spirally extended. Accordingly, when the rotating shaft 1172 receives the rotating force around the shaft line, a configuration in which the wire rods are entangled so as to tighten each other against one rotation, and entangled so as to loosen with respect to the other rotation, is achieved.

Examples of the material that can act in this manner can include metal materials and resin materials.

The coupling member 1171 of the aspect is also disposed on one end side in the shaft line direction of the rotating shaft 1172, and by engaging with the pin 12*b* of the driving shaft 12 (refer to FIG. 3), the coupling member 1171 functions as a rotating force receiving portion that transmits the rotating force from the image forming apparatus main body to the end member. Therefore, two projections 1171*a* and 1171*b* extend to be capable of being across the shaft portion 12*a* (refer to FIG. 3) of the driving shaft 12 so as to be engaged with the two pins 12*b* at an interval.

One of the projections 1171*a* of the coupling member 1171 of the aspect is connected to one wire rod 1172*a* of the rotating shaft 1172 and the other projection 1171*b* is connected to the other wire rod 1172*b* of the rotating shaft 1172.

However, the coupling member is not limited thereto, and the above-described coupling member can also be employed.

The base end portion 1173 is a columnar member disposed on the side opposite to the side on which the coupling member 1171 is disposed, and is disposed such that the shaft line of the column matches the shaft line of the shaft member 1170, in the end portion of the rotating shaft 1172.

The rotating force transmission pin 1174 is a rod-like member provided so as to protrude from the outer circumferential portion of the base end portion 1173. Two rotating force transmission pins 1174 are disposed so as to be orthogonal to the shaft line of the shaft member 1170 from the outer circumferential portion of the base end portion 1173. Therefore, the two rotating force transmission pins 1174 are positioned opposite to each other across the shaft line of the shaft member 1170.

Figure 78:
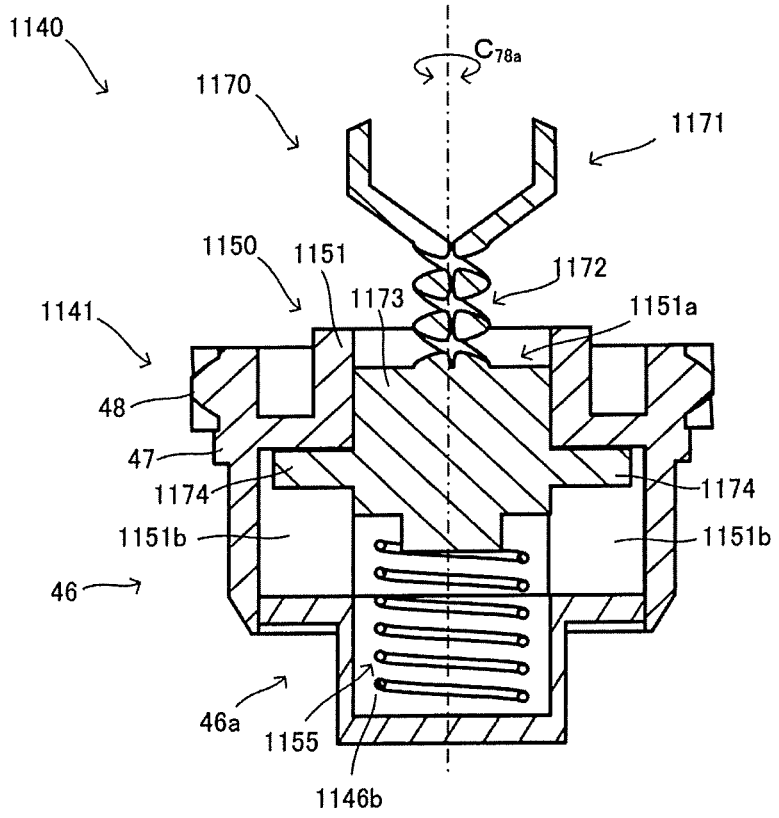
FIG. 78 is a sectional view of the end member 1140.

By combining the bearing member 1141 and the shaft member 1170 with each other as follows, the end member 1140 is made. By describing the combination, the shape, the size, or the positional relationship of the bearing member 1141 and the shaft member 1170 are further understood. FIG. 78 illustrates a sectional view of the end member 1140 along the shaft line direction.

As can be ascertained from FIG. 78, the elastic member 1155 is disposed in the recess portion 1146*b* on a side that becomes the inside of the tubular body 46 on the surface of the bottom portion 46*a*. Therefore, one end side of the elastic member 1155 is supported by the bottom portion 46*a*. In addition, a base end portion 1173 of the shaft member 1170 is disposed on the other end side of the elastic member 1155, and the base end portion 1173 is accommodated on the inside of the hole 1151*a* of the base end holding portion 1151. Accordingly, the rotating shaft 1172 and the coupling member 1171 are positioned so as to protrude from the side opposite to the bottom portion 46*a* of the tubular body 46. In addition, the rotating force transmission pin 1174 is inserted into the groove 1151*b* of the base end holding portion 1151 and disposed.

In this manner, the end member 1140 operates as follows. In other words, since the rotating shaft 1172 of the end member 1140 is configured such that two elastically deforming wire rods are twisted as described above, the rotating shaft itself can rotate around the shaft line as indicated by an arrow $C_{78a}$ so as to be twisted. Therefore, even when the photoreceptor drum including the end member 1140 is engaged with the driving shaft 12 (refer to FIG. 3) of the image forming apparatus, even when the driving shaft 12 and the coupling member 1171 are in contact with each other, the rotation of the rotating shaft 1172 becomes flexible so as not to interrupt the engagement thereof.

Accordingly, similar to the end member 40, it is possible to smoothly attach and detach the process cartridge to and from the apparatus main body 10.

Meanwhile, after the driving shaft 12 and the coupling member 1171 are engaged with each other, when the driving shaft 12 rotates, the rotational direction of the driving shaft 12 is twisted such that the two wire rods 1172*a* and 1172*b* of the rotating shaft 1172 are tightened, and accordingly, in the fastened state, the rotation due to the deformation of the rotating shaft 1172 itself becomes impossible, and the rotating force is transmitted to the base end portion 1173. The rotating force transmission pin 1174 is rotated by the rotation of the base end portion 1173, and is hooked to the wall surface of the groove 1151*b* provided in the bearing member 1141, and the rotating force is transmitted to the bearing member 1141. Accordingly, the end member 1140 rotates and the rotating force can be transmitted to the photoreceptor drum 35.

Therefore, after the coupling member 1171 and the driving shaft 12 are engaged with each other, it is possible to appropriately transmit the rotating force.

The invention contains subject matter related to Japanese Patent Application No. 2015-238591 filed in the Japanese Patent Office on Dec. 7, 2015, the entire contents of which are incorporated herein by reference.

REFERENCE SIGNS LIST

10 IMAGE FORMING APPARATUS MAIN BODY
20 PROCESS CARTRIDGE
30 PHOTORECEPTOR DRUM UNIT
35 PHOTORECEPTOR DRUM (COLUMNAR ROTATING BODY)
40, 140, 240, 340, 440, 540, 640, 740, 840, 940, 1040, 1140 END MEMBER
41, 141, 241, 341, 441, 541, 641, 741, 841, 941, 1041, 1141 BEARING MEMBER
50, 150, 250, 350, 450, 550, 650, 750, 850, 950, 1050, 1150 HOLDING PORTION
70, 170, 270, 370, 470, 570, 670, 770, 870, 970, 1070, 1170 SHAFT MEMBER

The invention claimed is:

1. An end member which is disposed in an end portion of a columnar rotating body, the end member comprising:
a shaft member; and
a bearing member which holds the shaft member,
wherein:
the shaft member comprises:
a rotating shaft; and
a rotating force receiving portion which is provided on one end side of the rotating shaft, is engageable with a rotating force imparting portion of an image forming apparatus main body, and receives a rotating force from a driving shaft in the engaged posture; and
at least one of the shaft member and the bearing member has a mechanism where the rotating force receiving portion moves in a shaft line direction without being inclined by a movement of the rotating force receiving portion in a direction orthogonal to the shaft line direction.

2. An end member which is mounted on an image forming apparatus main body having a groove that guides a rotating force receiving portion, and is disposed in an end portion of a columnar rotating body, the end member comprising:
a shaft member; and
a bearing member which holds the shaft member,
wherein:
the shaft member comprises:
a rotating shaft; and
a rotating force receiving portion which is provided on one end side of the rotating shaft, is engageable with a rotating force imparting portion of the image forming apparatus main body, and receives a rotating force from a driving shaft in the engaged posture; and
at least one of the shaft member and the bearing member has a mechanism where the rotating force receiving portion moves in a shaft line direction without being inclined by a movement of the rotating force receiving portion in a direction orthogonal to the shaft line direction.

3. The end member according to claim 1 or 2, wherein:
the mechanism comprises a projection provided in the bearing member; and
the rotating force receiving portion moves by the shaft member moving along a surface of the projection.

4. The end member according to claim 1 or 2, wherein:

the mechanism comprises a cam member provided with a pin having a shaft line that becomes a twist position; and the rotating force receiving portion moves by inclination of the cam member.

5. The end member according to claim 1 or 2, wherein the mechanism comprises:

a hole that is provided in the bearing member and is twisted such that a sectional shape is deviated along a shaft line direction; and a twisted pillar-like member which is provided in the shaft member and is inserted into the hole.

6. The end member according to claim 1 or 2, wherein the mechanism comprises an inclined surface provided in the bearing member, and is configured such that the shaft member moves also in the shaft line direction by the shaft member moving in a direction orthogonal to the shaft line while sliding on the inclined surface.

7. An end member which is disposed in an end portion of a columnar rotating body, the end member comprising:

a shaft member; and a bearing member which holds the shaft member, wherein:

the shaft member comprises:

a rotating shaft;

a rotating force receiving portion which is provided on one end side of the rotating shaft, is engageable with a rotating force imparting portion of an image forming apparatus main body, and receives a rotating force from a driving shaft in the engaged posture; and a base end portion which becomes thin toward a tip end and is provided in an end portion on a side opposite to a side on which the rotating force receiving portion is disposed;

the bearing member comprises a projection which extends toward a shaft line direction; and the rotating force receiving portion is movable in a direction orthogonal to a shaft line by the base end portion moving along a surface of the projection.

8. The end member according to claim 7, further comprising:

a rotating force transmission pin for transmitting a rotating force in the base end portion.

9. The end member according to claim 8, further comprising:

a rotating force receiving portion for receiving a rotating force from the rotating force transmission pin in the bearing member.

10. An end member which is disposed in an end portion of a columnar rotating body, the end member comprising:

a shaft member; and a bearing member which holds the shaft member, wherein:

the shaft member comprises:

a rotating shaft; and a rotating force receiving portion which is provided on one end side of the rotating shaft, is engageable with a rotating force imparting portion of an image forming apparatus main body, and receives a rotating force from a driving shaft in the engaged posture;

at least one of the shaft member and the bearing member has a mechanism which moves the shaft member in a shaft line direction without inclining the rotating force receiving portion by providing a member which presses the shaft member in the shaft line direction due to deformation caused by an external force.

11. A photoreceptor drum unit, comprising:

a photoreceptor drum which is the columnar rotating body; and the end member according to any one of claims 1, 2, 7 and 10 which is disposed at least one end portion of the photoreceptor drum.

12. A process cartridge, comprising:

a housing; and the photoreceptor drum unit according to claim 11 which is held by the housing.

13. The process cartridge according to claim 12, wherein the housing comprises a biasing member holding the shaft member in a posture of being deviated from a shaft line of the bearing member.

14. An image forming apparatus, comprising:

the end member according to any one of claims 1, 2, 7 and 10; and an image forming apparatus main body in which a groove which guides the rotating force receiving portion provided in the shaft member of the end member is formed.

* * * * *